US012458076B2

(12) United States Patent
Rushton

(10) Patent No.: US 12,458,076 B2
(45) Date of Patent: Nov. 4, 2025

(54) SUPPORTING GARMENTS WITH VERSATILE BANDS AND STRAPS

(71) Applicant: Linderton Holdings, Inc., Tampa, FL (US)

(72) Inventor: Danielle Rushton, Tampa, FL (US)

( * ) Notice: Subject to any disclaimer, the term of this patent is extended or adjusted under 35 U.S.C. 154(b) by 0 days.

(21) Appl. No.: 17/960,674

(22) Filed: Oct. 5, 2022

(65) Prior Publication Data

US 2023/0040804 A1 Feb. 9, 2023

Related U.S. Application Data

(63) Continuation-in-part of application No. 16/285,089, filed on Feb. 25, 2019, now Pat. No. 11,490,664.

(60) Provisional application No. 62/771,576, filed on Nov. 26, 2018, provisional application No. 62/634,293, filed on Feb. 23, 2018.

(51) Int. Cl.
*A41C 3/00* (2006.01)
*A41C 3/08* (2006.01)

(52) U.S. Cl.
CPC ..... *A41C 3/0021* (2013.01); *A41C 3/08* (2013.01)

(58) Field of Classification Search
CPC ..... A41C 3/0021; A41C 3/08; A41F 1/006
USPC ..... 450/89
See application file for complete search history.

(56) References Cited

U.S. PATENT DOCUMENTS

| | | | | |
|---|---|---|---|---|
| 8,425,274 | B1 * | 4/2013 | Ratcliff | A44C 5/00 450/86 |
| 9,462,833 | B1 * | 10/2016 | Spaulding | A41D 7/005 |
| 11,484,069 | B2 * | 11/2022 | Edmark | A41C 3/02 |
| 11,871,801 | B1 * | 1/2024 | Ratcliff | A44C 15/009 |

* cited by examiner

*Primary Examiner* — Timothy K Trieu

(57) ABSTRACT

New body supporting and enhancing garment techniques are provided. In some embodiments, new types of bras and other garments are provided, along with new sizing systems for fitting them to person's bodies. For example, a new form of bra having a reversible front fastener and a plurality of back bands provided in an under/over configuration, directly abutting one another, and having no gap, or substantially no gap between them. In other embodiments, shoulder straps are provided with location-variable, reversible attachment ends, having reversible fasteners, which engage with the back of a main body of the bra at a plurality of possible attachment positions.

20 Claims, 34 Drawing Sheets

707 705 705

| | | Cup Size | | | | | | | | |
|---|---|---|---|---|---|---|---|---|---|---|
| | | A | B | C | D | DD | DDD | E | F | |
| Halter/ Side Lateral Length | H14/S9.5 | H14A | H14B | H14C | H28D | H28DD | H28DDD | H28E | H28F | 703 |
| | H16/S10 | H16A | H16B | H16C | H16D | H16DD | H16DDD | H16E | H16F | 703 |
| | H18/S11.5 | H18A | H18B | H18C | H18D | H18DD | H18DDD | H18E | H18F | 703 |
| | H20/S13 | H20A | H20B | H20C | H20D | H20DD | H20DDD | H20E | H20F | 703 |
| | H22/S14 | H22A | H22B | H22C | H22D | H22DD | H22DDD | H22E | H22F | 703 |
| | H24/S15 | H24A | H24B | H24C | H24D | H24DD | H24DDD | H24E | H24F | 703 |
| | H26/S15.5 | H26A | H26B | H26C | H26D | H26DD | H26DDD | H26E | H26F | 703 |
| | | 701 | 701 | 701 | 701 | 701 | 701 | 701 | 701 | |

700

Fig. 7

1207 1205 1205

Example - Cup Size A

| | | Hemi Band (Top) | | | | | | | | |
|---|---|---|---|---|---|---|---|---|---|---|
| | | He13 | He15 | He17 | He19 | He21 | He23 | He25 | He28 | |
| Wrap Band (Bottom) | Wr24 | 24/13A | 24/15A | 24/17A | | | | | | 1203 |
| | Wr26 | | 26/15A | 26/17A | 26/19A | | | | | 1203 |
| | Wr28 | | 28/15A | 28/17A | 28/19A | 28/21A | | | | 1203 |
| | Wr30 | | | 30/17A | 30/19A | 30/21A | 30/23A | | | 1203 |
| | Wr32 | | | 32/17A | 32/19A | 32/21A | 32/23A | 32/25A | | 1203 |
| | Wr34 | | | | 34/19A | 34/21A | 34/23A | 34/25A | 34/28A | 1203 |
| | Wr36 | | | | 36/19A | 36/21A | 36/23A | 36/25A | 36/28A | 1203 |
| | Wr38 | | | | | 38/21A | 38/23A | 38/25A | 38/28A | 1203 |

1201 1201 1201 1201 1201 1201 1201 1201

1200

Fig. 12

2907 2905 2905

Example - Cup Size A

| | | Neck/Lower Lateral Strap | | | | | | | |
|---|---|---|---|---|---|---|---|---|---|
| | | NL17 | NL18 | NL19 | NL20 | NL21 | NL22 | NL23 | |
| Top Lateral Strap | TL5.5 | 5.5/17A | 5.5/18A | 5.5/19A | | | | | 2903 |
| | TL6 | | 6/18A | 6/19A | 6/20A | | | | 2903 |
| | TL6.5 | | 6.5/18A | 6.5/19A | 6.5/20A | 6.5/21A | | | 2903 |
| | TL7 | | | 7/19A | 7/20A | 7/21A | 7/22A | | 2903 |
| | TL7.5 | | | 7.5/19A | 7.5/20A | 7.5/21A | 7.5/22A | 7.5/23A | 2903 |
| | TL8 | | | | 8/20A | 8/21A | 8/22A | 8/23A | 2903 |
| | | 2901 | 2901 | 2901 | 2901 | 2801 | 2901 | 2901 | |

2900

Fig. 29

SUPPORTING GARMENTS WITH VERSATILE BANDS AND STRAPS

CROSS-REFERENCE TO RELATED APPLICATIONS

This application is a continuation-in-part of U.S. patent application Ser. No. 16/285,089, titled "Supporting Garments and Sizing Systems," filed Feb. 25, 2019, which claims the benefit of priority to U.S. Provisional Application Nos. 62/634,293, filed Feb. 23, 2018, titled "Bra with Support and Adjustability," and 62/771,576, filed Nov. 26, 2018, titled "Supporting Garments and Sizing System," both of which are herein incorporated by reference in their entirety.

FIELD OF THE INVENTION

The present invention relates to the field of body supporting garments and systems. More specifically, the present invention also relates to brassieres (hereinafter "bras") and other supporting garments for women. The present invention also relates to sizing systems for bras and other supporting garments.

BACKGROUND

Breast supporting and covering garments date back to the island of Crete, in ancient Greece, where a garment similar to the modern corset was used to partially support and present the breasts, enhancing cleavage. This garment did not cover the breasts generally, but women from ancient Greece and Rome were also known to cover their breasts with simple garments, such as bands of wool or linen, tied or pinned behind the back. To this day, bras share one or more of the same goals of these early garments: supporting, covering and enhancing appearance.

Modern bras have taken a number of alternative forms, each representing a different balance of those goals. Some recent bra designs emphasize cleavage enhancement, improving a woman's appearance, such as the "push-up bra," which lifts and pushes the breasts together, making them more prominent in the decolletage. Other recent bra designs enhance the apparent size of a woman's breasts, by lifting them and adding padding. Conversely, some bras are primarily dedicated to support, such as the "sports bra," which tends to compress and reduce the movement and appearance of the breasts during athletic pursuits.

Breast supporting and covering garments are not limited to bras. In addition to other dedicated supporting garments, like the corset or bustier, certain modern tops, dresses and swimsuits, for example, include integrated support for the breasts.

Sizing Systems

Bra sizes have been based on two components for several decades: (1) cup size; and (2) band length. Cup size relates to systems for sizing bra cups, which are designed to receive and support a woman's breasts, while band length relates to systems for sizing bra bands, which hold bras in place by surrounding part of a woman's back, and are connected to part of the remainder of the bra (other than the bra bands). Typically, the circumference of a woman's torso is measured, just below the breasts, in standard units of measurement (e.g., inches), using a cloth measuring tape to measure the woman's band length. The same measuring tape is then lifted several inches to the mid-breast level, measuring the circumference of the entire bust (a woman's chest and breasts) and back, (a.k.a., a "bust size"). Cup size can then be determined by subtracting the band length measurement from the bust size measurement. The combination of the two sizes, meaning the band length (e.g., 36 inches) and cup size (e.g., size C), yields a conventional "bra size," for example, "36C," which has been reported as a frequently occurring conventional bra size. The chart below is an example matrix of some conventional bra sizes, which may be used in the United States.

TABLE 1

Matrix of Bra Sizes (United States)

| | | Cup Size | | | | | | | | |
|---|---|---|---|---|---|---|---|---|---|---|
| | | A | B | C | D | DD | DDD | E | F | G |
| Band Size (Inch) | 28 | 28A | 28B | 28C | 28D | 28DD | 28DDD | 28E | 28F | 28G |
| | 30 | 30A | 30B | 30C | 30D | 30DD | 30DDD | 30E | 30F | 30G |
| | 32 | 32A | 32B | 32C | 32D | 32DD | 32DDD | 32E | 32F | 32G |
| | 34 | 34A | 34B | 34C | 34D | 34DD | 34DDD | 34E | 34F | 34G |
| | 36 | 36A | 36B | 36C | 36D | 36DD | 36DDD | 36E | 36F | 36G |
| | 38 | 38A | 38B | 38C | 38D | 38DD | 38DDD | 38E | 38F | 38G |
| | 40 | 40A | 40B | 40C | 40D | 40DD | 40DDD | 40E | 40F | 40G |
| | 42 | 42A | 42B | 42C | 42D | 42DD | 42DDD | 42E | 42F | 42G |
| | 44 | 44A | 44B | 44C | 44D | 44DD | 44DDD | 44E | 44F | 44G |

The size chart shown above, in Table 1, is incomplete, for simplicity of presentation, but includes the average bra size in the U.S., in 1995 (34B) and the present day (36C), according to LiveScience.com. In actuality, cup sizes may ascend higher (e.g., through the letter "R") in some systems, and band sizes also ascend far higher and lower, and through more increments, than shown above, in some sizing systems, yielding many more sizes. Yet, even in the conventional matrix of conventional bra sizes shown above, 81 different bra sizes are indicated. Bra sizing standards vary considerably between countries and manufacturers. The sizes shown are also misleading in their apparent simplicity, in that, in conventional bra sizing systems, cup sizes also change with band size, across various bra sizes. For example, a 38C may have a larger cup size than a 32C, notwithstanding the same indicated cup size of "C".

In some existing bras, bands are included that open and close the bra with a hook-and-eye fasteners. Some such bras attempt to better fit a woman's body, over time, as materials in the bras may stretch out, with three different sets of eye fastener components for each hook of the hook-and-eye fastener, at different positions along the length of the band. Thus, as such a bra stretches out, and no longer fits, a user may fasten the hook-and-eye fastener to the next, tighter position, in an attempt to counteract the poor fit.

It should be noted that some of the disclosures set forth as background, such as, but not limited to, the above language under the heading "Background," do not relate exclusively to prior art and the state of the art in the field(s) of the invention, and should not be construed as an admission with respect thereto.

SUMMARY OF THE INVENTION

New body supporting and enhancing garment techniques are provided. In some embodiments, new types of strapless, backless bras and other garments are provided, along with new sizing systems for fitting them to women's bodies. For example, new types and positions of bra straps and bands are provided, in some embodiments. In other embodiments, new systems of internal and external attachment points, for reversibly connecting adhesives, straps, clothing and accessories to bras and other garments, are also provided.

These and other aspects of the invention will be made clearer below, in other parts of this application. This Summary, the Abstract, and other parts of the application, are for ease of understanding only, and no part of this application should be read to limit the scope of the invention, whether or not it references matter in any other part.

BRIEF DESCRIPTION OF THE DRAWINGS

FIG. 7 depicts a table, coding and other aspects of an example new sizing system corresponding with backless bras and other garments, according to some embodiments of the present invention.

FIG. 12 depicts a table, coding and other aspects of an example new sizing system corresponding with strapless bras and garments, in accordance with some embodiments of the present invention.

FIG. 29 depicts a table, coding and other aspects of an example new sizing system corresponding with bras and garments with minimized back components, as discussed above in relation to FIGS. 25 and 26, in accordance with some embodiments of the present invention.

DETAILED DESCRIPTION OF THE INVENTION

The example embodiments of the invention presented herein are directed to new body supporting and enhancing garment techniques, which are now described herein. This description is not intended to limit the application of the example embodiments presented herein. In fact, after reading the following description, it will be apparent to one skilled in the relevant art(s) how to implement the following example embodiments in alternative embodiments.

Figure 1:
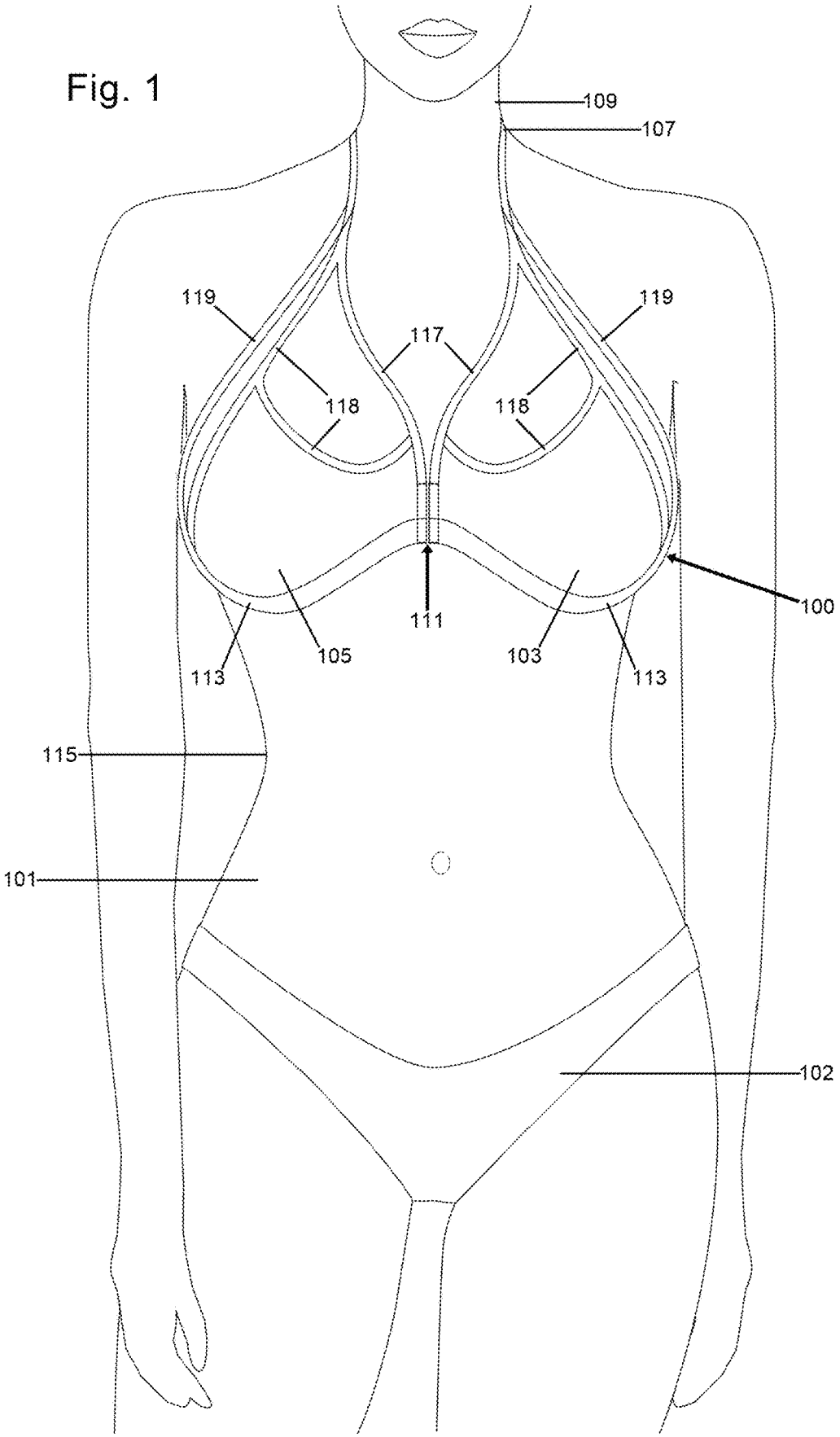
FIG. 1 is a front view of an example backless bra, in place on an example woman's body, in accordance with some embodiments of the present invention.

FIG. 1 is a front view of an example backless bra 100, in place on an example woman's body 101, in accordance with some embodiments of the present invention. Generally speaking, as with any other bra or other supporting garment set forth in the present application, backless bra 100 may be worn alone, or with other garments, such as example separate bikini bottom 102. In some embodiments, backless bra 100, or any other body supporting or enhancing bra or garment incorporating any aspect of the invention, may be worn over and/or under blouses, dresses, or other tops or garments, or pluralities thereof. In still other embodiments, backless bra 100 or any other body supporting or enhancing bra or garment incorporating any aspects of the invention, may be integrated with blouses, dresses and other tops or garments, or pluralities thereof (not pictured). The particular form of supporting and enhancing garment pictured, namely, backless bra 100, is merely an example embodiment, and any aspect of the invention may be carried out with any suitable top or other body supporting and enhancing garment in other embodiments, as will be apparent to those of ordinary skill in the art.

In particular, in some embodiments, backless bra 100 may be integrated with other backless articles of clothing, such as backless dresses and halters. In one embodiment, a backless dress or top may be worn directly over backless bra 100, covering just backless bra 100, or nearly so. For example, in some embodiments, a backless dress or top covers 5% more, or 5% less, of woman's body 101 laterally, vertically, or in any other direction, than backless bra 100. In some embodiments, such a backless dress or top may be selected with a size just concealing backless bra 100, and leaving the remainder of woman's body 101 bare, giving the impression that the woman may not be wearing backless bra 100.

Backless bra 100 may comprise two breast-supporting cup sections, including left breast-supporting cup section 103 and right breast-supporting cup section 105, joined together by a neck strap 107, which, among other things, may be drawn around the back of the woman's neck 109, in some embodiments. In some embodiments, left breast-supporting cup section 103 and right breast-supporting cup section 105 are each bra cups. In some embodiments, left breast-supporting cup section 103 and right breast-supporting cup section 105 each include bra cups. Left breast-supporting cup section 103 and right breast-supporting cup section 105 also may be variably fastened together with a front fastener 111, attached to left breast-supporting cup section 103 and right breast-supporting cup section 105. In some embodiments, fastener 111 is included within left breast-supporting cup section 103 and right breast-supporting cup section 105. In some embodiments, fastener 111 is included within one, but not both, of cup sections 103 and/or 105. In some embodiments, front fastener 111 is, or includes, any form of variable, secure fastener or closure for joining two structural pieces together, known in the art. As examples of just some of such possible fasteners, in accordance with some embodiments, front fastener 111 includes one or more hook-and-eye fasteners. In some embodiments, front fastener 111 includes a zipper. In other embodiments, front fastener 111 includes a snap fastener. In still other embodiments, front fastener 111 includes a hook-and-loop (such as VELCRO) fastener. In still other embodiments, front fastener 111 includes a button and buttonhole. In still other embodiments, front fastener 111 includes an adhesive. In other embodiments, front fastener 111 includes a magnetic fastener. In still other embodiments, front fastener 111 includes a pin fastener. In still other embodiments, front fastener 111 includes a clip fastener. Similarly, neck strap 107 may be reversibly separated in some embodiments. For example, neck strap 107 may be reversibly separated at a fastening point behind the woman's neck, in some embodiments. As another example, neck strap 107 may be reversibly separated at one or more connection points with left breast-supporting cup section 103 and/or right breast-supporting cup section 105, in some embodiments. In some embodiments, neck strap 107 may be separated at any other point on or about neck strap 107. Each of left breast-supporting cup section 103 and right breast-supporting cup section 105 may have a curved lower support 113, complementarily shaped and configured to securely hook under and hold the woman's breasts from underneath, in some embodiments. In some embodiments, curved lower support 113 may be an underwire support.

In one method of donning backless bra 100, a user may place left breast-supporting cup section 103 or right breast-supporting cup section 105 over her left or right breast, respectively, and may place one of underwire supports 113 at or under the inframammary fold of that breast, hooking it under that breast, and holding that breast upward. The user may then pull neck strap 107 over her head and behind her neck (e.g., preferably in elastic embodiments of neck strap 107), and/or, if separated with a neck strap fastener in a particular embodiment, join neck strap 107 together and/or to one or both of left breast-supporting cup section 103 and/or right breast-supporting cup section 105. In some embodiments, neck strap 107 may be adjustable in length, whether or not neck strap 107 comprises a neck strap fastener. In some embodiments, neck strap 107 may have an adjustable length through any strap- or band-lengthening technique known in the art. For example, in some embodiments, neck strap 107 may comprise a slide (a.k.a. a "slider") and looped, folded or otherwise doubled strap fabric around a turnstile (such as a ring) at location(s) along the neck strap 107, for providing lengthening and shortening of neck strap 107. In some such embodiments, neck strap 107 may be lengthened by sliding the slider in one direction along the length of neck strap 107, and shortened by sliding the slider in an opposite direction along the length of neck strap 107. In some embodiments, neck strap 107 may be loosened prior to donning, easing its passage over the user's head, and then tightened once in place, behind her neck. Similarly, any other strap or band of material set forth in the present application, with respect to any bra or other supporting garment set forth in any embodiment set forth in the present application, may be of adjustable in length through any strap- or band-lengthening technique known in the art. In some embodiments, any such strap or band of material may include a slider, and may be adjustable in length via such a slider. In some embodiments, one or more straps or bands of material set forth in the present application may be of an adjustable length. In any event, any strap or band of material that is so adjustable in length may be adjustable in length according to any strap- or band-lengthening technique known in the art.

Figure 2:
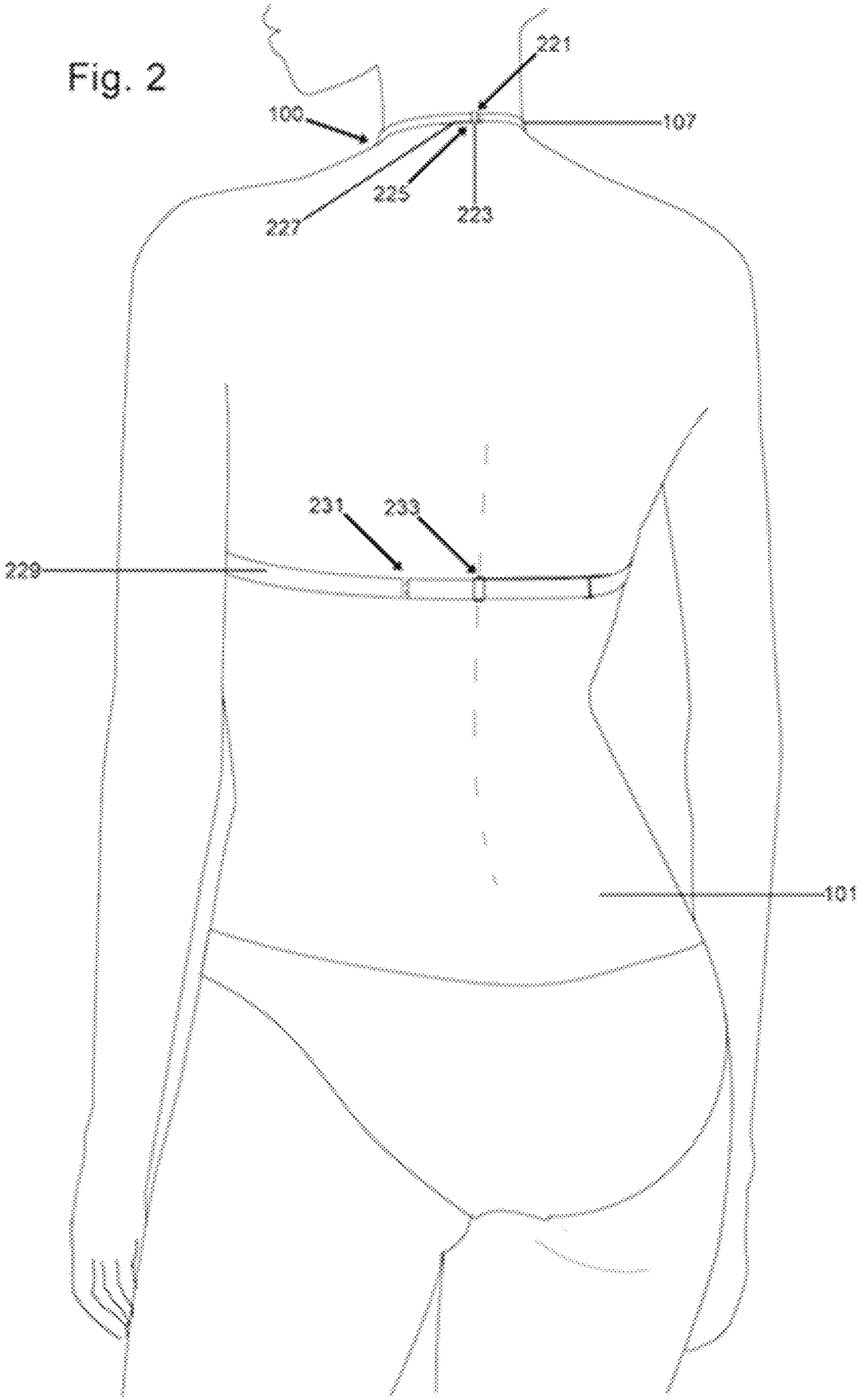
FIG. 2 is a rear perspective view of the same example backless bra, in place on the same woman's body of FIG. 1, above, illustrating additional embodiments of the present invention.

In some embodiments, an optional lower supporting band may be included in bra 100, as shown in FIG. 2, as optional lower supporting band 229. In such embodiments, such a lower supporting band may be fastened or separated with the same, or a similar, front fastener 111, which is attached to two ends of the lower supporting band. In other embodiments, however, front fastener 111 may not separate or close such a supporting band, even when such a supporting band 229 is present in a particular embodiment of the invention. In some embodiments, the supporting band 229 may be sufficiently elastic to allow donning on woman's body 101 from overhead or below, by including an elastic device and/or material. In some embodiments of the present invention, any band or strap of material set forth in this application may include a variable, reversible fastener or closure, for separating or closing such band or strap of material. In some embodiments, a rear closure is included in such a supporting band 229. In the instance of a rear closure for the supporting band 229, the user may first wrap the lower supporting band around or about her waist 115, preferably with the closure infront initially, to fasten it within her field of vision. The user may then swivel the supporting band and bra 180 degrees on her body 101, inserting her breasts into left breast-supporting cup section 103 and right breast-supporting cup section 105, and then donning the neck strap 107 in the position pictured, in some embodiments.

The particular example methods of donning set forth in the present application are illustrative, not limiting or exhaustive, of the many alternative possible embodiments of methods of donning the bras or other garments set forth. Many alternative methods of donning the bras or other supporting garments set forth in the present application will be readily apparent to persons of ordinary skill in the art, and are within the scope of the invention. Similarly, the example embodiments of bras, garments, devices and systems set forth in the present application are illustrative, not limiting or exhaustive, of the many alternative possible embodiments of bras, garments, devices and systems carrying out aspects of the present invention, as will be readily apparent to such persons of ordinary skill in the art.

In some embodiments, backless bra 100 may also comprise a series of additional suspending straps, or strap sets, attached at various points to neck strap 107, left breast-supporting cup section 103 and right breast-supporting cup section 105, such as: (1) inner set of suspending straps 117, mid set of suspending straps 118, and (3) a set of side lateral suspending straps 119. By attaching at different points along neck strap 107, and left breast-supporting cup section 103, and right breast-supporting cup section 105, these sets of suspending straps each serve to selectively distribute support to a woman's breasts, and better fit and conform to a woman's body, such as woman's body 101. In some embodiments, each such suspending strap is individually tailored to fit the dimensions of corresponding parts of a woman's body. In some embodiments, each such suspending strap is adjustable in length to fit the dimensions of corresponding parts of a woman's body. In particular, set of side lateral suspending straps 119 (a.k.a., "supplemental straps," in some embodiments) can be tailored or adjusted in length to alter the cup size and shape of either or both of left breast-supporting cup section 103 and right breast-supporting cup section 105, to better match, hold and conform to the woman's breasts, in some embodiments. In some embodiments, set of side lateral suspending straps 119 can be adjusted in length to better match, hold and conform to the side, lateral area of her body 101, underneath set of side lateral suspending straps 119 in FIG. 1 (hereinafter, the "transverse side lateral area") of the woman's body 101.

In some embodiments, additional pieces of fabric or other material (not pictured) may be included between any two straps of backless bra 100. For example, such a piece of fabric may be provided between, and attached to, one of mid set of suspending straps 118, on the right-hand side of the figure, and one of inner set of suspending straps 117, also on the right-hand side of the figure, in some embodiments. In some such embodiments, such a piece of material covers the entire area between one of mid set of suspending straps 118, on the right-hand side of the figure, and one of inner set of suspending straps 117, also on the right-hand side of the figure. Similarly, in some embodiments, a piece of fabric may be provided between one of mid set of suspending straps 118, on the left-hand side of the figure, and one of inner set of suspending straps 117, also on the left-hand side of the figure. In some such embodiments, such a piece of material covers the entire area between one of mid set of suspending straps 118, on the left-hand side of the figure, and one of inner set of suspending straps 117, also on the left-hand side of the figure. In some embodiments, such a piece of fabric may be provided between, and attached to, one of mid set of suspending straps 118, on the right-hand side of the figure, and one of inner set of suspending straps 117, also on the right-hand side of the figure and such a piece of fabric may be provided between one of mid set of suspending straps 118, on the left-hand side of the figure, and one of inner set of suspending straps 117, also on the left-hand side of the figure. However, in some embodiments, no such pieces of fabric or other materials are provided.

As mentioned above, and discussed in greater detail below, with respect to other straps and bands comprised in bras and other body supporting and enhancing garments according to some embodiments of the present invention, any of the straps of inner set of suspending straps 117 and side lateral suspending straps 119 may comprise and/or be adjustable by strap or band length adjusting hardware, such as sliders and rings (not pictured in the present figure).

As will be apparent to those of ordinary skill in the art to which the present invention applies, a wide range of bras and other garments may include, or be modified to include or combine with, the garments, aspects and techniques of the present invention, as set forth in this application, in some embodiments. The mention, depiction or discussion of any specific bra or other garment types within this application is for illustration purposes, and is not intended to limit the scope of the present invention. For example, in various embodiments, any of the aspects for a backless bra 100 may be incorporated into or integrated with any particular type of top used as clothing for a woman's body. For example, in various embodiments, any of the aspects for a backless bra 100 may be incorporated into or integrated with any of a: corset, bustier, camisole, dress, shirt, t-shirt, tank top, crop-top, crotch top, tube-top, bandeau, blouse, vest, jacket, robe, tunic, sweater, sweatshirt, leotard, unitard, catsuit, bodysuit, tights, jumpsuit, wet suit, track suit, rash guard, romper, bikini swimsuit top, one-piece swimsuit, or any other top or top-comprising garment. More generally, the exact detailed embodiments provided throughout this application, including the garments, aspects and techniques set forth in the figures and discussed in detail in this application are, of course, examples, and not limiting. Rather, these embodiments are intended only as a reasonable set of possible example structures, substructures, materials, methods, steps, techniques and other aspects of the present invention, among virtually infinite and innumerable possibilities for carrying out the present invention, to ease comprehension of the disclosure, as will be readily apparent to those of ordinary skill in the art. For example, the description of one particular order, number or other arrangement of any aspects of the present invention set forth herein is illustrative, not limiting, and all other possible orders, numbers, arrangements, etc., are also within the scope of the invention, as will be so readily apparent. Any aspect of the invention set forth in this application may be included with any other aspect, as well as any aspects known in the art, in any number, order, arrangement, or alternative configuration, in particular embodiments, while still carrying out, and falling within the scope of, the invention.

FIG. 2 is a rear perspective view of the same example backless bra 100, in place on the same woman's body 101, of FIG. 1 above, illustrating additional embodiments of the present invention. As discussed above, neck strap 107 can be seen more completely in FIG. 2, wrapped around the back of the neck of example woman's body 101, with an optional example separating and connecting fastener 221 shown, incorporating a neck strap length adjustment device 223, such as an internal turnstile (not pictured), through which a loop 225 of the material of neck strap is threaded and doubled over itself, as shown by double-layer neck strap material 227. As with other length adjustment mechanisms set forth in the present application, neck strap length adjustment device 223 permits a user to lengthen or shorten the length of the band or strap of material to which it is attached. In the example shown as neck strap adjustment device 223, a user may lengthen neck strap 107 by partially unthreading from the turnstile, and undoubling part of, double-layer neck strap material 227, shortening loop 225. Also pictured is optional lower supporting bra band 229 of example backless bra 100, also with an optional rear closure 231 (e.g., a hook-and-eye closure), and with another form of length adjustment device (namely, back band adjustment device 233) pictured. In some embodiments, back band adjustment device 233 may be a slider paired with a turnstile, as discussed in greater detail elsewhere in this application. As mentioned above, either or both of connecting fastener 221 and/or rear closure 231 is omitted in some embodiments. For example, in some embodiments where elastic materials are used for neck strap 107 and/or supporting band 229, connecting fastener 221 and rear closure 231 is omitted. In some embodiments, lower supporting band 229 is integrated with or attached to curved lower support 113. In some embodiments, lower supporting band 229 may wrap entirely around woman's body 101, holding itself snugly in place with tension.

As can be seen in the figure, the low position of optional lower supporting band 229, and the high position of neck strap 107, leave most of the woman's back bare. Thus, some open-back dresses and tops, such as, but not limited to, some halter tops, may be worn with backless bra 100, without revealing backless bra 100. In some embodiments, especially revealing clothing may be so worn where optional garment adhering aspects, set forth in greater detail below, are also incorporated.

Figure 3:
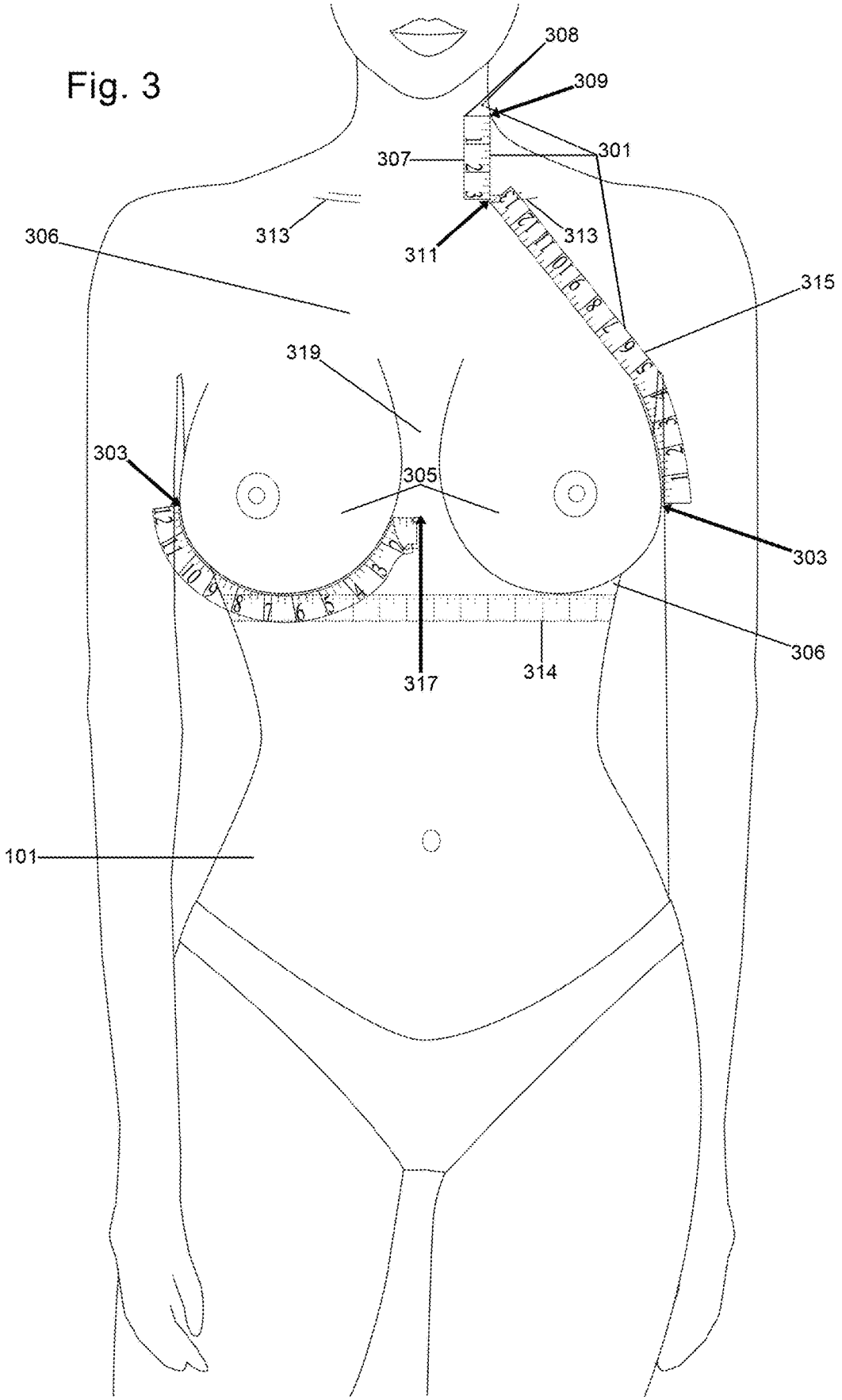
FIG. 3 is a front view of the same example woman's body of FIGS. 1 and 2, illustrating areas of the body and dimensions of the body which may be measured and correspond to dimensions of the example backless bra, discussed above, in accordance with some embodiments of the present invention.

FIG. 3 is a front view of the same example woman's body 101 of FIGS. 1 and 2, illustrating areas of woman's body 101 and dimensions of woman's body 101 which may be measured and correspond to dimensions of the example backless bra 100, discussed above, in accordance with embodiments of the present invention. As with other dimensions set forth above, the dimensions and measurements set forth in the present figure may be used to match or create a sizing system for fitting a bra or other garment (such as bra 100), incorporating aspects of the present invention, to a woman's body, supporting part of a woman's body (such as the breasts) and/or enhancing the appearance of a woman's body (such as woman's body 101).

In measurement systems in accordance with embodiments of the present invention, any or all of the areas of a body and dimensions of a body set forth below, measurements thereof, and corresponding dimensions of example clothing, such as example backless bra 100, may be incorporated as components or variables, together with other components or variables, in a wide variety of orders and numbers, creating suitable systems for sizing and fitting bras and other body-supporting garments. As mentioned above, the embodiments set forth herein are intended only as a reasonable set of possible example structures, substructures, materials, methods, steps and other aspects of the present invention, among many possibilities for carrying out the present invention, to ease comprehension of the disclosure, as will be readily apparent to those of ordinary skill in the art. By convention, this application will illustrate areas of the body and dimensions, in part, by depicting example cloth measuring tapes with example units (English units, in the example shown), placed at locations on woman's body 101 to illustrate the lengths measured. Thus, when a length measurement is discussed, and the corresponding number label points to an example cloth measuring tape on woman's body 101, it should be understood that the number label refers to the length measured by that example cloth measuring tape, and not the measuring tape itself.

In one aspect of the present invention, a measurement and fitting system may include an example measurement of a neck strap length 301, which may be measured along side and front surfaces of a standing woman's body, such as woman's body 101, and which may in some embodiments, as discussed further below, be the sum of a number of smaller length measurements (as pictured). In any event, neck strap length 301 may begin from a point 303, at the junction of the breasts 305 and chest 306 of woman's body 101, at the widest horizontal circumference of her chest 306 and/or breasts 305, and end at a point 405 (shown in the following figure), at the center of the back of her neck, and along the sagittal plane of the woman's body 101. Thus, in some embodiments, there may be two such neck strap lengths in total, identical in length to neck strap length 301, corresponding with both the right and left sides of a woman's body (such as example woman's body 101), a second neck strap length (not pictured, but on the left-hand side of the figure) being a mirror image of the first example neck strap length 301 (shown at the right-hand side of the figure). However, in some embodiments, a neck strap length may include the total of both a right-hand side and left-hand side neck strap length, thus being 2 times the length of neck strap length 301. In some embodiments, neck strap length 301 may be the shortest length between points 303 and 405. In some embodiments, the line between points 303 and 405 hugs or traces the outer surface of the woman's body 101 at all points, being the shortest length between points 303 and 405 so conforming to the surface of the woman's body 101.

In some embodiments, however, neck strap length 301 may be created from or may comprise one or more shorter lengths corresponding with other parts of a woman's body, which do not necessarily sum to a shortest possible length between points 303 and 405. According to such measurements, a bra or other garment based on the sizing systems set forth in the present application may create any number of new halter lines and decolletage.

For example, neck strap length 301 may comprise a neck-wrapping measurement (shown in the following figure as 403) as one such shorter length measurement. As another example, neck strap length 301 may comprise a vertical (or approximately vertical) top-front measurement 307, along the surface of the neck and chest of the woman's body 101. In some embodiments, neck-wrapping measurement 403 and top-front measurement 307 are added together, the total summed measurement of the length of neck-wrapping measurement 403 and the length of top-front measurement 307 being a halter length 308. In some embodiments, top-front measurement 307 begins at a point 309, at or near the transition between the neck and shoulders (e.g., at the side transition point on the skin between of the trapezius and neck) of woman's body 101, e.g., at the mid-coronal plane of the neck. In some embodiments, point 309 is at any other natural resting point of a halter-top neck strap, along the side of a woman's neck. In some embodiments, top-front measurement 307 is the length from point 309 to a point 311 at, at the top of, or at the bottom of, or near a clavicle 313 of woman's body 101, below point 309 (i.e., top-front measurement 307 may be a vertical or approximately vertical line along the surface of woman's body 101). As yet another example, in some embodiments, neck strap length 301 includes a component side lateral length measurement 315, extending from point 311 to point 303. In some embodiments, neck strap length measurement 301 includes several shorter length measurements. In some such embodiments, neck strap length measurement 301 includes each of shorter, component lengths 403, 307 and 315.

In some embodiments, other measurements corresponding (matching or conforming) to length, area, volume, or other measurements of body parts corresponding with components of bra or garment 100 are combined to formulate a measurement and garment fitting and sizing system. Those other measurements may be known bra and garment fitting and sizing measurements, in some embodiments, or new measurements, in some embodiments. For example, a known cup size measurement, which may correspond with the volume and/or shape of a woman's breast may be used in conjunction with any or some of the measurements set forth above, in some embodiments of sizing systems in accordance with the present invention. As another conventional measurement, a conventional "band" measurement 314, of the circumference of the chest may be taken at or just below the bottom of the breasts 305 (e.g., at the inframammary fold) and a corresponding halter-securing band (not pictured) may be added at that location to bra or garment 100, in some embodiments. In contrast, a new form of body measurement related to known or previously undescribed body parts or sections may be used, and combined with other measurements set forth in this application, in a bra or garment fitting and/or sizing system. For example, in some embodiments, a lower breast curve measurement is taken on a woman's body, from point 303 to a point 317 at the junction of the breast and chest at or near the sternum 319 (which may, as with point 303, be at a vertical position on her body along the widest horizontal circumference of her chest 306 and/or breasts 305, but at the inner breast or cleavage, as pictured).

Figure 4:
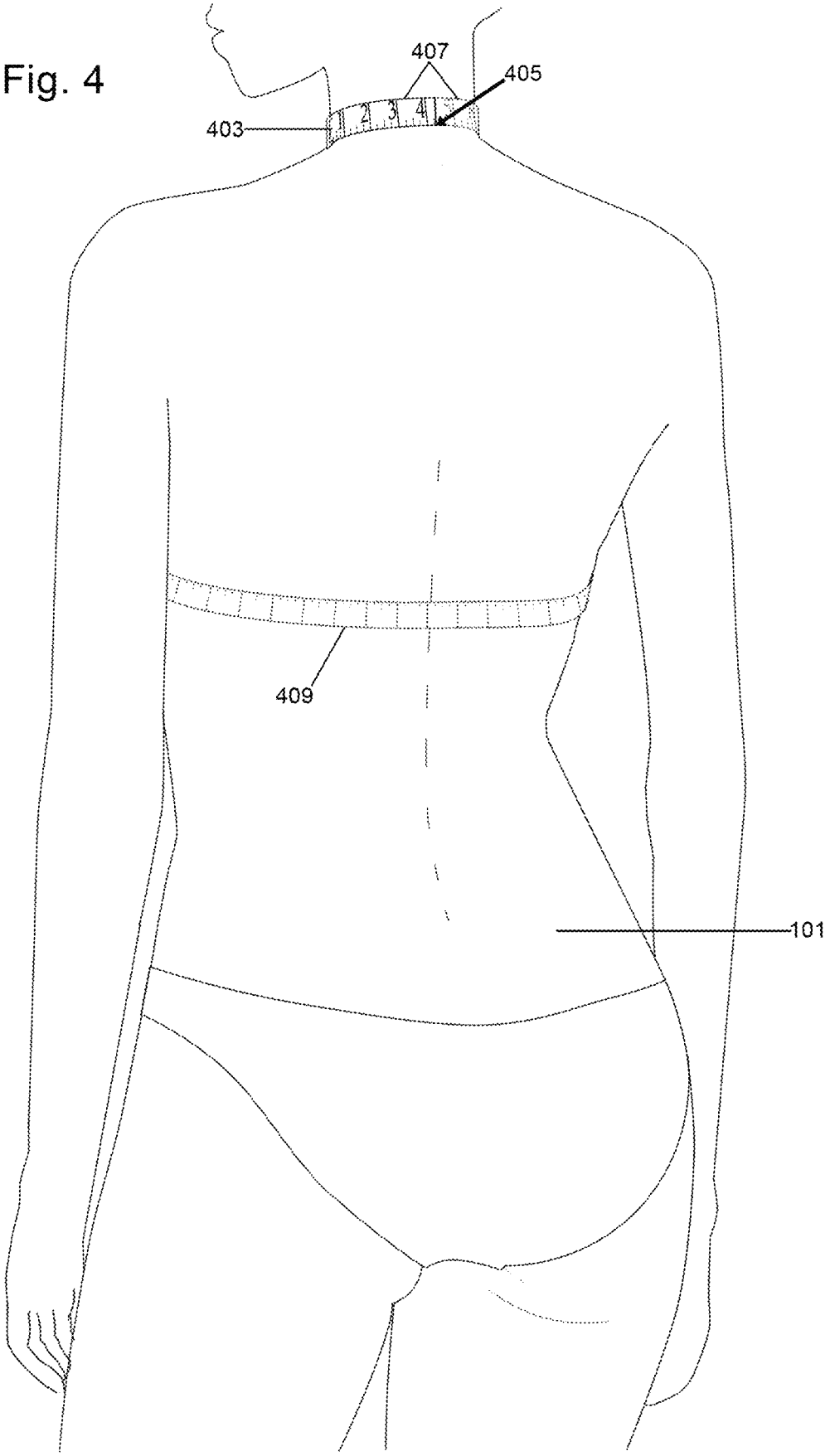
FIG. 4 is a rear perspective view of the same example woman's body of FIGS. 1 through 3, illustrating areas of the body and dimensions of the body which may be measured and correspond to the dimensions of the example backless bra, discussed above, in accordance with some embodiments of the present invention.

FIG. 4 is a rear perspective view of the same example woman's body 101 of FIGS. 1 through 3, illustrating areas of the body and dimensions of the body which may be measured and correspond to the dimensions of the example backless bra 100, discussed above, in accordance with some embodiments of the present invention. As mentioned above, example neck strap length 301 for measuring a body, such as example woman's body 101, and fitting a bra of garment, such as backless bra 100, may comprise a number of shorter measurements of body parts, lengths or components. One such measurement, namely, neck-wrapping measurement 403, may extend along the surface of the back of the neck of woman's body 101, to a point 405, at a point along the sagittal plane (bilateral division) of woman's body 101. Point 405 may be at or about the transition of the neck and skin surrounding the trapezius muscle of woman's body 101, or within one or two inches, above or below that transition. If the bra or garment to be fitted using the measurement includes a more taught or stiff neck strap material, point 405 may be taken from a higher position, and vice versa.

As with other measurements set forth in this application, a second, bilaterally symmetrical measurement, corresponding with the other side of the back of the neck of woman's body 101, may also, or alternatively, be used in a sizing and garment fitting system in accordance with some embodiments of the present invention. In other embodiments, any measurements set forth herein may be summed or otherwise added together, to create a simpler, larger measurement, such as entire back-of the neck measurement 407, combining measurement 403 with its mirror image measurement of the other half of the back of the neck of woman's body 101.

As mentioned above, in some embodiments of bras or other supporting garments set forth in the present application, an optional lower supporting band may be included, as shown in FIG. 2, such as optional lower supporting band 229. Accordingly, in some measurement and fitting systems in accordance with aspects of the present invention, a lower supporting band measurement 409, corresponding with that band, drawn about the circumference of the chest, may be taken at or just below the bottom of the breasts 305 (e.g., at the inframammary fold) and around the back of the woman's body 101, in some embodiments.

Figure 5:
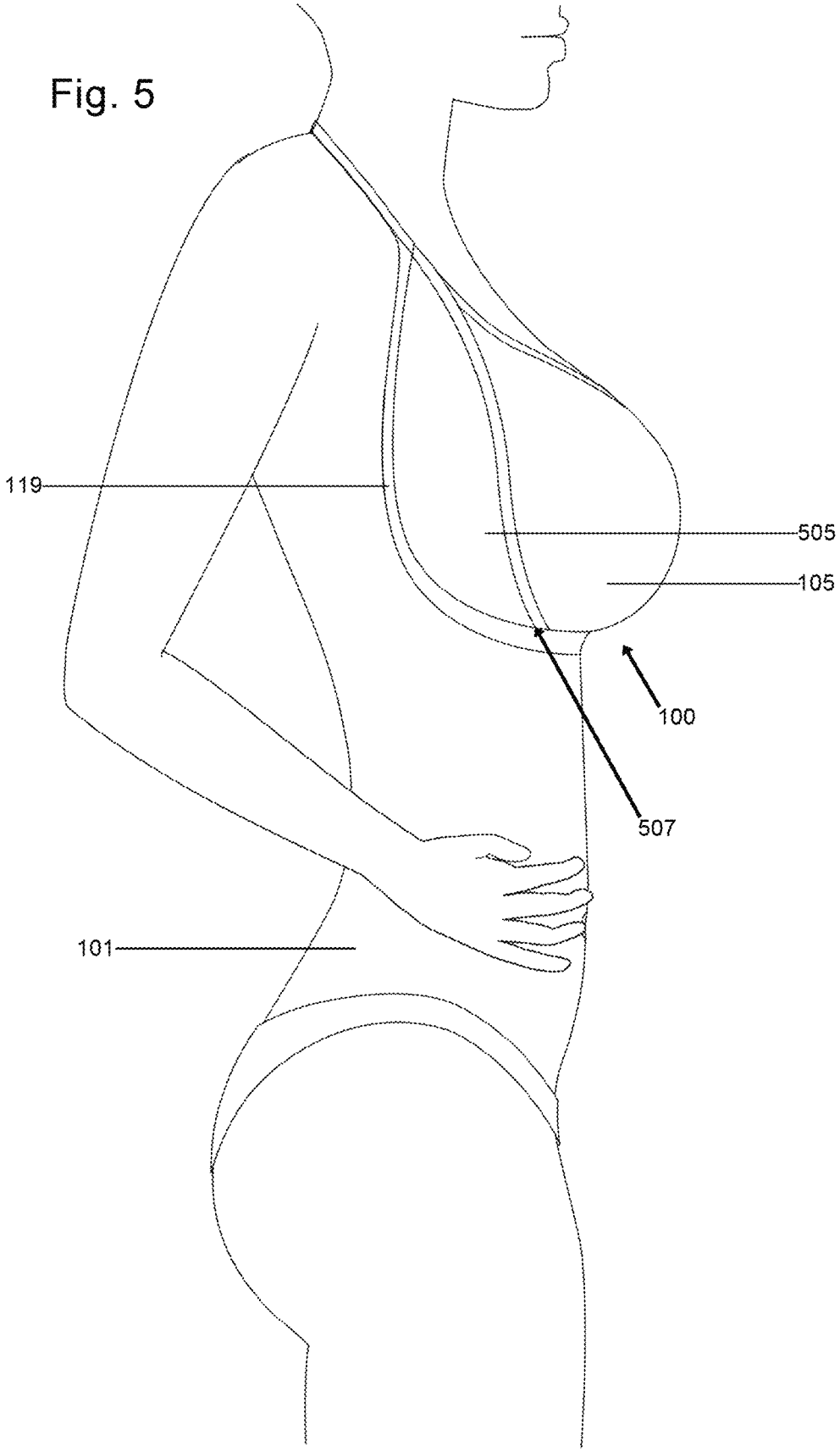
FIG. 5 is a side view of the same example backless bra, in place on what may be the same woman's body set forth in figures above, in accordance with additional embodiments of the present invention.

FIG. 5 is a side view of the same example backless bra or garment 100, in place on what may be the same woman's body 101 of FIGS. 1-4, illustrating some additional embodiments of the present invention. Although woman's body 101 may be the same body 101 discussed above, it exhibits some physical differences (in addition to the difference in perspective of the figure.) Woman's body 101 may exhibit larger breasts 505 than the breasts depicted earlier, as breasts 305, either through natural maturation, a recent pregnancy, or ordinary (e.g., monthly) hormonal changes. As a result, a larger cup size than that pictured above might better fit woman's body 101 as depicted in the present figure. However, in accordance with aspects of the present invention, backless bra 100, or other garments featuring aspects of the present invention, may instead be differently adjusted and/or positioned on woman's body 101, to accommodate the different breast size on either or both sides of woman's body 101, in some embodiments.

As mentioned above, set of side lateral suspending straps 119 can be (and now has been) tailored or adjusted in length to alter the cup size and shape of each of left breast-supporting cup section 103 (not pictured) and right breast-supporting cup section 105 (which should be understood to include strap set 119), to better match, hold and conform to the woman's breasts and/or the transverse side lateral area of her body underneath set of side lateral suspending straps 119. More specifically, strap(s) 119 has/have been lengthened (e.g., in some embodiments, by slides or any other known strap length adjusters included with them, which are not pictured) to accommodate the now larger size of breasts 505. (Although sliders or other length adjusters included in straps 119 have been omitted from the depiction of set of side lateral suspending straps 119, for simplicity, examples of such length adjusters are discussed elsewhere in this application, and shown in FIGS. 2 and 9, below, among other places in this application.) As also pictured, the larger size of breasts 505, and set of side lateral suspending straps 119, lead to a strap attachment and convergence point 507, which has shifted downward and underneath the breasts 505, in comparison to its location when bra or garment 100 is fitted to smaller breasts, as shown, for example, in FIG. 1.

Figure 6:
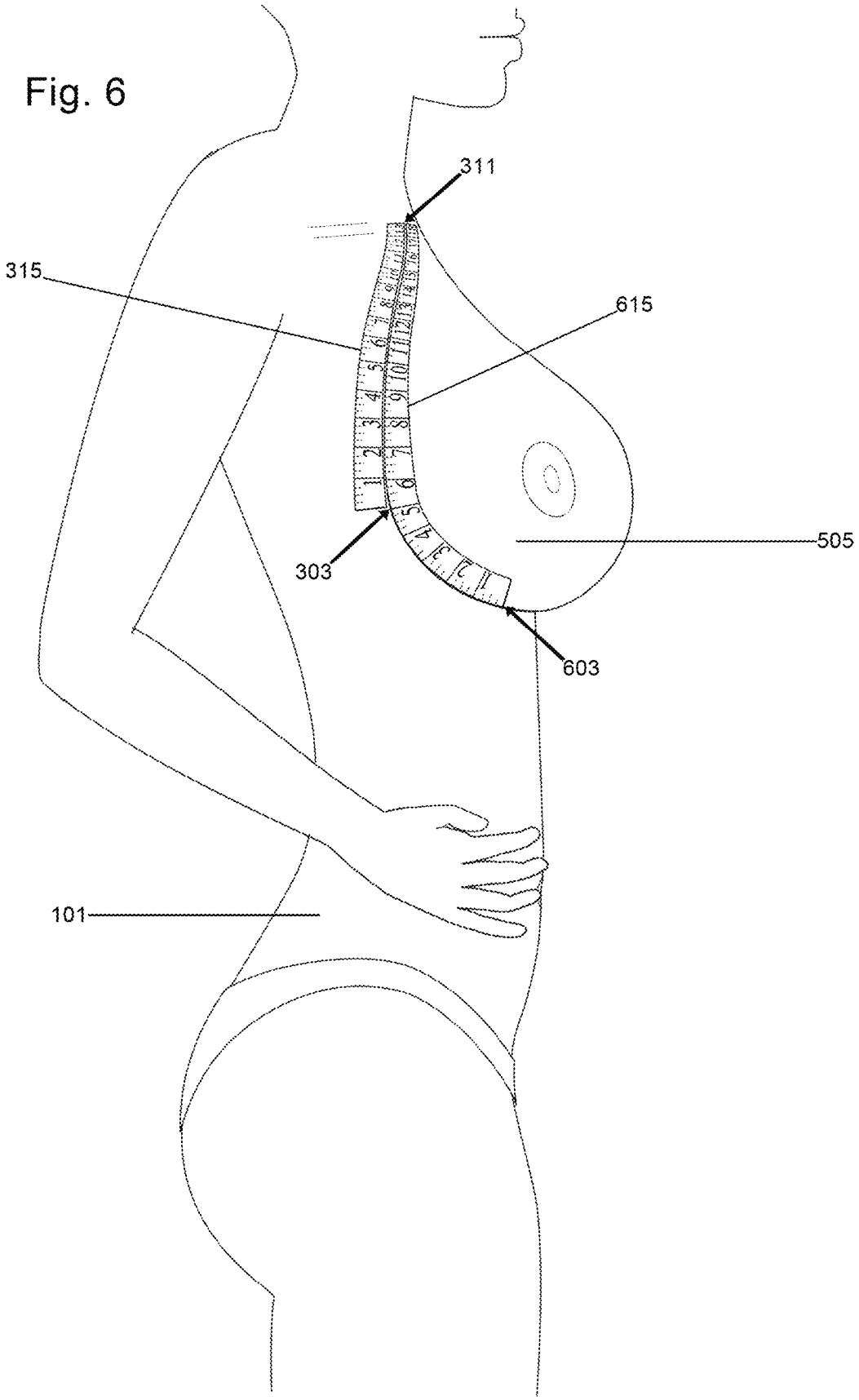
FIG. 6 is a side view of the same example woman's body of FIG. 5, set forth above, illustrating areas of the body and dimensions of the body which may be measured and correspond to dimensions of the example backless bra, discussed above, in accordance with some embodiments of the present invention.

FIG. 6 is a side view of the same example woman's body 101 of FIG. 5, discussed above, illustrating areas of the body and dimensions of the body which may be measured and correspond to dimensions of the example backless bra 100, discussed above, in accordance with embodiments of the present invention. As discussed above, in some embodiments, neck strap length 301 may comprise a shorter side lateral length measurement 315, extending from point 311 to point 303, each of which aspects is now pictured in the side view perspective of the figure. However, in some embodiments, a user may wish to achieve the fit shown in FIG. 5, above, with the corresponding longer length of set of side lateral suspending straps 119. In that instance, an alternative side lateral length measurement 615 may be taken, from an alternative lower point 603, at or about the base of one of the breasts 505, along the conventional band measurement for a woman's bra (i.e., at the inframammary fold), to point 311. Thus, to achieve the wider lateral fitment and greater bare area exhibited in FIG. 5 on woman's body 101, a smaller bra may be selected for the same woman's body 101 than that pictured in FIG. 1, incorporating alternative side lateral length measurement 615, in some embodiments.

FIG. 7 depicts a table 700, coding and other aspects of an example new sizing system corresponding with backless bras and garments, according to some embodiments of the present invention. Table 700 depicts eight columns 701, each corresponding with a different bra cup size for bras or other supporting garments, and seven rows 703, each corresponding with a neck strap length and side lateral length for bras or other supporting garments, as discussed above in this application. By selecting any one value shown in the column headings, such as the examples shown as 705, and by selecting any one value of the row headings, such as the examples shown as 707, any of a wide range of combinations of those values can be created, corresponding with a good fit for a woman's body. The values shown in the column headings as 705 may be coding for conventional cup sizes, in some embodiments, as pictured. In other embodiments of bra sizing and creation systems of the present invention, however, new, unconventional cup sizes, and sets of cup sizes, may be included. Examples of such unconventional cup sizes, and sets, are discussed in greater detail elsewhere in this application. Similarly, the values shown in the row headings as 707 are merely examples of possible coding, units (inches, in this example) and sets of halter length measurements and side lateral length measurements.

For example, a woman with an average cup size of C, and a neck strap length of H18/S11.5 (which coding signifies a halter length of 18 inches and a side lateral length of 11.5 inches), may select the size "H18C," which is the resulting size code combining the values of one of column headings 705 and one of row headings 707. However, because each of the straps of a bra or other supporting garment corresponding with the neck strap length (including the halter length, in some embodiments) and the side lateral length may be individually adjusted, an infinite array of alternate, more form-fitting sizes may be selected and created. For example, and assuming that the alternative side lateral length measurement discussed above is not selected, the same woman may select a size down in cup size, H18B, and increase the side lateral strap length, to achieve a fit more similar to that depicted in FIG. 5, above.

Figure 8:
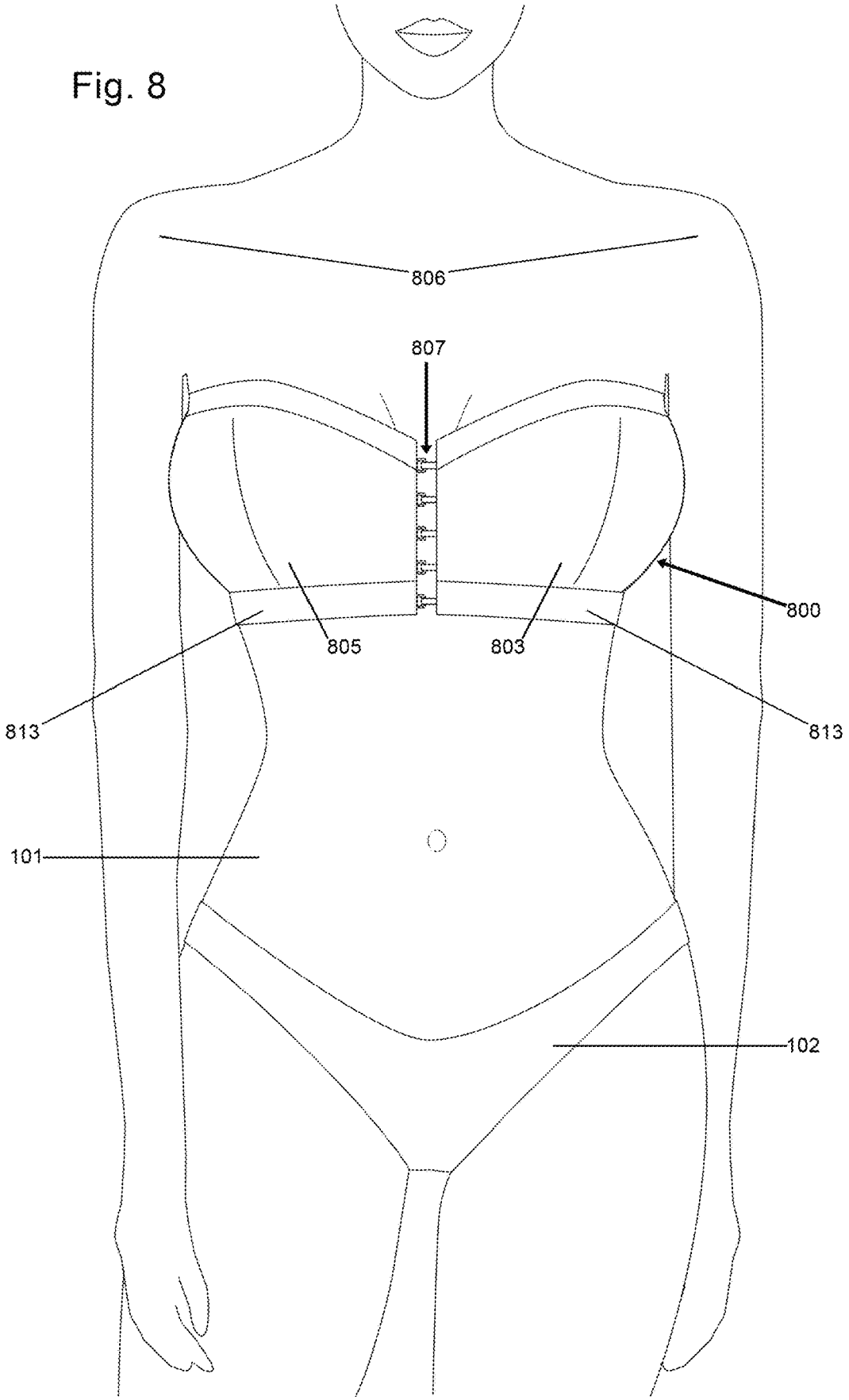
FIG. 8 is a front view of an example strapless bra (meaning that it does not comprise any over-the-shoulder straps), with a unique configuration of multiple back bands, on the same woman's body of figures set forth above, in accordance with some embodiments of the present invention.

FIG. 8 is a front view of an example strapless bra 800 (meaning that it does not comprise any over-the-shoulder straps), with a unique configuration of multiple back bands, in place on the same woman's body 101, discussed above, in accordance with some embodiments of the present invention. As with other bras and garments set forth in the present application, strapless bra 800 may be worn alone, or with other garments, such as example separate bikini bottom 102, or over and/or under, or integrated with, blouses, dresses and other tops or garments (not pictured). As also mentioned above with respect to other bras or garments set forth in the present application, any aspect of strapless bra 800 may be integrated with any such articles of clothing, provided that they cover, support, adorn or otherwise enhance a woman's top, as with a bustier, blouse, corset, dress, camisole, tank top, crop-top, bandeau, tube-top, vest, sweater, jacket, shirt, tunic, robe, cat suit, body suit, leotard, crotch top or shirt body suit, bikini swimsuit top, one-piece swimsuit, among virtually limitless possibilities. Preferably, strapless bra 800 may integrate with other strapless articles of clothing, such as strapless dresses and tops, strapless bustiers, strapless corsets, tube tops, and bandeau swimsuit tops, to name just a few possibilities. In one embodiment, a strapless dress or top may be worn directly over strapless bra 800, covering just strapless bra 800, or nearly so (e.g., covering 1-5% more, or 1-5% less, of the woman's body laterally and vertically, than strapless bra 800). In some embodiments, such a strapless dress or top may be selected with a size just concealing strapless bra 800, and leaving the remainder of the woman's skin bare, giving the impression that the woman may not be wearing strapless bra 800.

Strapless bra 800 may comprise two breast-supporting cups, including left breast-supporting cup section 803 and right breast-supporting cup section 805, variably and reversibly joined together by: A) two rear bands (not pictured in the present figure, but visible as upper back band 901 and lower back band 902, in FIG. 9), which may be drawn around a woman's back, below her shoulders 806, and B) a front-facing fastener(s) 807, which variably fastens and unfastens cup sections 803 and 805 together. Front-facing fastener(s) 807 may be a single fastener, or a set of fasteners (as pictured) and may be in any form of variable, reversible fastener for joining two structural pieces together known in the art. As examples of just some of the possible fasteners, front-facing fastener(s) 807 may be one or more of the following: an eye-and-hook, zipper, snap, hook-and-loop (such as VELCRO), button, adhesive, magnetic, pin and/or clip fastener. Similarly, a neck strap, similar to that shown as neck strap 107 in FIG. 1, may be reversibly attached and separated in some embodiments, at one or more connection points with left breast-supporting cup section 803 and/or right breast-supporting cup section 805, and/or at any other point on or about the rear of bra or garment 800 and/or such a neck strap, in some embodiments. Each of left breast-supporting cup section 803 and right breast-supporting cup section 805 may have a curved lower support 813, complementarily shaped and configured to securely hook and hold the woman's breasts and the inframammary fold of woman's body 101, from underneath. In some embodiments, curved lower support 813 may be an underwire. In other embodiments curved lower support 813 may be a strap. In still other embodiments, curved lower support 813 may be any form of support suitable for supporting or enhancing the appearance of a woman's breasts.

Figure 9:
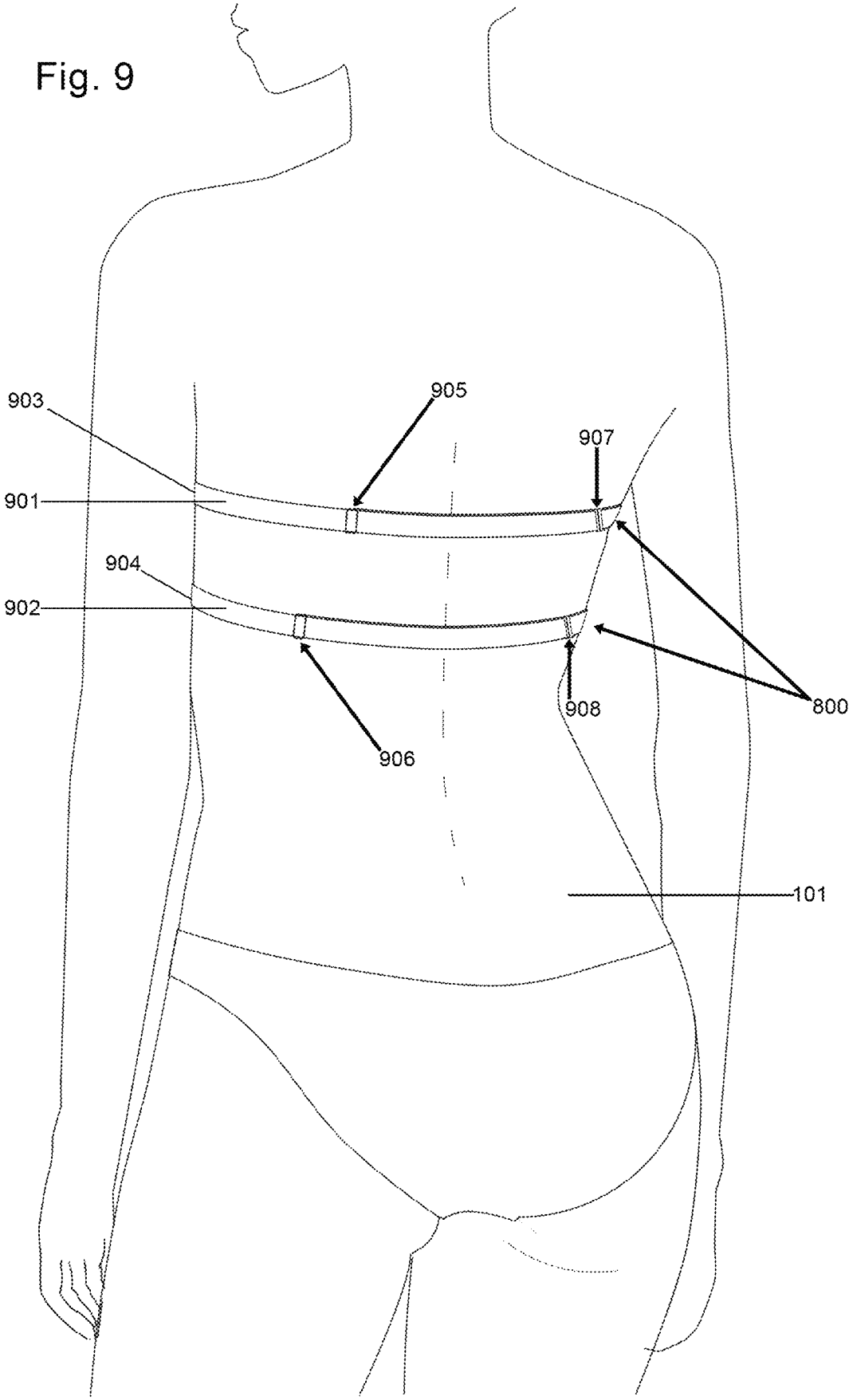
FIG. 9 is a rear perspective view of the same example strapless bra set forth in FIG. 8, fitted to the same woman's body of figures set forth above, with multiple, adjustable back bands and other new aspects, in accordance with some embodiments of the present invention.

FIG. 9 is a rear perspective view of an embodiment of the same example strapless bra 800 set forth in FIG. 8, fitted to the same woman's body, 101, of figures discussed above, with multiple, adjustable back bands, such as the examples shown as upper back band 901 and lower back band 902, and other new aspects, in accordance with some embodiments of the present invention. Each of upper back band 901 and lower back band 902 is preferably adjustable in length and is attached on each end, such as end 903 and end 904, respectively, to the side edge (not pictured) of bra or garment 800, holding it in place on woman's body 101.

As with any other bands, straps or parts thereof set forth anywhere in this application, in some embodiments, and as mentioned above, upper back band 901 and lower back band 902 are adjustable in length, and may comprise length adjustment hardware, thus permitting a user to alter the length of either or both of upper back band 901 and lower back band 902 to suit her comfort and taste and better conform to her body, holding strapless bra 800 in place, and supporting and/or presenting her breasts. For example, and only as one example among virtually unlimited possibilities, bands 901 and/or 902 may each comprise a slidable connector (a.k.a. "slider"), such as the examples provided as upper slider 905 and lower slider 906, and an end ring, such as the examples provided as upper ring 907 and lower ring 908. Together, such a slider and end ring combination as those pictured for each of bands 901 and 902 permits a user to alter the length of a band of strapless bra 800, or a similar supporting garment incorporating similar aspects of the invention, and fitting bra 800 (or such other garment) to a particular body on which it is worn, such as woman's body 101. In some embodiments, one band, such as band 901, may have a slideable connector provided on one side of bra 800 (and, when donned, one side of a user's body, such as example woman's body 101), such as the right-hand side, while a second band, such as band 902, may have a slideable connector provided on the other side of bra 800 (and, when donned, the other side of woman's body 101). In other words, in such embodiments, sliders may be provided on alternating or opposing sides. In some embodiments, however, length adjustment hardware may be omitted from one or both of bands 901 and 902. In some such embodiments, bands 901 and 902 comprise an elastic material. In some embodiments other components of bra 800, may comprise an elastic material.

Accordingly, in some embodiments, ranges of different lengths, and combination of lengths, of upper back band 901 and lower back band 902 may be created by a user of strapless bra 800. Nonetheless, and in accordance with additional embodiments of the invention set forth below, those ranges may be limited, and differently limited, for each of the different back bands, such as band 901 and 902, in accordance with bra sizing systems of the present invention. Such sizing systems are set forth in greater detail below. As explained in greater detail below, lower back band 902 may correspond to, and be created in reference to, a lower wrap length 1003, while upper back band 901 may correspond to, and be created in reference to, an upper torso hemi length 1007, which are discussed in greater detail below.

Although the example of a slider and end ring is provided in the pictured embodiment, it should be understood that any suitable mechanism or combination of mechanisms for altering the length of a band or strap of material may be used, in addition to, or as an alternative to, sliders 905 and 906, and end rings 907 and 908, in other embodiments. Similarly, although the example of two adjustable-length band strapless bra 800 is provided, it should be understood that one band (as in the embodiment set forth in FIG. 13, below, or more than two bands, may also be used, in the context of any supporting or enhancing garment implementing some aspects of the invention. Such variations of the invention will be readily apparent to those of ordinary skill in the art.

Either or both of upper back band 901 and lower back band 902, and any other bands and/or straps set forth in the present application, may comprise any suitable material, or combination of materials, known in the art for forming bra straps and bands. For example, in some embodiments, upper back band 901 and lower back band 902 may include any of: cloth, fabric, plastic, rubber, or flexible metal structures, or any other material set forth in this application for bras. In some embodiments, upper back band 901 and lower back band 902 may include any combination of such materials, in linked and/or blended textile materials.

Figure 10:
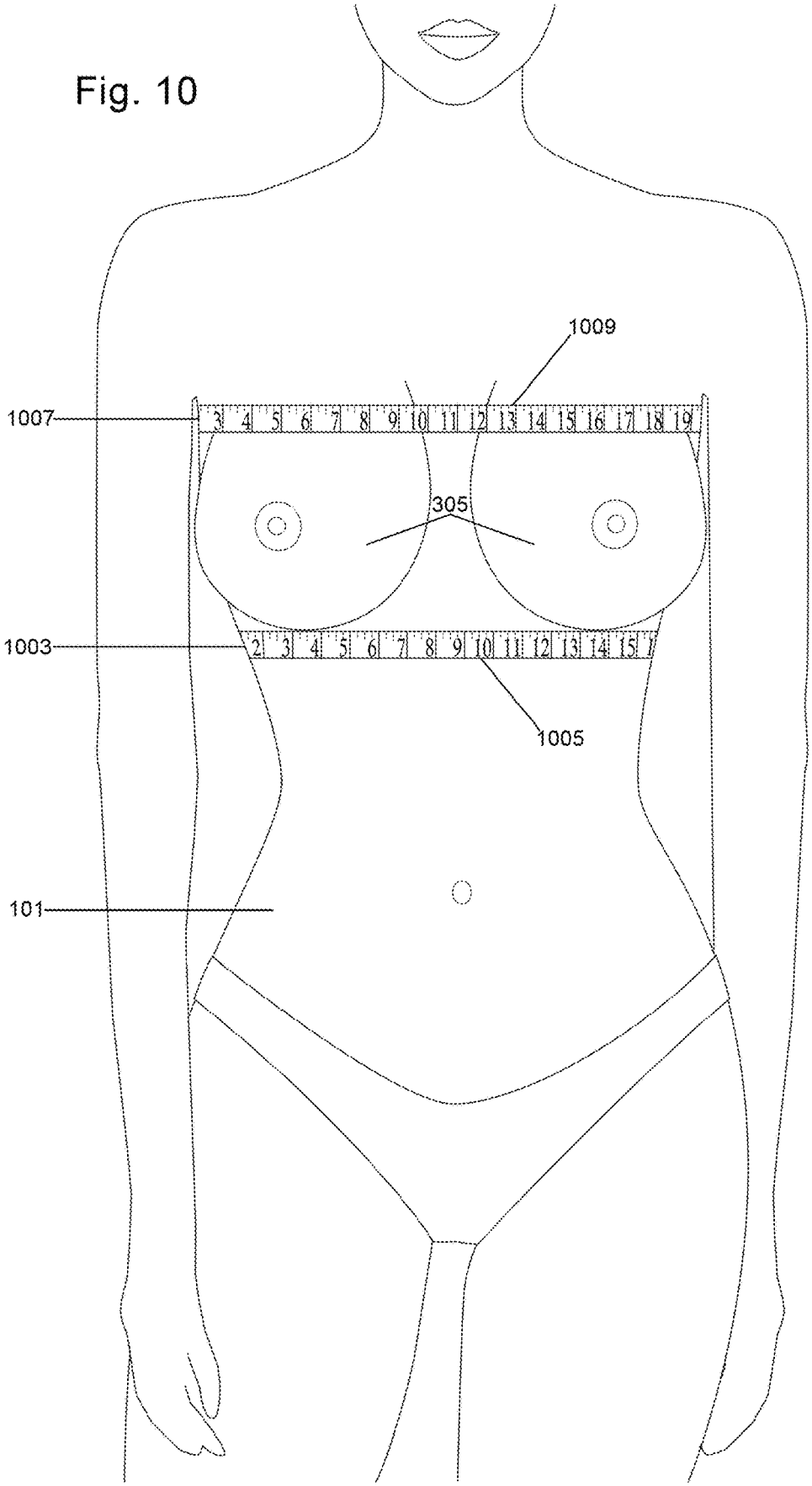
FIG. 10 is a front view illustrating areas and dimensions of the same woman's body set forth in figures above, which may be measured and correspond to dimensions of the example strapless bra of FIGS. 8 and 9, discussed above, in accordance with some embodiments of the present invention.

FIG. 10 is a front view illustrating areas and dimensions of the same woman's body 101 discussed in reference to figures above, which may be measured and correspond to the dimensions of the example strapless bra 800 of FIGS. 8 and 9, discussed above, in accordance with embodiments of the present invention. As with other dimensions set forth above, the dimensions set forth in the present figure may be used to match or create a sizing system for creating and fitting bras or other garments (such as strapless bra 800) to a woman's body, supporting part of the woman's body (such as the breasts) and/or enhancing the appearance of the woman's body (such as woman's body 101).

In measurement systems in accordance with embodiments of the present invention, any or all of the areas of the body and dimensions of the body set forth below, and corresponding dimensions of example clothing, such as example strapless bra 800, may be incorporated as components or variables, together with other components or variables, in a wide variety of orders and numbers, creating suitable systems for sizing and fitting bras and other body-supporting garments. As mentioned above, the example embodiments set forth herein are intended only as a reasonable illustrative set of example structures, substructures, materials, methods, steps and other embodiments of the present invention, among virtually infinite and innumerable possibilities for carrying out the present invention, to ease comprehension of the disclosure, as will be readily apparent to those of ordinary skill in the art.

One such dimension depicted in the figure is a lower wrap length 1003, which may be measured from around the circumference of a woman's torso at a vertical position at the bottom of, or just below, the woman's breasts 305. Although, due to the limited perspective of the figure, only a component 1005 of lower wrap length 1003 is visible from the front perspective depicted in the figure, it should be understood that lower wrap length 1003 wraps completely around the back of woman's body 101, at the same vertical level of her body as component 1005. Other components of lower wrap length 1003, however, are visible from other perspectives, such as the perspective depicted in FIG. 11, below. As mentioned above, lower wrap length 1003 corresponds with the length of band 902, discussed above.

Another such dimension is upper torso hemi length 1007, which may, in some embodiments, be measured at the level of the largest circumference of a woman's torso at a vertical position at the level of her breasts or, alternatively, in other embodiments, at the level of the medial part of the woman's breasts 305, or, in still other embodiments, at the level of the average medial part of the woman's breasts 305 or, again alternatively, in yet other embodiments, at the vertical level where the woman's breasts 305 or chest is largest. Only a potential component, shown as 1009, of upper torso hemi length 1007 is visible from the front perspective depicted in the figure, and it should also be understood that upper torso circumference length 1007 may wrap completely around the back of woman's body 101, at the same vertical level of her body as component 1009, in some embodiments. As mentioned above, upper torso hemi length 1007 corresponds with the length of upper back band 901. Other components of upper torso circumference length 1007, however, are visible from other perspectives, such as the rear perspective depicted in FIG. 11, immediately below.

Figure 11:
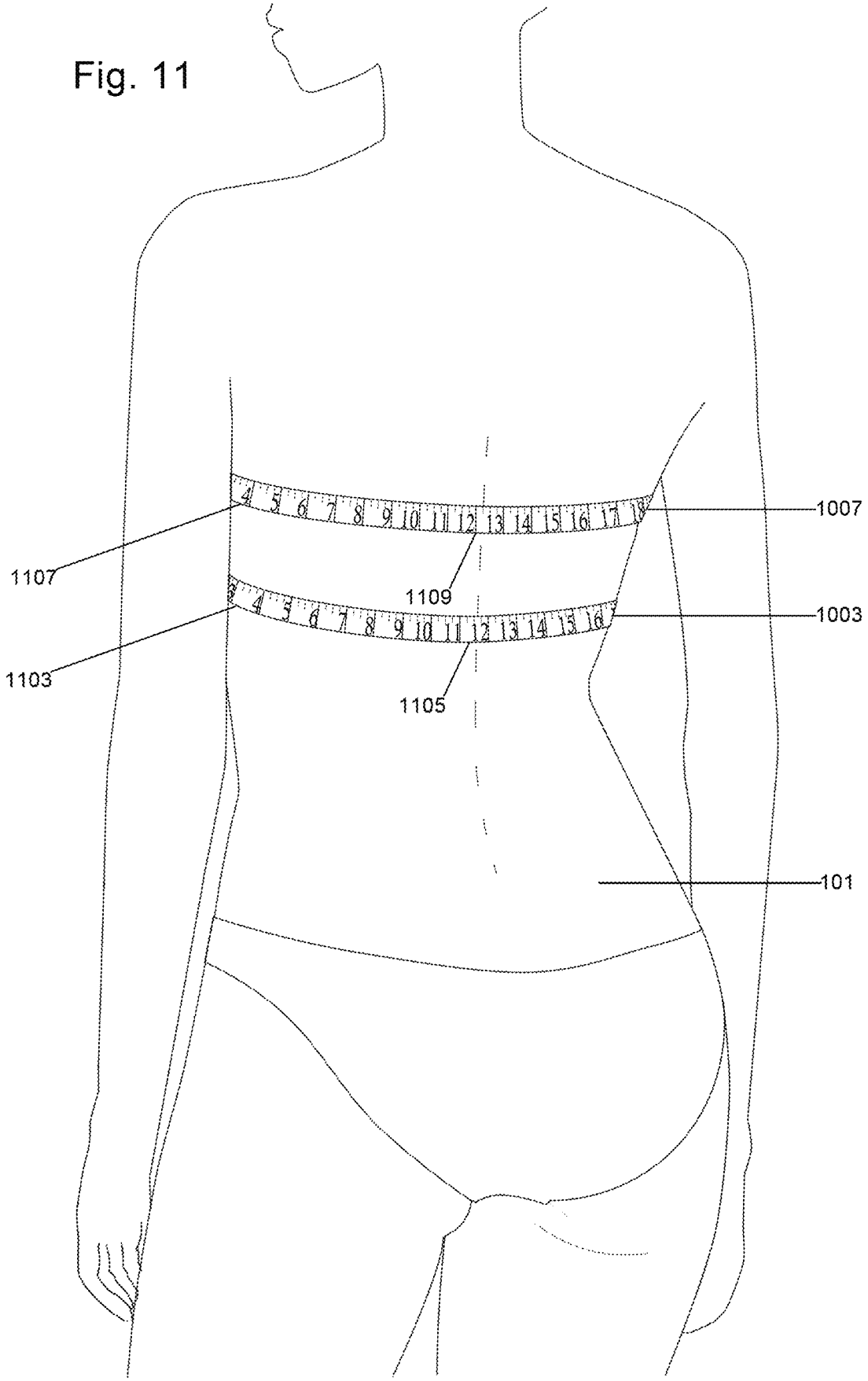
FIG. 11 is a rear perspective view of the same woman's body set forth in figures above, illustrating areas of the body and dimensions of the body which may be measured and correspond to the dimensions of the example strapless bra, discussed above, in accordance with some embodiments of the present invention.

FIG. 11 is a rear perspective view of the same woman's body, 101, of figures discussed above, illustrating areas of the body and dimensions which may be measured and correspond to dimensions of the example strapless bra 800, discussed above in reference to FIGS. 8 and 9, in accordance with embodiments of the present invention.

Now visible example side and rear components of lower wrap strap length 1003 are shown from the rear perspective view of the present figure, as dimension component 1103 and dimension component 1105, respectively, each of which may be measured entirely at the vertical level of the lower wrap length 1003, discussed above.

Similarly, side and rear components of upper torso hemi length 1007 are shown from the rear perspective view of the present figure, as dimension component 1107 and dimension component 1109, respectively, each of which are measured entirely at the level of the upper torso hemi length 1007, discussed above. In some embodiments of the present invention, twice the side dimension 1107, plus the rear component 1109, sum to a larger dimensional component, which will be referred to as a "hemi strap length" in this application.

FIG. 12 depicts a table 1200, coding and other aspects of an example new sizing system corresponding with strapless bras and other supporting garments, in accordance with some embodiments of the present invention. Table 1200 depicts eight columns 1201, each of which corresponds to a measurement of a hemi band length (a hemi band length being a dimension, such as 1107, discussed above, corresponding with, and matched with, bands of a particular type, as discussed above) on various women's bodies, and of particular bras or other supporting garments, and parts thereof, matched and fitted thereto, and eight rows 1203, each of which corresponds to the measurement of a wrap band length (a wrap band length being a dimension, such as lower wrap length 1003, discussed above, corresponding with, and matched with, bands of a particular type, as discussed above) on various women's bodies and of particular bras or other supporting garments matched and fitted thereto. By measuring such dimensions of particular woman user's body, and selecting any one closest-matching value shown in the column headings 1205 and any one closest-matching value in the row headings 1207, a combination fitting that woman's body can be created, corresponding with a good fit for that particular woman's body. Furthermore, and as discussed elsewhere, a set of bra bands can be selected that match, fit, conform to, or otherwise correspond with those dimensions. In some embodiments, such bra bands can be attached to other bra components, which may also be selected according to measurements of dimension(s) of the woman's body, to create a bra fitting such a woman's body, in an assembly process. In some embodiments, such bra bands may be selected from a set of bra bands, in subsets of that set of bra bands that match values such as those shown in column headings 1205 and 1207. In some embodiments, a bra may be provided for a user pre-assembled, from a set of assembled bras, according to a coding system corresponding to values set forth in table 1200 as size codes. For example, a woman with an average hemi band length dimension measurement of 19 inches, coded as "He19," and an average lower wrap band length dimension measurement of 32 inches, coded as "WR32", may select the overall size code of "He19/WR32," and a bra may be provided to the woman from a subset of bras coded He19/WR32, of such a set of assembled bras. However, because bands provided to match each the wrap band length 1003 and the upper torso hemi band length 1007 (as with any other dimension corresponding with strap or band lengths discussed in this application) may be adjustable, with length adjustment hardware in some embodiments of the present invention, a sizing system implementing covered ranges of such lengths may, instead, be used in some embodiments. If so, preferably, a middle, median or other average length of a corresponding strap or band's total range of lengths, may be selected to fit a particular woman's body measurements as set forth in this application, in some embodiments of the sizing system inventions set forth in the present invention related to adjustable bra bands and straps. In some embodiments, the total range of lengths covered by a sizing system for adjustable and other band lengths or strap lengths in accordance with the present invention may be different than that set forth in FIG. 12, and different from any known band and strap sizing ranges and increments. For example, in some embodiments, such a total range of lengths covered by a sizing system may cover a range of between 26 inches and 60 inches, at a plurality of band length increments (e.g., 10 increments, which may be referred to as "Band Length 1," "Band Length 2," etc.) As discussed above, because any of the straps or bands of bras and other garments set forth in the present application may be individually adjusted, an infinite array of alternative, more form-fitting sizes may be selected and created with any bra or garment sized in accordance with aspects of the system set forth in the present figure. For example, the same woman may select a size down or up, or more, when measured as fitting a particular set of dimensions set forth in the chart.

As shown in FIG. 12, the particular array of band lengths are shown for one cup size (namely, cup size A). However, it should be understood that a number of other, and different cup sizes and increments may be combined with the set of band sizes provided in the figure, according to some embodiments of bra sizing systems set forth in this application. For example, as many as 10 different cup sizes and increments may be provided and used, which do not correspond with the increments of conventional cup sizes, in some embodiments. In some embodiments, the cup sizes provided are fixed cup sizes, meaning that the size of the dimensions of a woman's breast measured (e.g., volume or height of her breast(s)) and corresponding (e.g., matching or fitting) cups matched and provided for that woman (e.g., from subset(s) of a set of such cups or bras) do not vary with different sizes of band length dimensions, band lengths or other band sizes, such as those set forth in the present figure. This fixed size for dimensions and cups (e.g., volume held by a cup and corresponding with a particular cup size) may also be referred to as a "true cup size" or "true cup sizing." In some such embodiments, different coding for cup sizes, and bra sizes, may be used to label and select bras and sets of bras, and to provide bras corresponding with, matching and fitting a woman's body. For example, in some embodiments, different cup sizes and bra sizes, and increments (other than conventional cup sizes and sizing increments) of breast size dimensions and corresponding (e.g., matching or fitting) cups may be provided, and used to identify subsets (of cup sets) corresponding with each increment of such increments of breast size dimensions and corresponding cups. Such different cup size and bra size increments may be labeled with unconventional codes, each code corresponding with a different such bra size increment, preventing confusion with conventional cup size increments and coding. For example, in some embodiments, such different bra size increments may be coded, and ranked as follows: "Cup #1, Cup #2, Cup #3," etc., with cup sizes and dimensions that correspond to each code increasing as the codes progress from left to right. As another example, in some embodiments, such different bra size increments may be coded, and ranked as follows: "Cup Size #1, Cup Size #2, Cup Size #3," etc., with cup sizes and dimensions corresponding to each code increasing from left to right. In some such embodiments, multiple cup sizes may be covered by a single such code. In some such embodiments, two cup sizes may be covered by a single such code. In some such embodiments, such two cup sizes may be conventional cup sizes. For example, sizes A and B are combined to create Cup #1, in some embodiments.

Any of the aspects for the sizing system set forth in FIG. 12 related to cups, bands or straps may be applied to, and included in, any other sizing system set forth in reference to the present invention. For example, any use of conventional cup sizes in any sizing system set forth in this application may be replaced by the different cup size and bra size increments set forth in reference to FIG. 12. As another example, any of the methods set forth above for creating bras and other supporting garments corresponding to the measurements set forth in FIG. 12 may be applied to any other measurements, and charts of measurements, set forth in this application.

Figure 13:
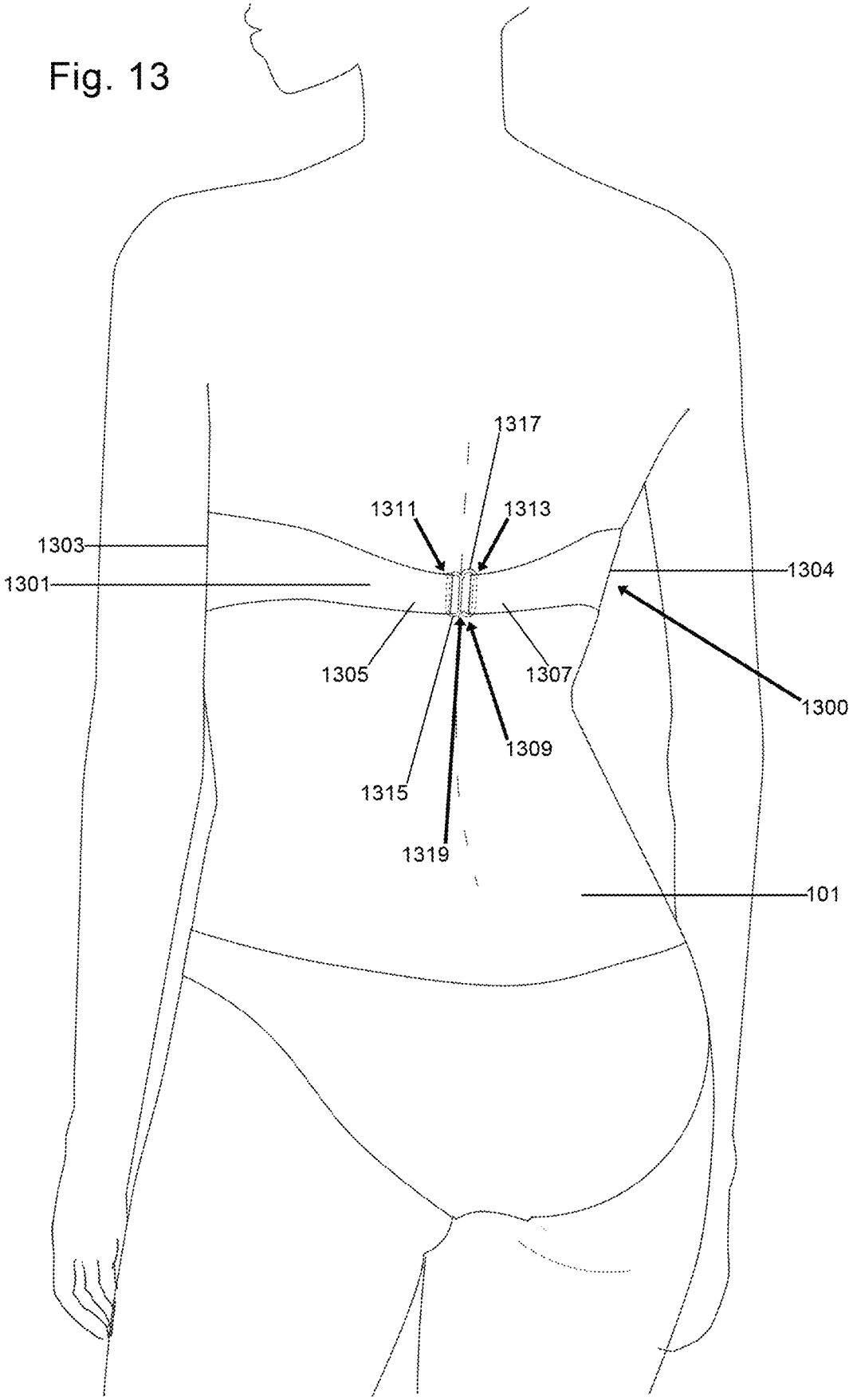
FIG. 13 is a rear perspective view of an example strapless bra, fitted to the same woman's body of figures set forth above, with a single, preferably adjustable-length, mid-position back band, and other aspects of some embodiments in accordance with the present invention.

FIG. 13 is a rear perspective view of an example strapless bra 1300, fitted to the same woman's body, 101, of figures discussed above, with a single (preferably adjustable-length, in some embodiments) mid-position back band, such as the example shown as mid back band 1301, and other aspects in accordance with some embodiments the present invention. As with bands 901 and 902, discussed above, single back band 1301 has a preferably adjustable length and is attached on each end, now end 1303 and end 1304, to the side edges (not pictured) of the front of bra or garment 1300, holding it in place on woman's body 101.

Back band 1301 may comprise at least two major subcomponents: separable and conjoinable left side 1305, and separable and conjoinable right side 1307, which may be joined together (as pictured) or separated, using a J-hook connector 1309. As shown in the figure, J-hook connector 1309 may be temporarily attached to one of two loops of material, such as loop 1311 and loop 1313, each at the end of one of major subcomponents 1305 and 1307, respectively, and more permanently attached to the other loop of material at the end of the major subcomponents, as also pictured. In the embodiment pictured, J-hook connector 1309 is attached to loop 1311 and loop 1313 via two conjoined ring components, such as ring component 1315 and ring component 1317, and more permanently in the instance of ring component 1315, which is threaded through loop 1311, than in the instance of ring component 1317, which comprises an opening 1319, through which loop 1313 may be variably threaded or unthreaded, separating or conjoining left side 1305 and right side 1307, and opening or closing back band 1301.

As discussed above, in some embodiments, back band 1301 may be adjustable in length, to conform to, fit, hold and enhance the appearance of a variety of body circumferences and dimensions, measurements and sizing systems for which are discussed in greater detail below. As also discussed above, in sizing systems according to aspects of the present invention, a plurality of back bands 1301 may be sized and provided in different lengths, ranges of lengths, and average lengths (in adjustable-length embodiments), and attached to other bra components, to correspond with measured dimensions of a woman's body.

As also set forth above with respect to other embodiments involving bras, aspects of strapless bra 1300 may be integrated with or comprised in any other suitable top or other supporting garment. In other words, the scope of the invention is not limited by the present embodiment, or any other embodiment, in the form of a bra.

Figure 14:
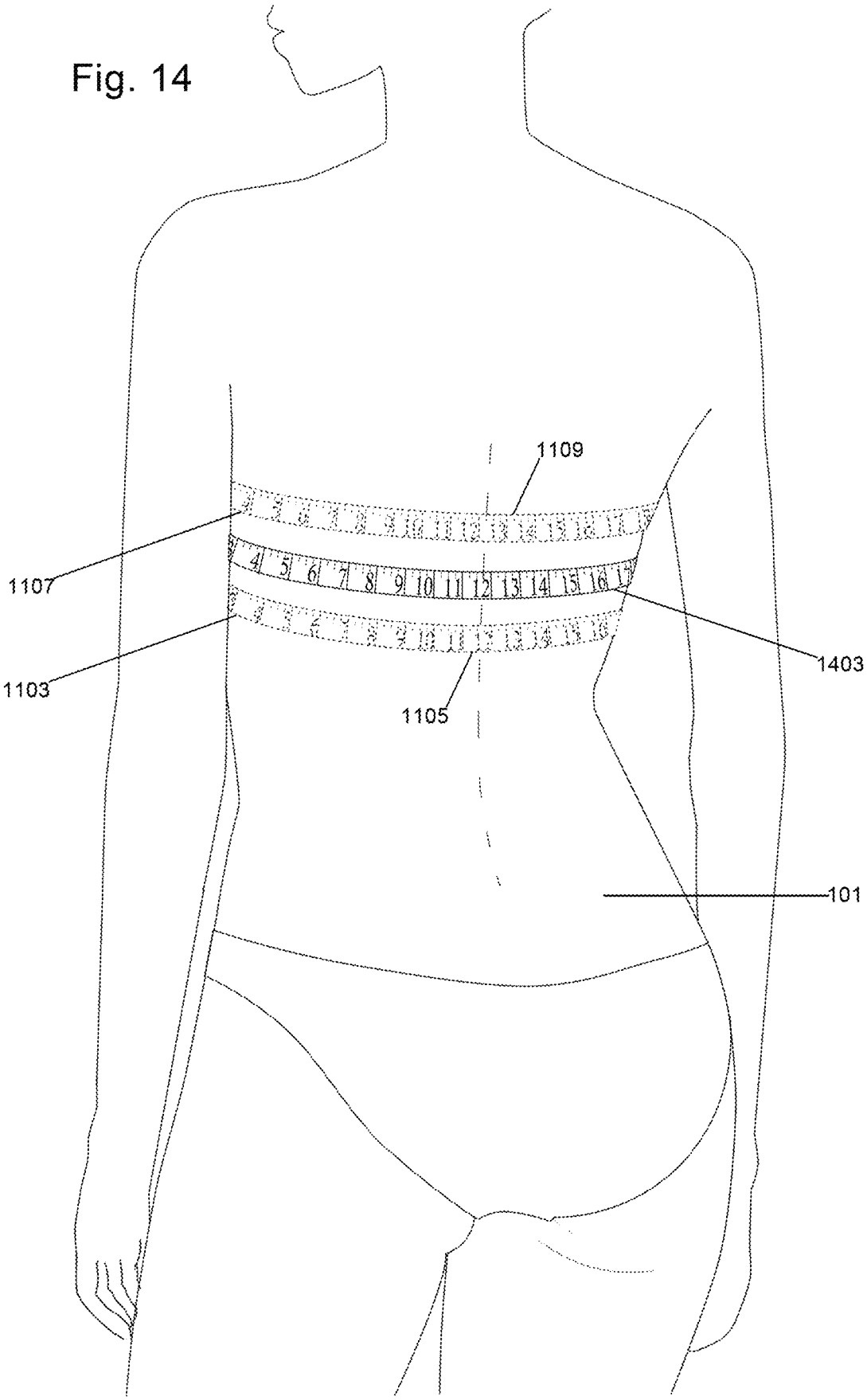
FIG. 14 is a rear perspective view of the same woman's body of figures set forth above, illustrating areas of the body and dimensions that may be measured and correspond to the dimensions of the example strapless bra set forth immediately above, in accordance with some embodiments of the present invention.

FIG. 14 is a rear perspective view of the same woman's body, 101, of figures set forth above, illustrating areas of the body and dimensions which may be measured and correspond to the dimensions of the example strapless bra 1300, and form the basis of a bra or other supporting garment sizing and creation system, in accordance with aspects of the present invention.

For reference, other dimensions discussed previously, for a multiple band version of the present invention—namely, dimension component 1103 through dimension component 1109—are shown in the present figure. A measurement of woman's body 101 corresponding with the length of back band 1301, is shown as mid-back circumference band length 1403. As can be seen in the picture, mid-back circumference length 1403 is preferably taken from a vertical position on the woman's body 101 that is equidistant from dimension component 1103 and dimension component 1107 or, in some embodiments, alternatively or, in some embodiments, in addition, equidistant from dimension component 1105 and dimension component 1109. Thus, mid-back circumference band length 1403 is centrally located on a woman's back, equidistant in its position vertically on a woman's body from prior measurements for the two-strap embodiment. In this way, pressure from corresponding mid band 1301 is evenly distributed across the front of a bra or other garment front, such as that shown in FIG. 8, which may be attached to band 1301, just as it was shown attached to multiple bands in FIGS. 8 and 9.

Figure 15:
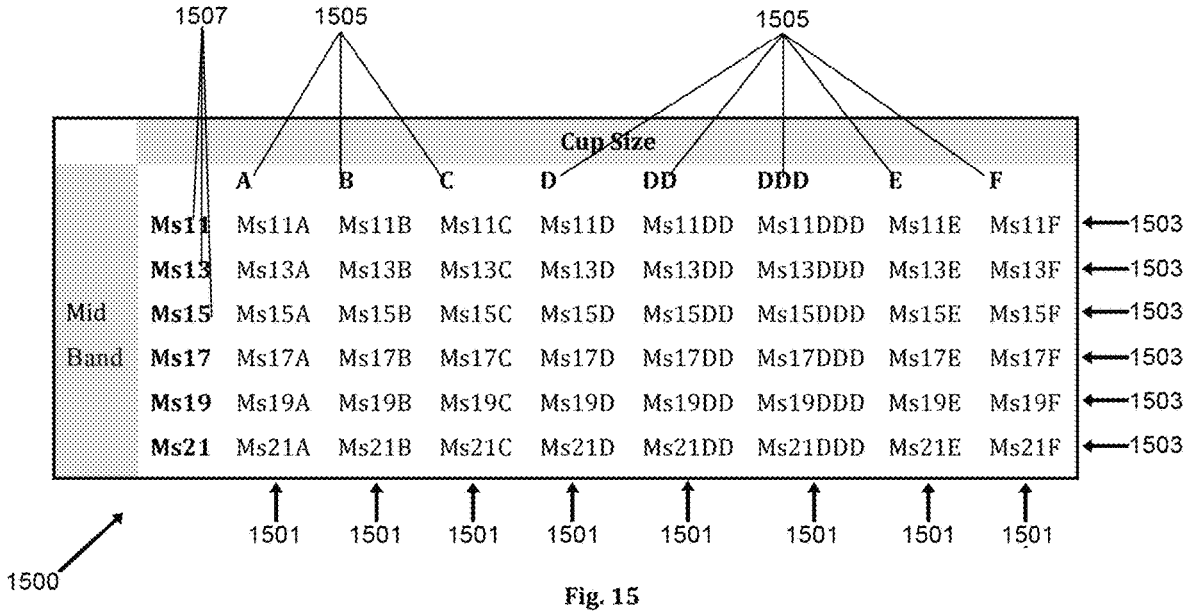
FIG. 15 depicts a table, coding and other aspects of an example new sizing system corresponding with strapless bras and garments, in accordance with some embodiments of the present invention.

FIG. 15 depicts a table 1500, coding and other aspects of an example new sizing system corresponding with strapless bras and garments, in accordance with aspects of the present invention. Table 1500 depicts eight columns 1501, corresponding to the measurement of a cup size, as discussed above, on various women's bodies and of corresponding bras or other supporting garments created or fitted thereto, and six rows 1503, corresponding with the measurement of a mid-back band dimension, such as mid-back circumference band length 1403, as discussed above, of various women's bodies and of bras or other supporting garments fitted thereto. By selecting any one value shown in the column headings 1505 and any one value shown in the row headings, such as the examples shown as 1507, a wide range of possible combinations can be created, corresponding with a good fit of a bra for a particular woman's body. For example, a woman with an average mid-back band dimension measurement of 17 inches, coded as "Ms17," and an average cup size dimension measurement of C, coded as "C", may select the overall size code of "Ms17C." However, because bands provided to match each mid-back strap or band dimension (as with any other dimension corresponding with strap or band lengths set forth in the present application) may be adjustable in length in some embodiments, with length adjustment hardware in some embodiments of the present invention, a sizing system implementing covered ranges of such lengths may, instead, be used. If so, preferably, a middle, median or other average length of a corresponding band or strap may be selected to fit a particular woman's body, in some embodiments of the sizing system inventions set forth in the present invention. As discussed above, because any of the straps or bands of bras and other garments set forth in the present application may be individually adjusted, an infinite array of alternate, more form-fitting sizes may be selected and created with any bra or garment sized in accordance with the system set forth in the present figure. For example, the same woman may select a size down or up, or more, when measured as fitting a particular set of dimensions set forth in the chart.

As explained above, in reference to FIG. 12, bra cups, such as left breast-supporting cup section 803 and right breast-supporting cup section 805, may be assembled together with band sizes created according to sizing systems of the present invention, such as the system set forth in reference to FIG. 15. In some embodiments, such cup sizes correspond with, and be created in reference to, a set of cup sizes, which may be true cup sizes, meaning that cups created and designated according to a particular cup size within the set of cup sizes of the measurement system do not vary in size when created, matched and assembled in conjunction with different band lengths or other such measurements of other components aside from cup measurements. In some embodiments, and again, as explained previously in reference to FIG. 12, above, such cup sizes may be provided in increments that do not match conventional bra cup sizes. For example, in some sizing systems in accordance with the present invention, and as discussed above, as many as 10 different cup sizes and increments may be provided and used, which do not correspond with the increments of conventional cup sizes, in some embodiments. In some embodiments, the cup sizes provided are fixed cup sizes, meaning that the size of the dimensions of a woman's breast measured (e.g., volume or height of her breast(s)) and corresponding (e.g., matching or fitting) cups matched and provided for that woman (e.g., from subset(s) of a set of such cups or bras) do not vary with different sizes of band length dimensions, band lengths or other band sizes, such as those set forth in the present figure. This fixed size for dimensions and cups (e.g., volume held by a cup and corresponding with a particular cup size) may also be referred to as a "true cup size" or "true cup sizing." In some such embodiments, different coding for cup sizes, and bra sizes, may be used to label and select bras and sets of bras, and to provide bras corresponding with, matching and fitting a woman's body. For example, in some embodiments, different cup sizes and bra sizes, and increments (other than conventional cup sizes and sizing increments) of breast size dimensions and corresponding (e.g., matching or fitting) cups may be provided, and used to identify subsets (of cup sets) corresponding with each increment of such increments of breast size dimensions and corresponding cups. Such different cup size and bra size increments may be labeled with unconventional codes, each code corresponding with a different such bra size increment, preventing confusion with conventional cup size increments and coding. For example, in some embodiments, such different bra size increments may be coded, and ranked as follows: "Cup #1, Cup #2, Cup #3," etc., with cup sizes and dimensions that correspond to each code increasing as the codes progress from left to right. As another example, in some embodiments, such different bra size increments may be coded, and ranked as follows: "Cup Size #1, Cup Size #2, Cup Size #3," etc., with cup sizes and dimensions corresponding to each code increasing from left to right. In some such embodiments, multiple cup sizes may be covered by a single such code. In some such embodiments, two cup sizes may be covered by a single such code. In some such embodiments, such two cup sizes may be conventional cup sizes. For example, sizes A and B are combined to create Cup #1, in some embodiments.

Because a band provided for the mid-back circumference band length 1403 (as with any other dimension corresponding with strap or band lengths discussed in this application) may be adjustable in some embodiments, with length adjustment hardware in some embodiments, a sizing system implementing covered ranges of such lengths may, instead, be used. If so, preferably, a middle, median or other average length of a corresponding band's total range of lengths, may be selected to fit a particular woman's body measurements as set forth in this application, in some embodiments of the sizing system inventions set forth in the present invention related to adjustable bra bands and straps. In some embodiments, the total range of lengths covered by a sizing system for adjustable and other band lengths or strap lengths in accordance with the present invention may be different than that set forth, and different from any known band and strap sizing ranges and increments. For example, in some embodiments, such a total range of lengths covered by a sizing system may cover a range of between 26 inches and 60 inches, at a plurality of band length increments (e.g., 10 increments, which may be referred to as "Band Length 1," "Band Length 2," etc.) As discussed above, because any of the straps or bands of bras and other garments set forth in the present application may be individually adjusted, an infinite array of alternate, more form-fitting sizes may be selected and created with any bra or garment sized in accordance with aspects of the system set forth in the present figure. For example, the same woman may select a size down or up, or more, when measured as fitting a particular set of dimensions set forth in the sizing system.

Any of the aspects for a sizing system set forth in FIG. 15 related to cups, bands or straps may be applied to, and included in, any other sizing system set forth in reference to the present invention. For example, any use of conventional cup sizes in any sizing system set forth in this application may be replaced by the different cup size and bra size increments set forth in reference to FIG. 15.

Figure 16:
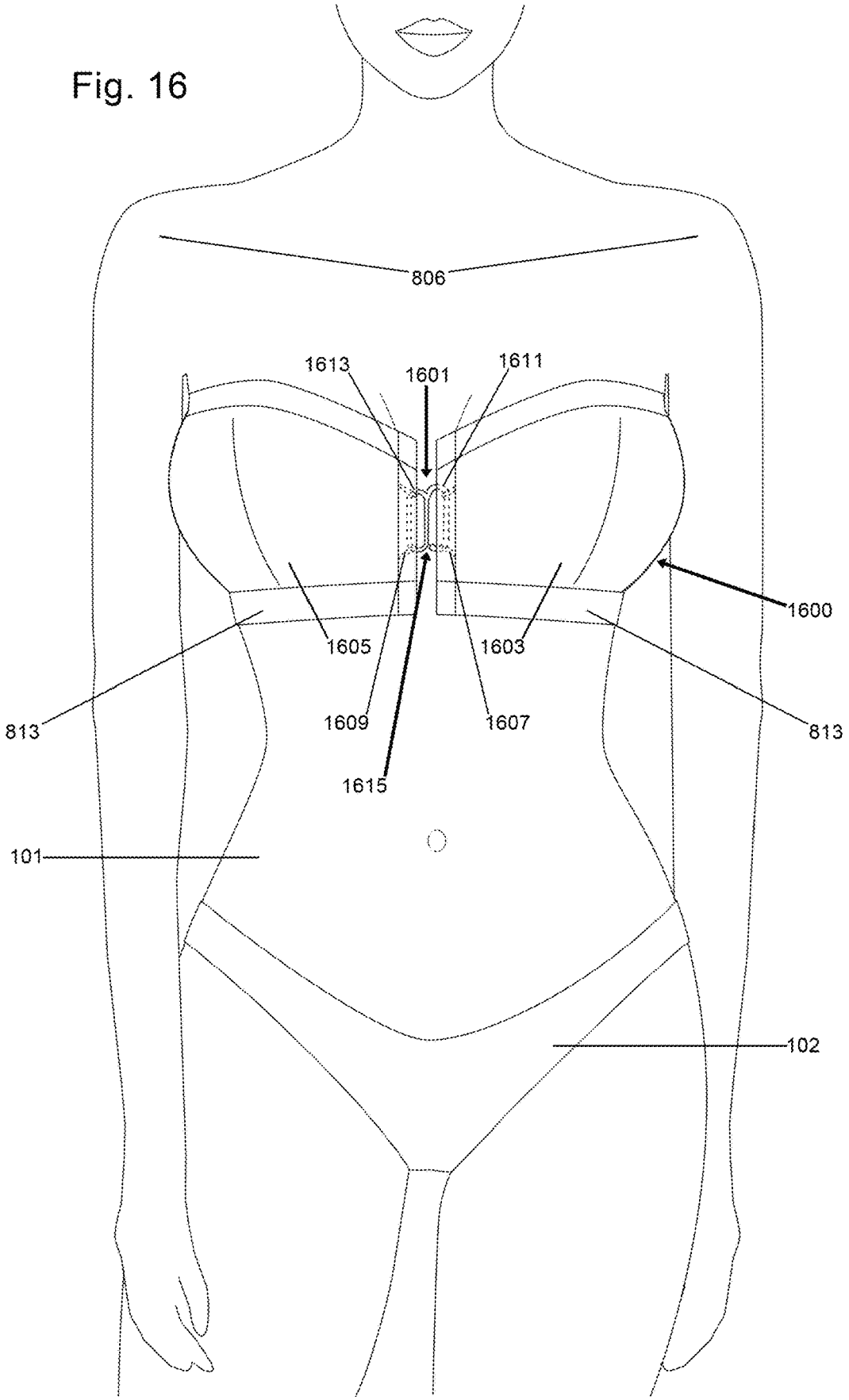
FIG. 16 is a front view of another example strapless bra (meaning that it does not comprise any over-the-shoulder straps), similar in nature to other bras or garments discussed above, but with an single, front J-hook connector, configured to variably join or separate two or more major subcomponents of the bra.

FIG. 16 is a front view of another example strapless bra 1600 (meaning that it does not comprise any over-the-shoulder straps), similar in nature to bra or garment 800, discussed above, but with an single, front J-hook connector 1601, configured to variably join or separate two or more major subcomponents of bra or garment 1600, such as breast-supporting cups, including left breast-supporting cup section 1603 and right breast-supporting cup section 1605.

As with other J-hook connectors set forth in the present application, J-hook connector 1601 may be temporarily attached to one loop of material, such as loop 1607, at the end of one of the major subcomponents, namely left breast-supporting subcomponent 1603, and more permanently attached to the end of another of the major subcomponents, as also pictured. In the embodiment pictured, J-hook connector 1601 is attached to loops, such as loop 1607 and loop 1609 via two conjoined ring components, such as ring component 1611 and ring component 1613, and more permanently in the instance of ring component 1613, which is threaded through loop 1609, than in the instance of ring component 1611, which comprises an opening 1615, through which loop 1609 may be variably threaded or unthreaded, separating or conjoining left breast-supporting cup section 1603, and right breast-supporting cup section 1605, and opening or closing bra or garment 1600.

Figure 17:
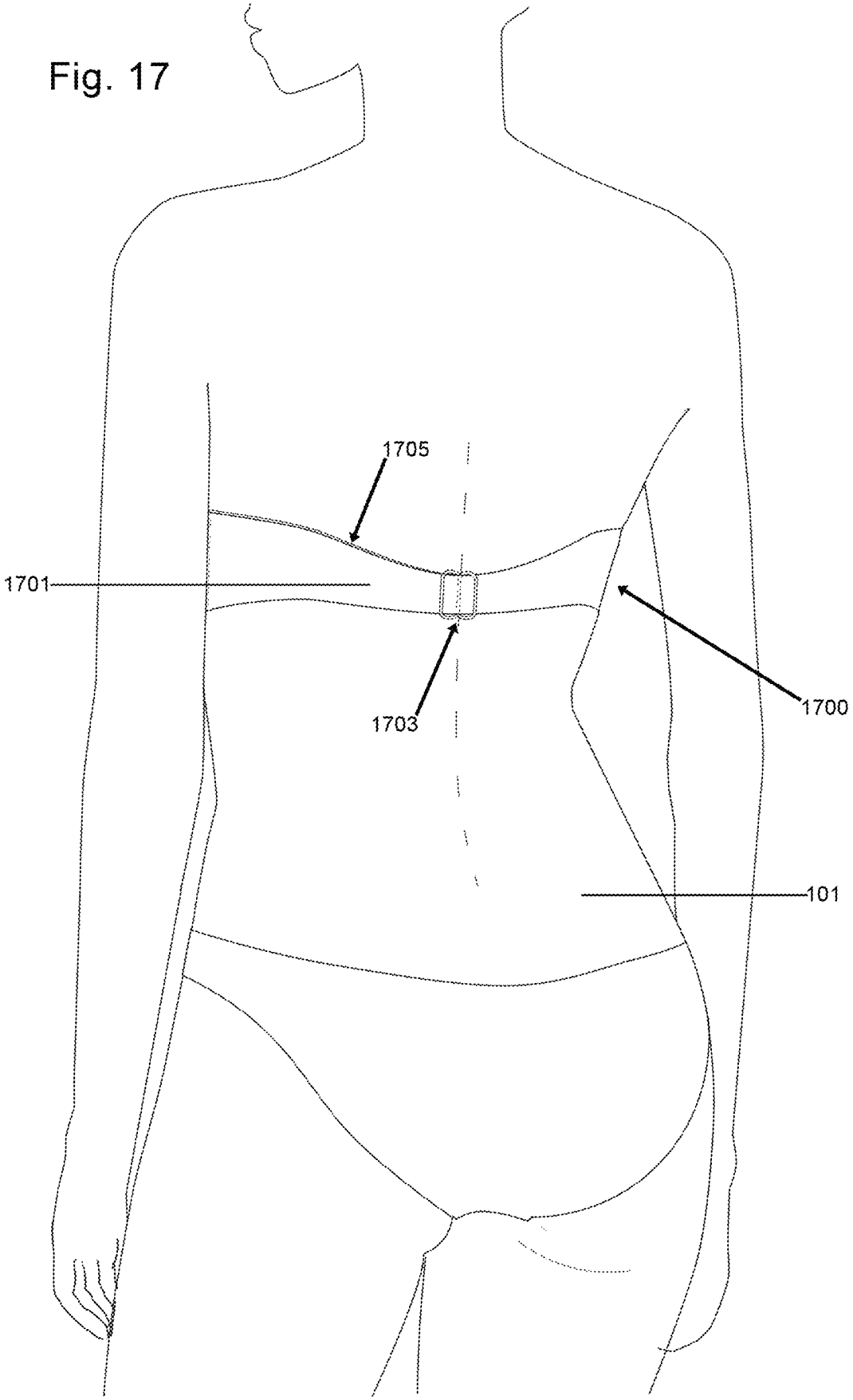
FIG. 17 is a rear perspective view of an example strapless bra, which may be the same bra discussed immediately above, fitted to the same woman's body of figures set forth above, with a single, preferably adjustable-length, mid-position back band, in accordance with some embodiments of the present invention.

FIG. 17 is a rear perspective view of an example strapless bra 1700, which may be the same bra 1600, discussed immediately above, fitted to the same woman's body, 101, of figures discussed above, with a single, preferably adjustable-length, mid-position back band, such as the example shown as back band 1701, in accordance with the present invention. Unlike the single mid-position back band 1301, discussed above, back band 1701 is preferably more permanently joined together as a single piece, rather than comprising separable and conjoinable subcomponents. Instead, to remove and don bra or garment 1700, back band 1701 may be loosened or tightened, until it can slide over or hold, respectively, woman's body 101, using example slider 1703. Because, as with other length-alterable bands and straps set forth in the present application, in some embodiments, band 1701 comprises a doubled over, folded length 1705, doubled over itself, on one side of slider 1703, and because the folded length 1705 is able to roll over a slit, roller, turnstile or other stanchion at the edge of the front section of bra or garment 1700 (not pictured), slider 1703 can lengthen or shorten back band 1701 by sliding to the right or left along back band 1701, and pulling more or less material to so roll over, causing more or less material of back band 1701 to be doubled over itself. Alternatively, or in addition, and as discussed above, bra or garment 1700 may be removed and donned from woman's body 101 by removing or conjoining a front-facing fastener, in some embodiments.

Figure 18:
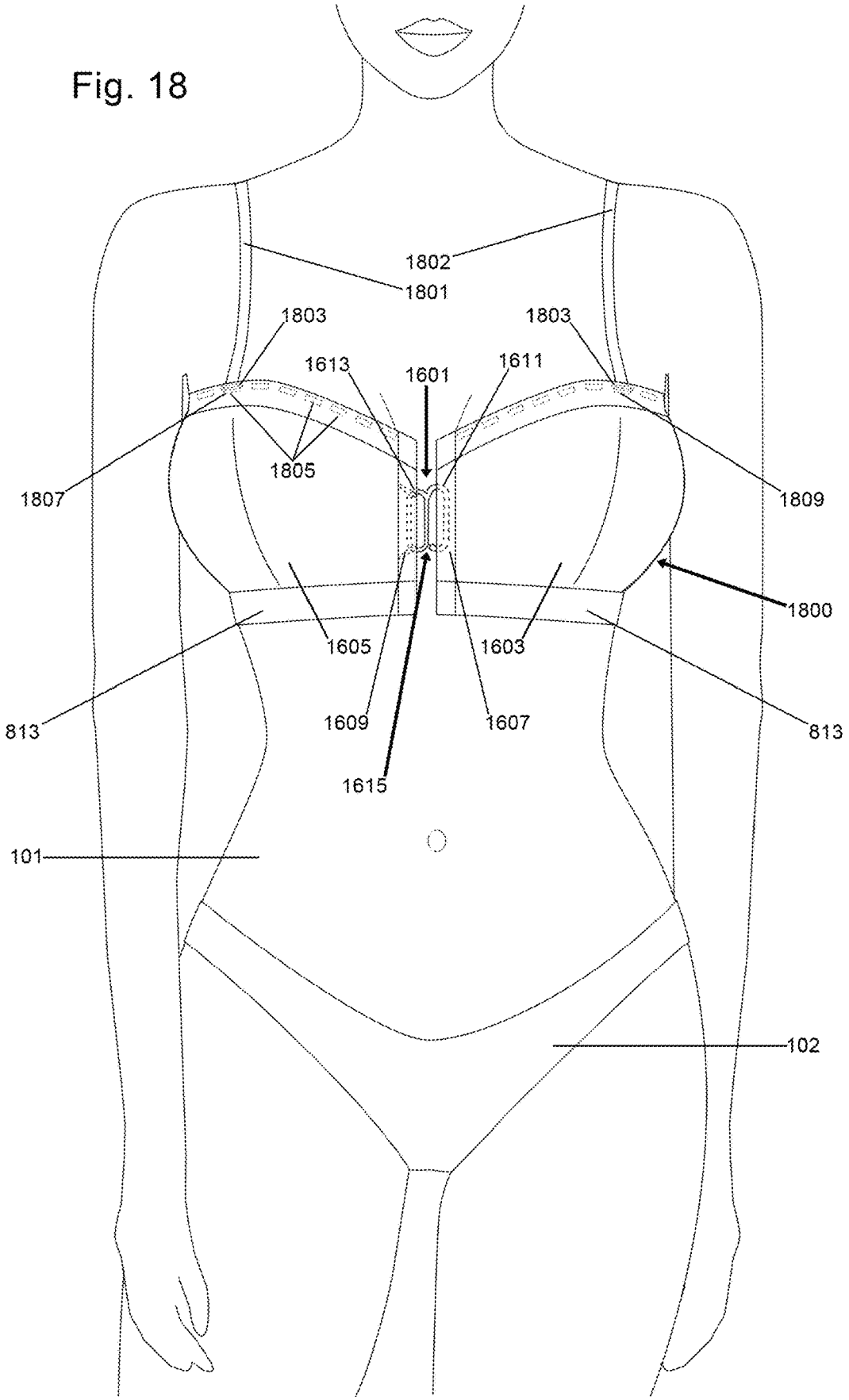
FIG. 18 is a front view of an example everyday bra, with adjustable strap positions, in accordance with some embodiments of the present invention.

FIG. 18 is a front view of an example everyday bra 1800, with adjustable strap positions, in accordance with embodiments of the present invention. Although bra 1800 may be generally similar in nature and subcomponents to other strapless bras and garments set forth in the present application, such as example strapless bra 1600, example bra or garment 1800 comprises a number of additional new aspects, increasing the support provided by the bra with adjustable straps 1801 and 1802. As discussed above, in some embodiments, any strap or band of bras or other supporting garments in the present application may be adjustable in length, according to any hardware or technique for length adjustments set forth in the present application. In addition, in some embodiments of the invention, as pictured, straps 1801 and 1802 are adjustable in the sense that their point of attachment on or about the remainder of bra or garment 1800 may be varied, at the discretion of a user. Each strap 1801 and 1802 comprise hooks or other variable connectors 1803, (e.g., at least one end of each strap, such as front ends, as pictured) which may be attached to any of a series of loops, such as the examples shown as 1805, lining or near the top edge of the remainder of garment 1800. Thus, the example positions of straps 1801 and 1802, fastened to example loops 1807 and 1809, are one set of several possible attachment positions which may be selected and varied by the user, to complement any number of different outfits, with various shapes and sizes of decolletage.

Figure 19:
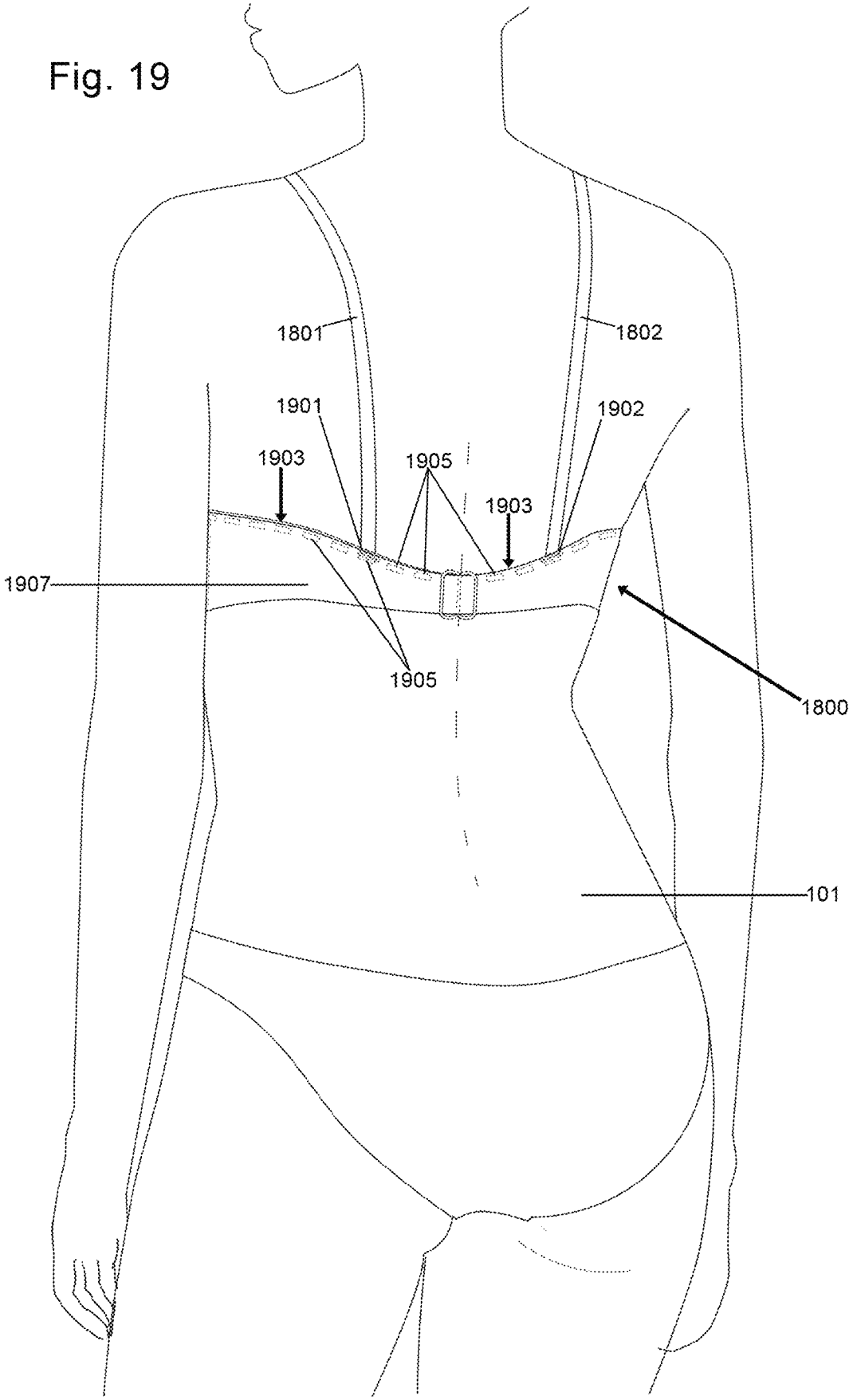
FIG. 19 depicts the same example everyday bra discussed immediately above, from a rear perspective view.

FIG. 19 depicts the same example everyday bra 1800 from a rear perspective, and illustrating additional ends—namely, end 1901 and end 1902 of adjustable straps 1801 and 1802. As with the end of strap 1801 and the end of strap 1802 pictured in FIG. 18, discussed above, end 1901 and end 1902 may comprise hooks or other variable connectors or fasteners, which may be attached to any of another series of additional rearward loops, in some embodiments, such as any of the examples shown as loops 1905, at or toward the upper edge 1903 of a back-supporting band, now shown as 1907. Thus, and again, the attachment points and positions of strap 1801 and strap 1802 on or about the remainder of everyday bra 1800 may be varied at the back side of everyday bra 1800, just as with the front side, discussed above, at the discretion of a user, to complement and coordinate with the position and style of materials of any number of different outfits, with various shapes and sizes of materials at the back.

Figure 20:
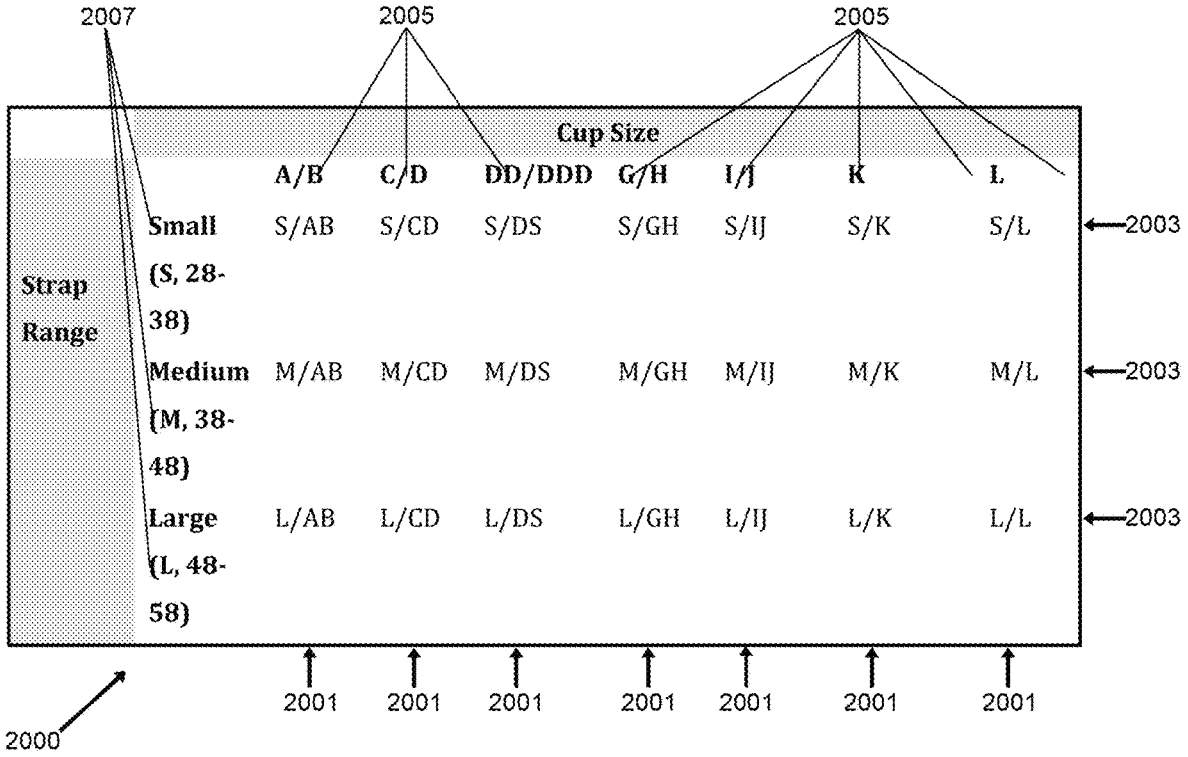
FIG. 20 depicts a table, coding and other aspects of an example new sizing system corresponding with bras and garments, in accordance with some embodiments of the present invention.

FIG. 20 depicts a table 2000, coding and other aspects of an example new sizing system corresponding with bras and supporting garments, in accordance with aspects of the present invention. Table 2000 depicts seven columns 2001, each corresponding with a measurement of a cup size dimension, as discussed above, of various women's bodies and of bras or other supporting garments fitted thereto, and three rows 2003, each corresponding with a range of measurements of a lateral, circumferential band or strap length dimension (depending on the embodiment of the invention), such as band length dimension 1403, as discussed above, of various women's bodies and of bras or other supporting garments fitted thereto. By selecting any one value shown in both the column headings 2005 and row headings 2007, a wide range of possible combinations can be created, corresponding with a good fit for a bra to particular woman's body, and with far fewer required size options than in other bra and supporting garment sizing systems. For example, a woman with a Medium range of strap or band length measurements (e.g., between 38 and 48 inches), coded as "M," and an average cup size dimension measurement of DD, coded as "DD", may select the overall size code of "M/DD," as shown in table 2000. However, because each band or strap length and the cup size of any bra or other supporting garment in accordance with the present invention may be varied (as with any other dimension corresponding with strap or band lengths that are adjustable, with length adjustment hardware, in some embodiments of the present invention), in some embodiments, a sizing system implementing overlapping ranges may, instead, be used. If so, preferably, a middle, median or other average length of a corresponding band, within the range of stated length measurements, may be selected to fit a particular woman's body, in some embodiments of the sizing system inventions set forth in the present invention.

As explained above, in reference to FIG. 12, bra cups may be assembled together with bands of sizes created according to sizing systems of the present invention, such as the system set forth in reference to FIG. 20. In some embodiments, such cup sizes correspond with, and are created in reference to, a set of cup sizes, which may be true cup sizes, meaning that cups created and designated according to a particular cup size within the set of cup sizes of the measurement system do not vary in size when created, matched and assembled in conjunction with different band lengths or other such measurements of other components aside from cup measurements. In some embodiments, and again, as explained previously in reference to FIG. 12, above, such cup sizes may be in increments that do not match conventional bra cup sizes. For example, in some sizing systems in accordance with the present invention, and as discussed above, as many as 10 different cup sizes and increments may be provided and used, which do not correspond with the increments of conventional cup sizes, in some embodiments. In some embodiments, the cup sizes provided are fixed cup sizes, meaning that the size of the dimensions of a woman's breast measured (e.g., volume or height of her breast(s)) and corresponding (e.g., matching or fitting) cups matched and provided for that woman (e.g., from subset(s) of a set of such cups or bras) do not vary with different sizes of band length dimensions, band lengths or other band sizes, such as those set forth in the present figure. This fixed size for dimensions and cups (e.g., volume held by a cup and corresponding with a particular cup size) may also be referred to as a "true cup size" or "true cup sizing." In some such embodiments, different coding for cup sizes, and bra sizes, may be used to label and select bras and sets of bras, and to provide bras corresponding with, matching and fitting a woman's body. For example, in some embodiments, different cup sizes and bra sizes, and increments (other than conventional cup sizes and sizing increments) of breast size dimensions and corresponding (e.g., matching or fitting) cups may be provided, and used to identify subsets (of cup sets) corresponding with each increment of such increments of breast size dimensions and corresponding cups. Such different cup size and bra size increments may be labeled with unconventional codes, which may be merged in a combination code, each code corresponding with a different such bra size increment, preventing confusion with conventional cup size increments and coding. For example, in some embodiments, such different bra size increments may be coded, and ranked as follows: "Cup #1, Cup #2, Cup #3," etc., with cup sizes and dimensions that correspond to each code increasing as the codes progress from left to right. As another example, in some embodiments, such different bra size increments may be coded, and ranked as follows: "Cup Size #1, Cup Size #2, Cup Size #3," etc., with cup sizes and dimensions corresponding to each code increasing from left to right. In some such embodiments, multiple cup sizes may be covered by a single such code. In some such embodiments, two cup sizes may be covered by a single such code. In some such embodiments, such two cup sizes may be conventional cup sizes. For example, sizes A and B are combined to create Cup #1, in some embodiments.

Similarly, different coding, and sizes, may be used instead of the strap lengths, and band lengths set forth in FIG. 20, and other strap and band lengths set forth in the figures of the present application. For example, rather than "Small," "Medium," and "Large," the terms "Short," "Average" and "Tall" may be used instead, respectively. In such embodiments, the corresponding measurement lengths may be different than that depicted in FIG. 20, but may correspond with population averages for a group of women. Combination coding, such as "S/AB" and "L/K," which results from such different terms for strap lengths or band lengths and cup sizes may also be different than that pictured in FIG. 20, but also corresponding with first initials of the code components, such as "S/1," for the combination of a Short strap or band size and Cup Size #1, and "T/5," for the combination of a Tall strap or band size and Cup Size #5, for example.

Figure 21:
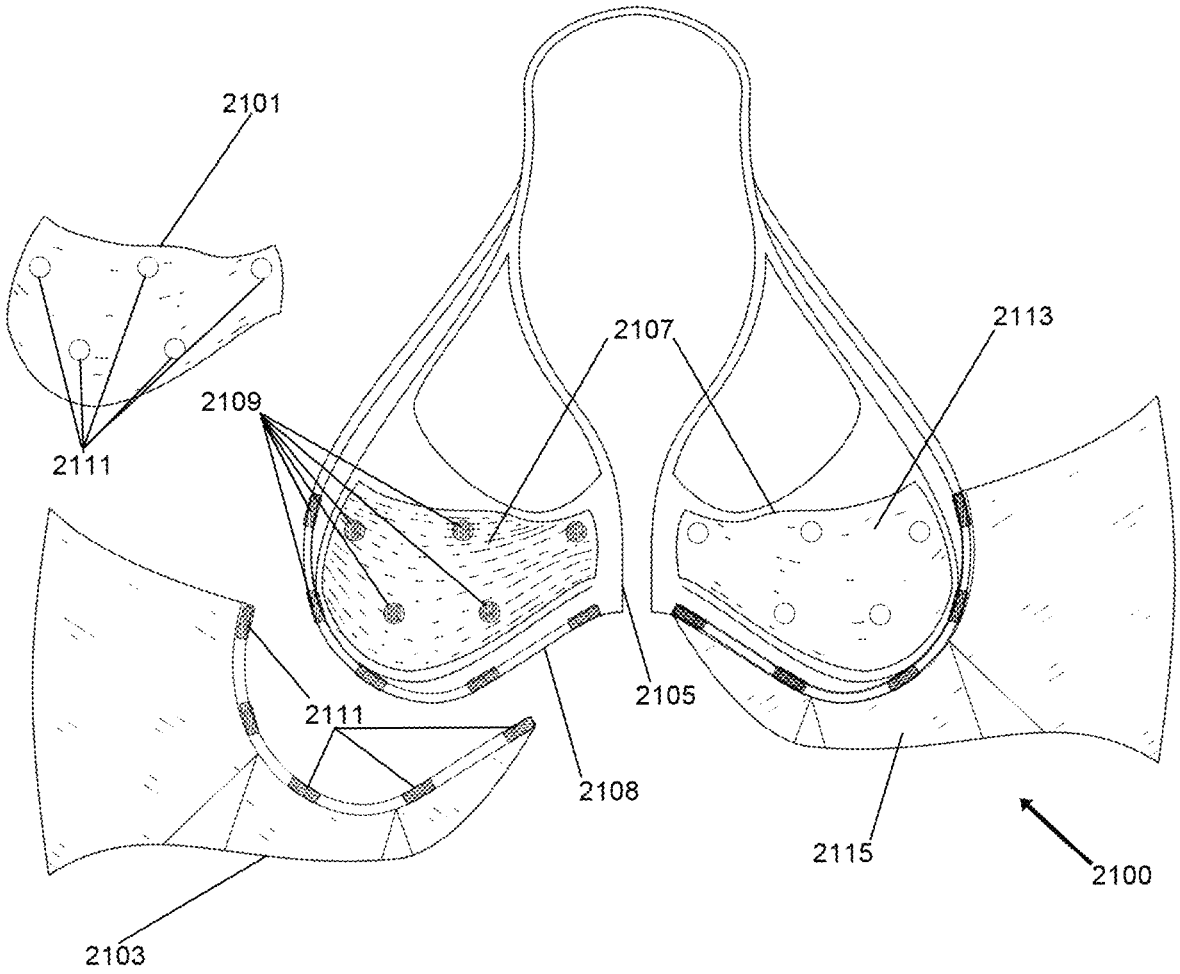
FIG. 21 is a back view of an example backless bra in accordance with some embodiments of the present invention.

FIG. 21 is a back view of an example backless bra 2100 in accordance with aspects of the present invention. Backless bra 2100 may be similar in nature, and have the same subcomponents set forth for, example bra or supporting garment 100, set forth above in this application. In addition, several other new aspects of the invention are set forth and included in backless bra 2100, in conjunction with those aspects previously set forth.

On the left-hand side of the figure, variably and reversibly attachable adhesive panel 2101 and variably and reversibly attachable adhesive panel 2103 are also pictured, separated from, but variably attachable to, a main body 2105 of bra 2100. Adhesive panel 2101 and adhesive panel 2103 preferably comprise one or more flexible, adhesive materials, prone to reversibly adhering to human skin, such as, but not limited to, silicon, rubber, and/or latex, in some embodiments. Lining the inside of breast-accepting cups 2107 and outer edges 2108 of bra or garment 2100 are several attachment points or areas, such as the examples shown as attachment points 2109. Attachment points 2109 may each comprise one-half of any suitable form of connector for joining two pieces of fabric or other thin sheet materials, in a surface covering pattern, while the other half of that connector is comprised in a similar, corresponding pattern of complimentarily shaped attachment points or areas, such as the examples shown as 2111, present on adhesive panel 2101 and adhesive panel 2103. For example, suitable connectors for attachment points or areas 2109 may include, but are not limited to, snaps, hook-and-loop fasteners (such as VELCRO), magnets, and silicon, and adhesives, in some embodiments. By joining the attachment points or areas of both the cups 2107 and adhesive panel 2101 and adhesive panel 2103, both the adhesive panels and the main body 2105 of bra 2100 may be variably detached or joined and, when joined, may allow a user to enhance the normal or contact forces between bra 2100 and her skin, encouraging a more reliable fit and attachment of bra or garment 2100. Such a joined state of the adhesive panels and main body 2105 is shown on the right hand side of the figure, as installed adhesive panel 2113 and installed adhesive panel 2115.

Figure 22:
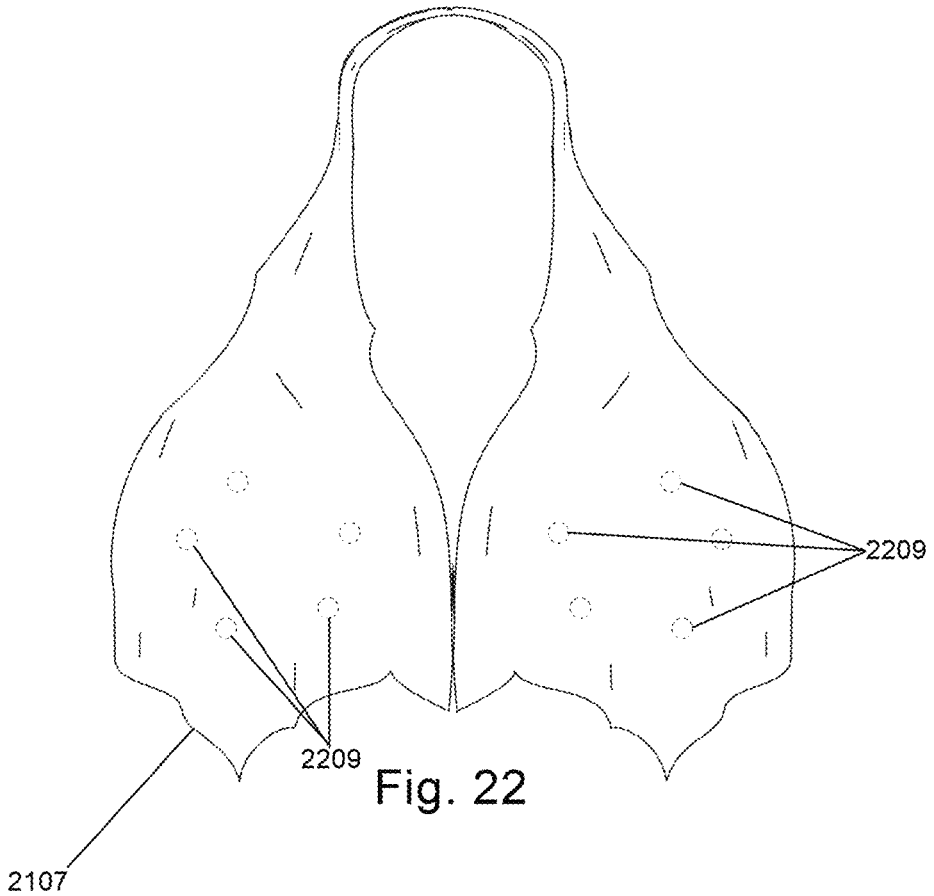
FIG. 22 depicts a front view of the same example backless bra set forth immediately above, but covered with an additional set of outer adhesive points or areas for adhering together the main body of the bra and an article of clothing, such as an example slender form factor flowing halter top, also depicted.
Figure 23:
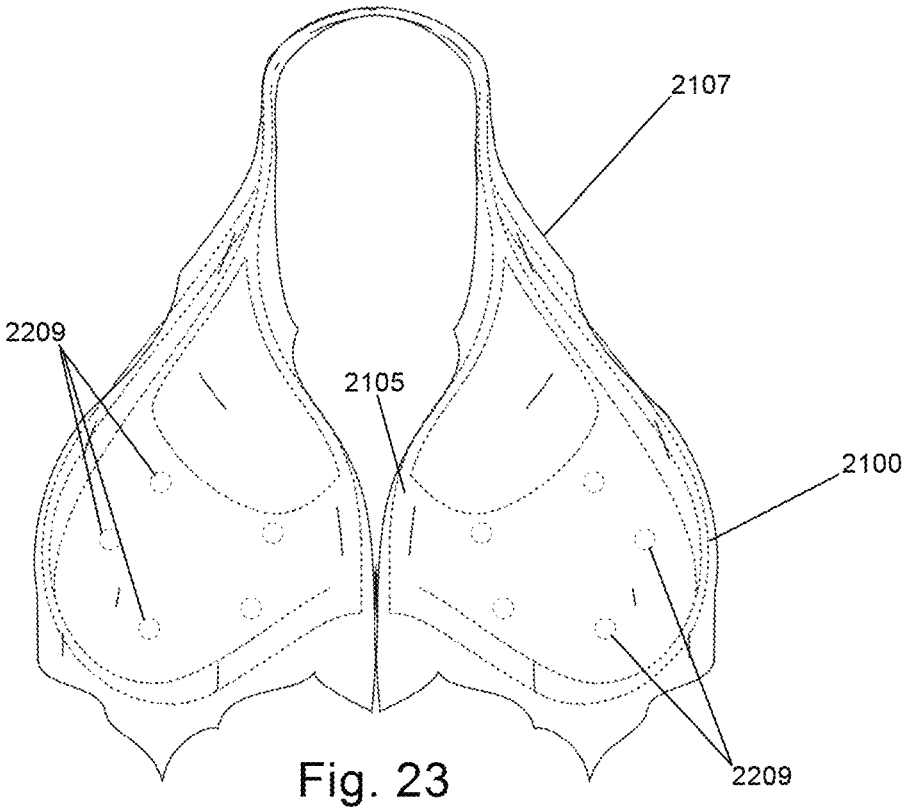
FIG. 23 depicts a front view of the same example backless bra discussed immediately above, and the same example slender form factor flowing halter top, but revealing the underlying location of the bra, in accordance with some embodiments of the present invention.

FIGS. 22 and 23 depict a front view of aspects of the same example backless bra or other supporting garment 2100 set forth above, but covered with an additional set of adhesive points or areas, on its outer, front surface, such as the examples shown as 2209, for adhering the main body 2105 of bra or garment 2100 and an article of clothing, such as example slender form factor flowing halter top 2107. Adhesive points or areas 2209 may include any suitable fastener or connector for adhering to materials found in clothing. For example, in some embodiments, adhesive points or areas 2209 include silicon. In some embodiments, adhesive points or areas 2209 include snaps. In some embodiments, adhesive points or areas 2209 include magnets. In some embodiments, adhesive points or areas 2209 include VELCRO. In some embodiments, adhesive points or areas 2209 include a hook-and-loop fastener. In other embodiments, adhesive points or areas 2209 include adhesives.

According to methods of the present invention, a user may thus first don bra 2100, followed by donning a top with a similar silhouette (e.g., between 2 and 5% greater in all dimensions) just covering bra or garment 2100 from view, while leaving substantially all other areas of the user's body exposed.

FIG. 23 depicts a front view of the same example backless bra or other supporting garment 2100 and the same example slender form factor flowing halter top 2107, but revealing the underlying location of bra 2100. Thus, the preferred minimal form factor of bra or garment 2100 and 2107, and other fitment benefits as discussed above, can be seen.

Figure 24:
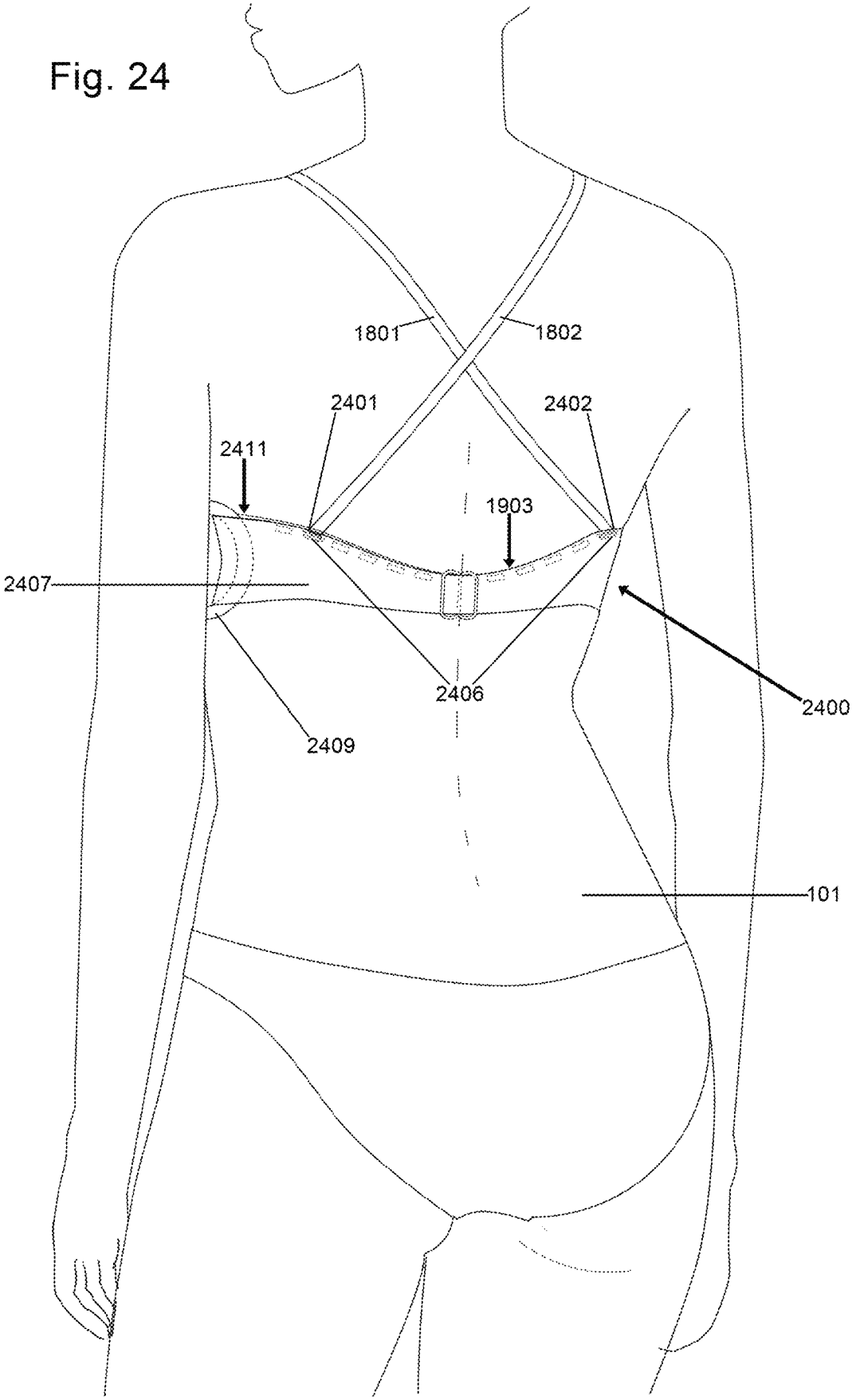
FIG. 24 depicts a back view of an example bra similar in nature to bras depicted above, in FIGS. 18 and 19, but exhibiting different points of attachment for its adjustable variable attachment straps, among other aspects of some embodiments of the present invention.

FIG. 24 depicts a back view of an example bra 2400, similar in nature to bra 1800, and other supporting garments, as depicted in FIGS. 18 and 19, above, but exhibiting different exemplary points of attachment for ends (now 2401 and 2402) of adjustable straps 1801 and 1802—namely, attachment to different loop locations 2406 of the back band, which back band is now shown as 2407. In addition, and partly due to the selected loop locations for attaching the reversible (or "variable") connectors of ends 2401 and 2402, adjustable straps 1801 and 1802 exhibit an exemplary interwoven, or criss-crossed configuration, providing additional support to, and altering the appearance of, woman's body 101. The configuration and number pictured in FIGS. 18, 19 and 24 of straps 1801 and 1802 are but a few of virtually limitless possible configurations and numbers, and the present invention is not limited to the configurations and numbers shown. For example, 3, 4, 6, 8 or more straps such as 1801 may be provided in some embodiments of the invention, and may be drawn off the shoulder or even under the arms, in some methods of use in accordance with aspects of the present invention. Although the example of variable, reversible connectors for both ends of straps has been provided in FIGS. 18, 19 and 24, in other embodiments within the scope of the present invention, such straps may be more permanently attached at one end, yet have reversible, variable connectors at the other end. For example, in some embodiments of any of the bras set forth in the present application, over-the-shoulder straps may be provided that are attached at fixed positions to the front of the bra at one end of each of the straps, while the other end of each of the straps includes reversible connectors, of the nature set forth above in this application.

Also pictured in FIG. 24 is a new form of turnstile and/or hoop 2409, aiding in the folding over, and extension or shortening of, looped material 2411 of back band 2407 (and, thereby, the lengthening and shortening of back band 2407). Specifically, the turnstile and/or hoop 2409 is in the form of a large O-ring connector, threaded through looped material 2411, on one side, and also attached, on its other side, to the side of a front panel of bra or other garment 2400.

Figure 25:
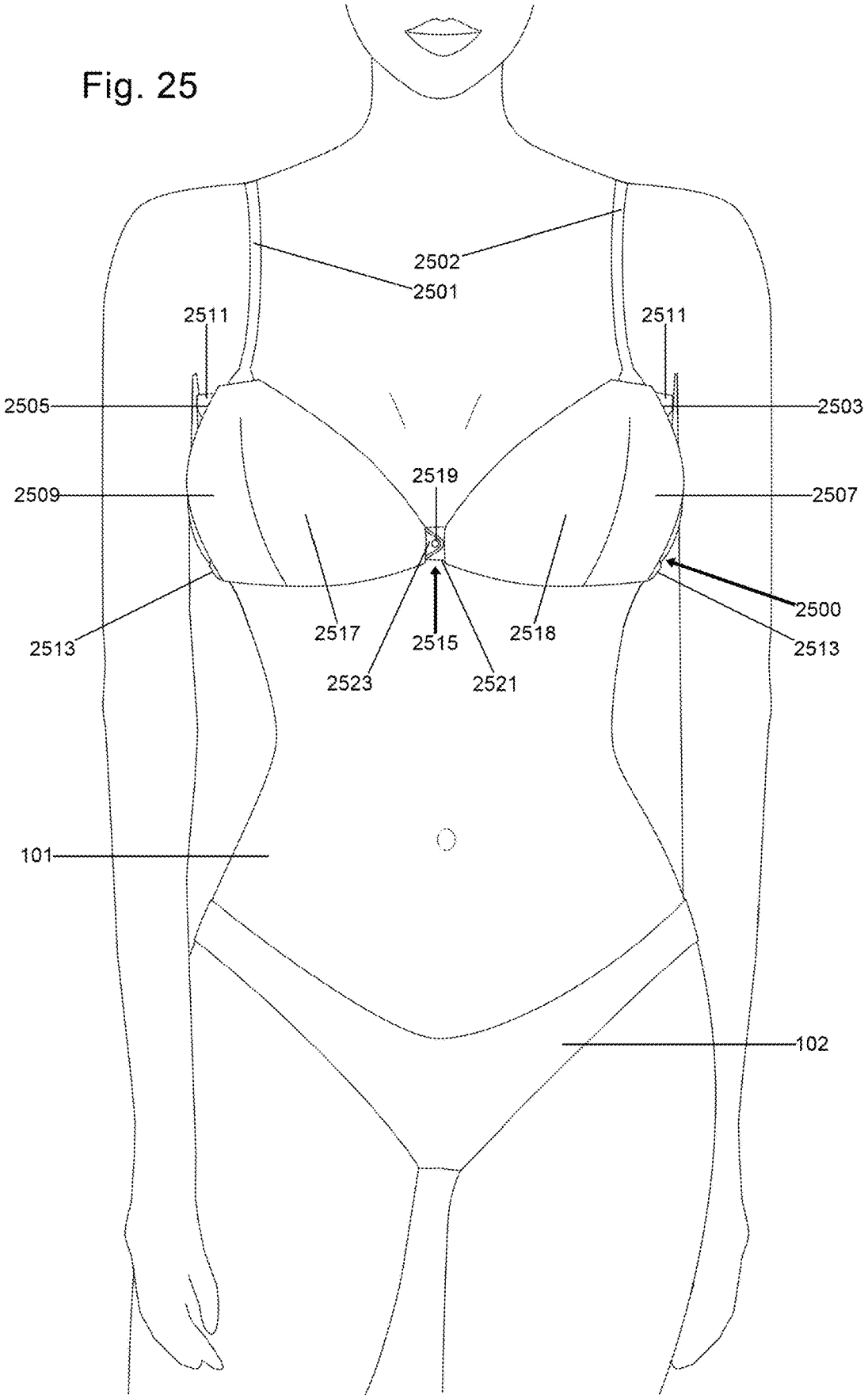
FIG. 25 is a front view of another example bra with minimized back components, in accordance with some embodiments of the present invention.

FIG. 25 is a front view of another example bra 2500 with minimized back components, in place on the same woman's body 101 discussed in reference to other figures of this application. Unlike some other, backless bras set forth elsewhere in this application, bra 2500 does comprise over-the-shoulder straps—such as example right strap 2501 and example left strap 2502. Nonetheless, and as will be discussed in greater detail below in reference to a rear perspective view, such straps, such as right strap 2501 and left strap 2502, do not attach to a circumferential back band that encircles the back of woman's body 101. Instead, right strap 2501 and left strap 2502 may connect directly to a left outer edge 2503 and a right outer edge 2505 of a side and/or front component, such as front panel 2507 or front panel 2509.

As will be explained in greater detail below, however, right strap 2501 and left strap 2502 each may ramify into and/or join with other straps, such as upper lateral straps 2511 and lower lateral straps 2513, which are so directly connected to left outer edge 2503 and right outer edge 2505.

As with other bras and garments set forth in the present application, bra 2500 may comprise a reversible, temporary central connector 2515, which variably connects and detaches a right breast-accepting bra cup 2517, and a left breast-accepting bra cup 2518. While central connector 2515, as with other connectors and fasteners set forth in this application, may be of any type suitable for connecting clothing and supporting components related to bras and other garments, the specific example provided as connector 2515 comprises a clip mechanism with a pushbutton 2519 release. Thus, by pressing pushbutton 2519, a user may release connector 2515, separating right breast-accepting bra cup 2517, and a left breast-accepting bra cup 2518. Conversely, a user may don bra or other garment 2500 by first inserting her arms through straps 2501 and 2502, then drawing right breast-accepting bra cup 2517, and a left breast-accepting bra cup 2518 together, and around and under her breasts, and finally clipping a left-hand clip component 2521 to a right-hand clip component 2523, activating a lock mechanism that causes push button 2519 to pop outward, in which position button 2519 may then be pressed to unlock that lock mechanism (not pictured). In some embodiments, central connector 2515 may be omitted. In some such embodiments, right breast-accepting bra cup 2517, and a left breast-accepting bra cup 2518 may be permanently joined together in the front. For example, in some embodiments, a strip of additional fabric or another material is present at the location shown for connector 2515, and right breast-accepting bra cup 2517, and a left breast-accepting bra cup 2518 may each be sewn to that strip of additional fabric or another material (not pictured). In other embodiments, right breast-accepting bra cup 2517, and a left breast-accepting bra cup 2518 may be sewn directly together at their inner, front, vertical edges, which are shown located closest to connector 2515 in the figure.

Figure 26:
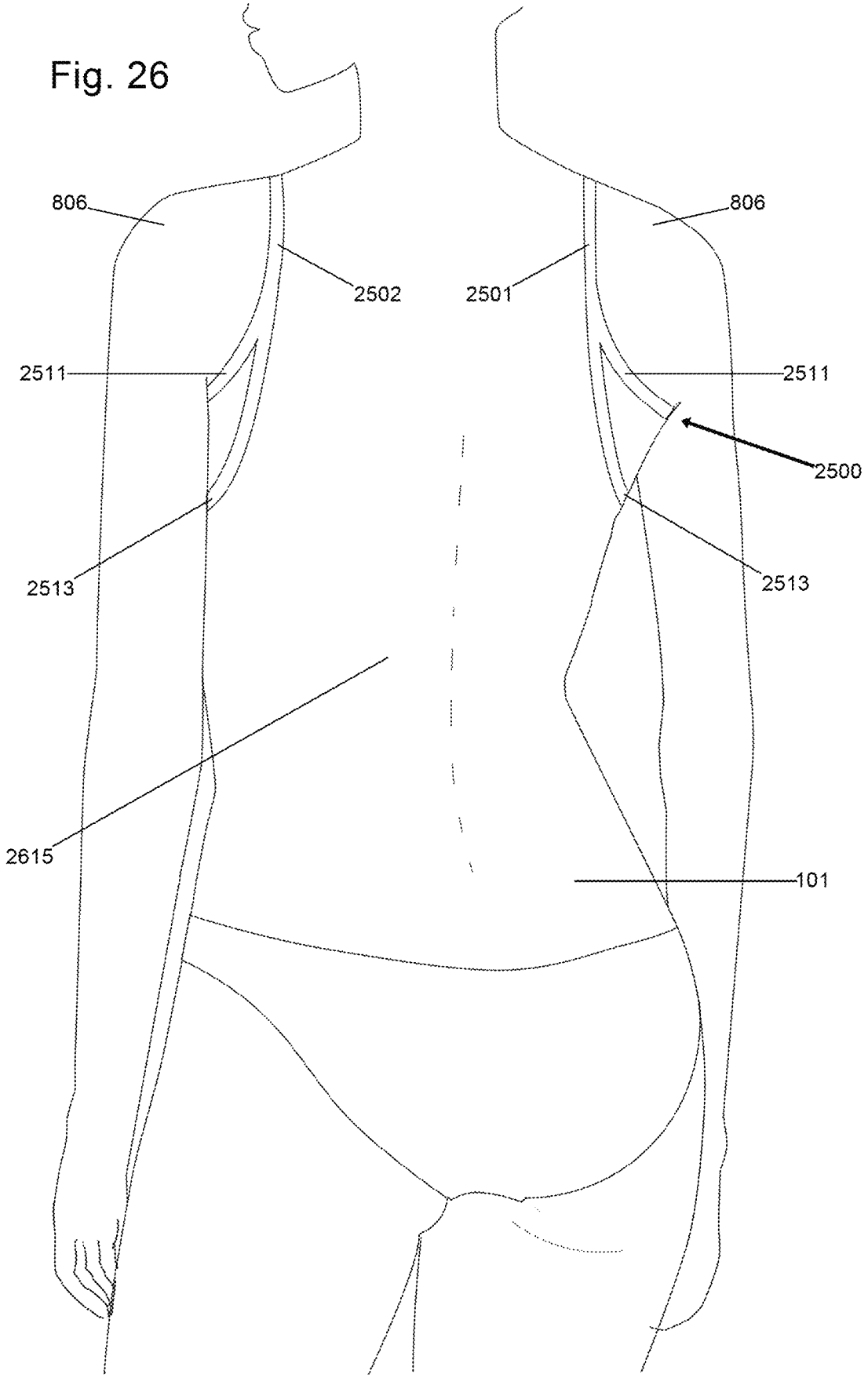
FIG. 26 is a rear perspective view of an example bra with minimized back components, which may be the same bra discussed immediately above, in reference to FIG. 25, in accordance with some embodiments of the present invention.

FIG. 26 is a rear perspective view of an example bra with minimized back components, which may be the same bra 2500, discussed immediately above, fitted to the same woman's body 101 of other figures discussed in this application. As discussed immediately above, bra 2500, or a similar supporting garment, may comprise a set over-the-shoulder straps, which may comprise example right strap 2501 and example left strap 2502. As also discussed above, each of right strap 2501 and left strap 2502 may ramify into and/or join with other straps, such as upper lateral straps 2511 and lower lateral straps 2513, which are directly connected to outer edges of front and/or side components (not pictured in the present figure) of bra 2500 (or another supporting garment incorporating aspects of bra 2500).

With this configuration of strap(s), donned over the shoulders 806 of woman's body 101, the majority of her back 2615 is left bare, and may remain exposed when additional garments, such as a backless dress, or any other backless garment, are layered over bra or garment 2500.

Figure 27:
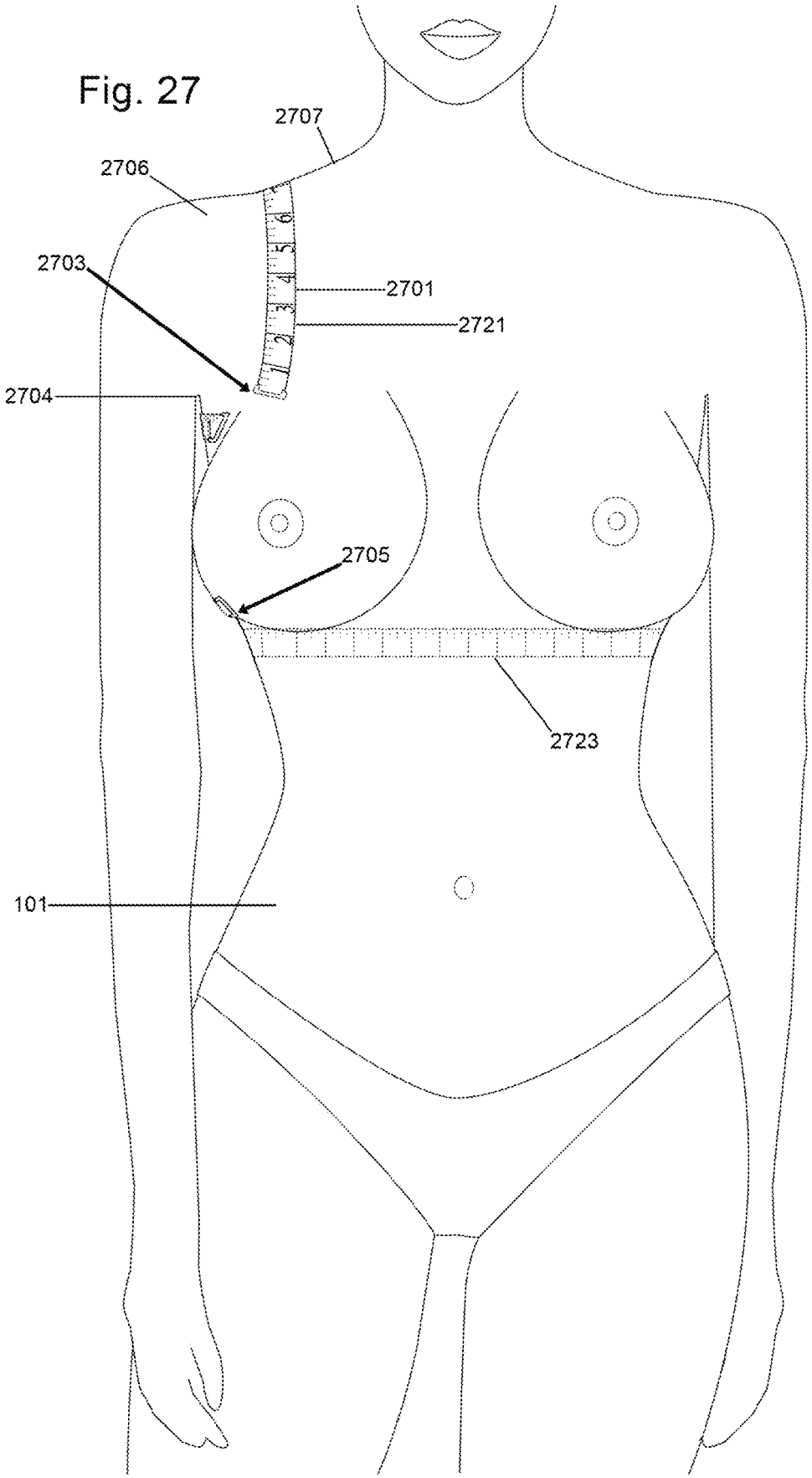
FIG. 27 is a front view of the same example woman's body discussed above, illustrating areas of the body and dimensions of the body which may be measured and correspond to the dimensions of the example bra with minimized back components, discussed above, in FIGS. 25 and 26, in accordance with some embodiments of the present invention.

FIG. 27 is a front view of the same example woman's body 101 discussed above, illustrating areas of the body and dimensions of the body which may be measured and correspond to the dimensions of the example bra 2500, with minimized back components, discussed above, in FIGS. 25 and 26, in accordance with aspects of the present invention. As with other dimensions set forth above, the dimensions set forth in the present figure may be used to match or create a sizing system for fitting a bra or other garment (such as bra 2500) to a woman's body, supporting part of the woman's body (such as the breasts) and/or enhancing the appearance of the woman's body (such as woman's body 101).

Figure 28:
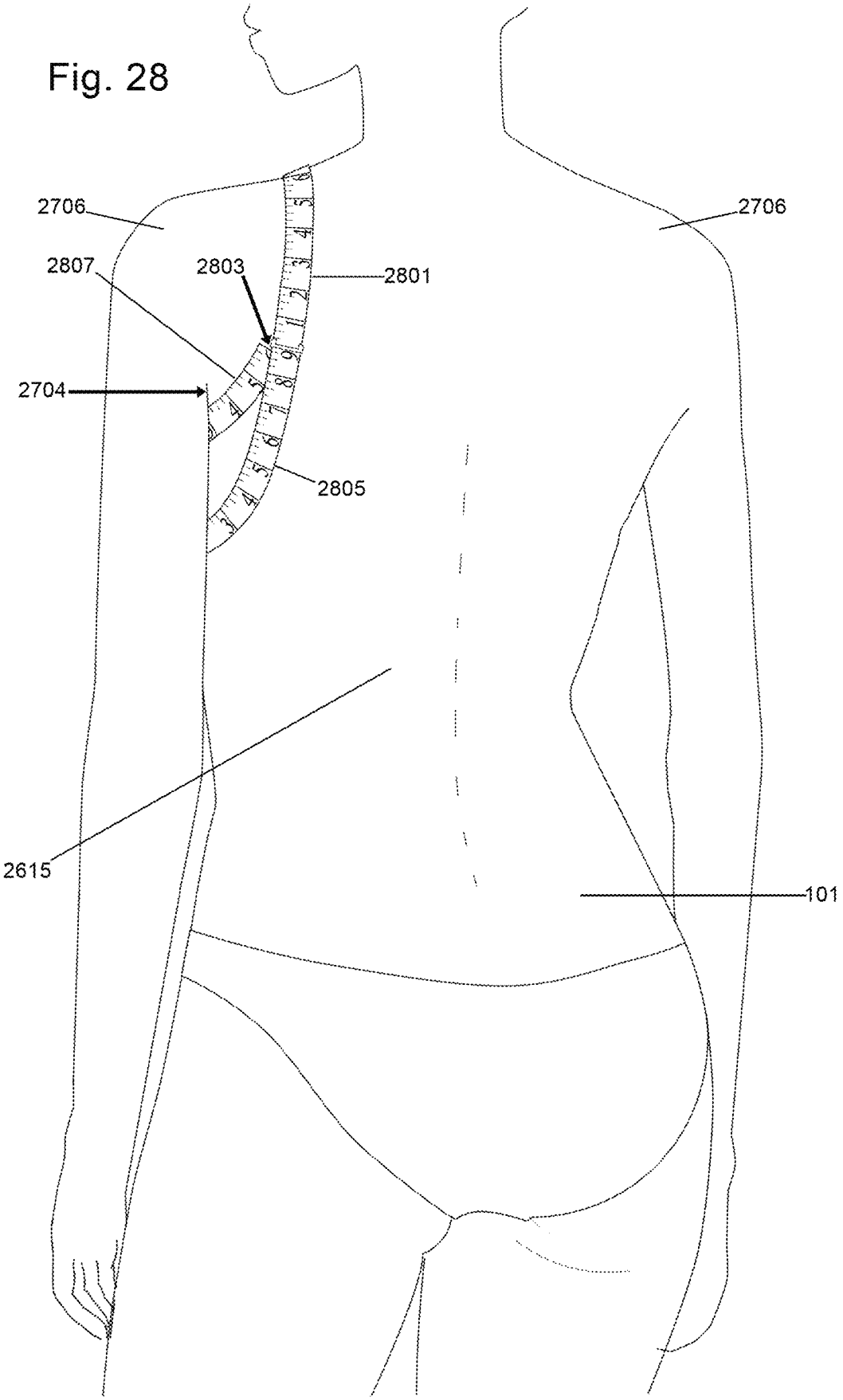
FIG. 28 is a rear perspective view of the same example woman's body discussed above, illustrating areas of the body and dimensions of the body corresponding to the dimensions of the example bra with minimized back components, discussed above, in FIGS. 25 and 26, in accordance with some embodiments of the present invention.

In one aspect of the present invention, a measurement and fitting system may include an example measurement of a neck strap length 2701, which may be measured, at least in part, along the front, chest surface of a standing woman's body, such as woman's body 101, and which may in some embodiments, as discussed further below, be summed with at least one additional neck strap and/or over-the-shoulder length measurement (as pictured in FIG. 28, below). In any event, neck strap length 2701 may begin from a point 2703, at the top of the breasts of woman's body 101, and/or a position lateral to, and at the same vertical level as, the armpit 2704 of woman's body 101, and wrap around her back (not shown in the present figure) to end at a point 2705, at a point at the side and base of the her breast (at or about the inframammary fold), on the same side of woman's body 101. Thus, in some embodiments, there may be two such neck strap lengths, corresponding with both the right and left sides of a woman's body, a second neck strap length (not pictured, but on the left-hand side of woman's body 101) being a mirror image of the first example neck strap length partially pictured as 2701 (shown at the right-hand side of woman's body 101).

In some embodiments, neck strap length 2701 may be the shortest length between point 2703 and point 2705. In some embodiments, neck strap length 2701 may be measured as the shortest length between point 2703 and point 2705 conforming to the surface of the woman's body 101 (i.e., a line hugs or traces the outer surface of the woman's body 101 at all points), going over the top of shoulder 2706, preferably at the junction of the shoulder 2706 and trapezius muscle 2707, and over the back of woman's body 101. In other embodiments, neck strap length 2701 may be any suitable length to provide support to the lower front of bra or other supporting and enhancing garment 2500 with lower lateral strap 2513 and/or neck strap 2501, while easing comfort and enhancing the appearance of woman's body 101.

In some embodiments, however, neck strap length 2701 may comprise, or be comprised within, one or more other lengths corresponding with other parts of a woman's body, which do not necessarily sum to a shortest possible length between points 2703 and 2705. In this way, a bra or other garment based on the sizing systems set forth in the present application may create any number of known or new strap lines and decolletage.

For example, neck strap length 2701 may comprise a neck-wrapping measurement (shown as 2721) which includes only the top length shown on the front side of woman's body 101 in FIG. 27, as one such other length measurement. It should be noted that neck-wrapping measurement 2721 traces the same position on the front of woman's body 101 as right strap 2501 of FIG. 25, and measures an appropriate fit for that strap. As another example, discussed below, neck strap length 2701 may comprise a rear neck strap length 2801, shown in FIG. 28, leading from length 2721, over shoulder 2706 and back 2615 of woman's body 101, until an attachment point 2803 to a descending lateral strap measurement, 2805, which is in the same position as lateral strap 2513, shown in FIGS. 25 and 26. (It should be noted that only the left-hand side of such measurements are shown in FIG. 28, while only the right-hand side of such measurements are shown in FIG. 27, for ease of presentation in the perspective of the figures, but it should be understood that a corresponding, bilaterally symmetrical set of measurements, for the other side of the body may be taken. The same reference numbers are intended to reference either the measurement shown, and its bilaterally symmetrical counterpart on the other side of body 101, whether or not that counterpart is pictured. In some embodiments, neck strap length 2701 may comprise both neck-wrapping measurement 2721 and descending lateral strap measurement 2805. Such an embodiment is used to create the example table, coding and other aspects of an example new sizing system depicted in FIG. 29, below.

As another example, neck strap length 2701 may also, or alternatively, lead to or include a top lateral strap measurement 2807, which traces the same line on the back of woman's body 101 as strap 2511, shown in FIGS. 25 and 26, above—namely, a line descending from shoulder 2706, under the armpit 2704 and attaching to the top-right outer edge of the right breast of woman's body 101. In the embodiment used to create the example table, coding and other aspects of an example new sizing system depicted in FIG. 29, below, neck strap length 2701 leads to, but does not include, top lateral strap measurement 2807, which is measured and coded separately.

In some embodiments, other measurements corresponding with length, area, volume, or other measurements of body parts corresponding with components of bra or garment 2500 may be combined to formulate a measurement and garment fitting and sizing system. Those other measurements may be known bra and garment fitting and sizing measurements, or new measurements. For example, a known cup size measurement, which may correspond with the volume and/or shape of a woman's breast may be used in conjunction with the measurements set forth above. Such a measurement is incorporated into the example table, coding and other aspects of an example new sizing system depicted in FIG. 29, below. As another conventional measurement, a conventional "band" measurement 2723 (shown in FIG. 27), of the circumference of the chest may be taken at or just below the bottom of the breasts of woman's body 101 (e.g., at the inframammary fold) and a corresponding halter-securing band (not pictured) may be added at that location to bra (or garment) 2500. In contrast, a new form of body measurement related to known or previously undescribed body parts or sections may be used, and combined with other measurements set forth in this application, in a bra or garment fitting and/or sizing system, as discussed in greater detail elsewhere in this application.

FIG. 29 depicts a table 2900, coding and other aspects of an example new sizing system corresponding to bras and other supporting garments with minimized back components, such as bra or garment 2500, in accordance with aspects of the present invention. Table 2900 depicts seven columns 2901, corresponding to the sum of a neck strap length 2701, which may be the sum of a neck strap length measurement 2721, a rear neck strap length 2801, and a descending lateral strap measurement 2805, and six rows 2903, each corresponding to a range of measurements of a top lateral strap measurement 2807, all of which measurements, and ranges of measurements, as discussed above, may be taken on various women's bodies.

In addition, a measurement of the volume of such women's breasts (or a measurement corresponding to the volume of a woman's breasts (e.g., a breast height and maximum width), or a cup size (meaning some measurement of the interior volume of a bra cup, configured to receive conform to, and hold a woman's breast, meaning that the cup size corresponds with that measurement), may also be taken, and combined with the measurements set forth immediately above, to create a particular bra or other garment size coding that best corresponds to a particular fitment to a particular woman's body. For example, by combining any cup size (known or newly invented as set forth in this application) with a set of two other values, each of which is set forth in either column headings 2905 or row headings 2907, a unique combination and coding can be created, corresponding to a good fit for a particular woman's body. For example, a woman with a 19-inch neck strap length or band length (coded "NL 19"), a top lateral strap measurement of 6.5 inches (coded "TL6.5"), and a small ("A") cup size dimension measurement, may select the overall size code of "6.5/19A." However, because each band or strap length and the cup size of any bra in accordance with the present invention may be varied in some embodiments (any other dimension corresponding with strap or band lengths may be adjustable, with length adjustment hardware in some embodiments of the present invention), a sizing system implementing overlapping ranges may be used in some sizing systems according to the present invention. If so, preferably, a middle, median or other average length of a band may be selected to match (or most nearly match, among a set of options) a band measurement of a woman's body, and to fit that particular woman's body, in some embodiments of the sizing system inventions set forth in the present invention. Of course, table 2900 relays only part of the sizing system, corresponding to a cup size of "A," for simplicity, and additional combinations of neck strap length measurements (which may be any component or combination of neck strap lengths set forth in this application) and lateral strap length measurements and cup size measurements (such as B, C, DD, etc.) may combined to create similar sizes best fitting a particular woman's body, and coding therefor, in some embodiments.

As explained above, in reference to FIG. 12, bra cups, such as right breast-accepting bra cup 2517 and left breast-accepting bra cup 2518, may be assembled together with band or strap sizes created according to sizing systems of the present invention. In some embodiments, such cup sizes correspond to, and are created in reference to, a set of cup sizes, which may be true cup sizes, meaning that cups created and designated according to a particular cup size within the set of cup sizes of the measurement system do not vary in size when created, matched and assembled in conjunction with different band lengths or other such measurements of other components aside from cup measurements. In some embodiments, and again, as explained previously in reference to FIG. 12, above, such cup sizes may be in increments that do not match conventional bra cup sizes or nomenclature. For example, in some sizing systems in accordance with the present invention, and as discussed above, as many as 10 different cup sizes and increments may be provided and used, which do not correspond with the increments of conventional cup sizes, in some embodiments. In some embodiments, the cup sizes provided are fixed cup sizes, meaning that the size of the dimensions of a woman's breast measured (e.g., volume or height of her breast(s)) and corresponding (e.g., matching or fitting) cups matched and provided for that woman (e.g., from subset(s) of a set of such cups or bras) do not vary with different sizes of band length dimensions, band lengths or other band sizes, such as those set forth in the present figure. This fixed size for dimensions and cups (e.g., volume held by a cup and corresponding with a particular cup size) may also be referred to as a "true cup size" or "true cup sizing." In some such embodiments, different coding for cup sizes, and bra sizes, may be used to label and select bras and sets of bras, and to provide bras corresponding with, matching and fitting a woman's body. For example, in some embodiments, different cup sizes and bra sizes, and increments (other than conventional cup sizes and sizing increments) of breast size dimensions and corresponding (e.g., matching or fitting) cups may be provided, and used to identify subsets (of cup sets) corresponding with each increment of such increments of breast size dimensions and corresponding cups. Such different cup size and bra size increments may be labeled with unconventional codes, each code corresponding with a different such bra size increment, preventing confusion with conventional cup size increments and coding. For example, in some embodiments, such different bra size increments may be coded, and ranked as follows: "Cup #1, Cup #2, Cup #3," etc., with cup sizes and dimensions that correspond to each code increasing as the codes progress from left to right. As another example, in some embodiments, such different bra size increments may be coded, and ranked as follows: "Cup Size #1, Cup Size #2, Cup Size #3," etc., with cup sizes and dimensions corresponding to each code increasing from left to right. In some such embodiments, multiple cup sizes may be covered by a single such code. In some such embodiments, two cup sizes may be covered by a single such code. In some such embodiments, such two cup sizes may be conventional cup sizes. For example, sizes A and B are combined to create Cup #1, in some embodiments.

Because each strap provided to match a neck strap length 2801, a lateral strap measurement 2805 and a top lateral strap measurement 2807 (as with any other dimension corresponding with strap or band lengths discussed in this application) may be adjustable, with length adjustment hardware in some embodiments of the present invention, in some embodiments, a sizing system implementing covered ranges of such lengths may, instead, be used. If so, preferably, a middle, median or other average length of a corresponding band's total range of lengths, may be selected to fit a particular woman's body measurements as set forth in this application, in some embodiments of the sizing system inventions set forth in the present invention related to adjustable bra bands and straps. In some embodiments, the total range of lengths covered by a sizing system for adjustable and other band lengths or strap lengths in accordance with the present invention may be different than that set forth in the figures, and different from any known band and strap sizing ranges and increments. For example, in some embodiments, such a total range of lengths covered by a sizing system may cover a range in inches, at a plurality of length increments (e.g., 10 increments, which may be referred to as "Strap Length 1," "Strap Length 2," etc.) As discussed above, because any of the straps or bands of bras and other garments set forth in the present application may be individually adjusted, an infinite array of alternate, more form-fitting sizes may be selected and created with any bra or garment sized in accordance with aspects of the system set forth in the present figure. For example, the same woman may select a size down or up, or more, when measured as fitting a particular set of dimensions set forth in the sizing system.

Any of the aspects for a sizing system set forth in FIG. 29 related to cups, bands or straps may be applied to, and included in, any other sizing system set forth in reference to the present invention. For example, any use of conventional cup sizes in any sizing system set forth in this application may be replaced by the different cup size and bra size increments set forth in reference to FIG. 29.

Figure 30:
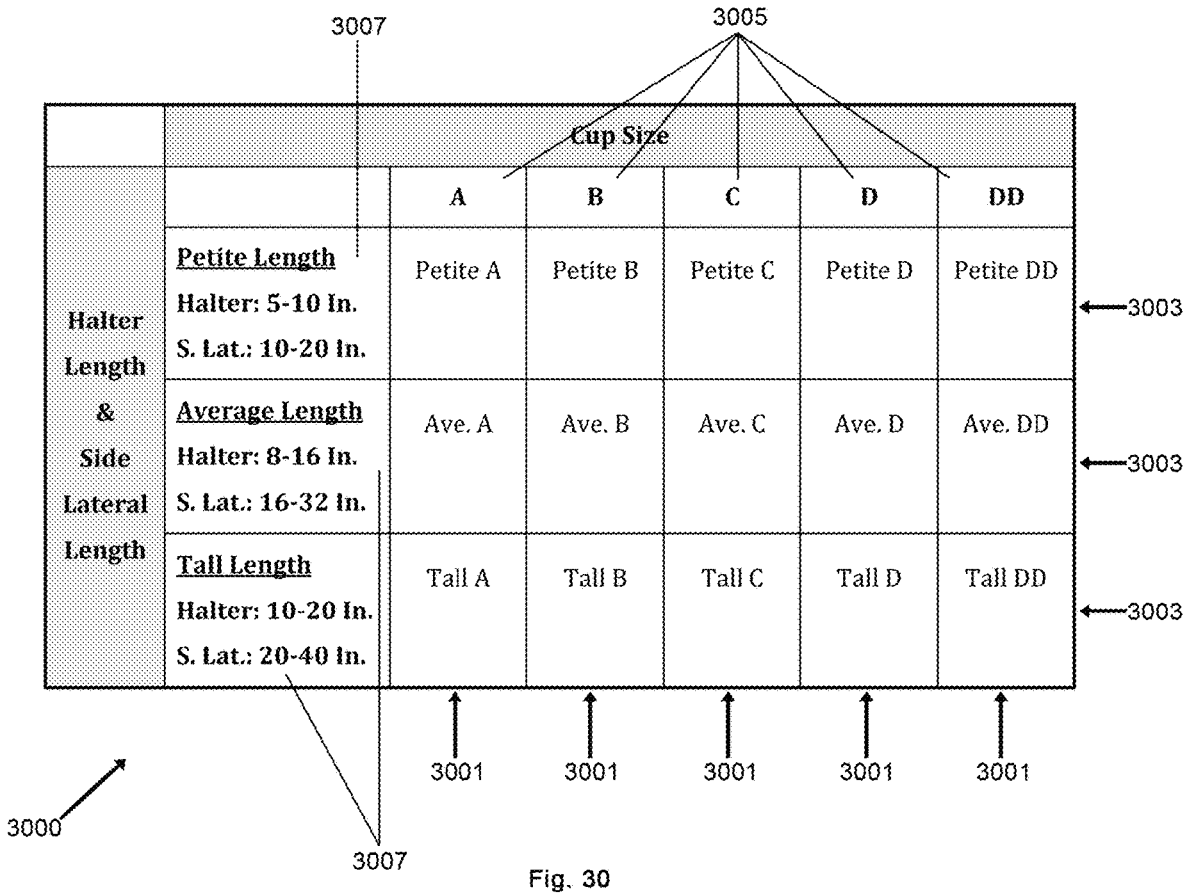
FIG. 30 depicts a table, coding and other aspects of an example new sizing system corresponding with backless bras and garments, according to some embodiments of the present invention.

FIG. 30 depicts a table 3000, coding and other aspects of an example new sizing system corresponding to backless bras and other supporting garments, according to some embodiments of the present invention. Table 3000 depicts five (5) columns 3001, corresponding to example bra or other supporting garment cup sizes, and three (3) rows 3003, corresponding to example bra or other supporting garment strap lengths—namely, halter lengths and side lateral lengths, as discussed above in this application. More specifically, in some embodiments set forth in the present figure, a range of such bra or other supporting garment strap lengths is provided, because, as discussed above, in some embodiments, some straps or any strap may be adjusted to infinite degrees within a range of possible lengths, in other words, between a maximum length and a minimum length.

For example, in some embodiments a neck strap, such as example neck strap 107, of a bra or garment sized in accordance with a sizing system set forth herein may correspond in length to any length within the range indicated for halter lengths set forth in FIG. 30, for a particular indicated size. In some embodiments, such a neck strap may be adjustable in length, such that its length may be adjusted by a user to match any measurement within that range. In some specific embodiments, such a neck strap may only be adjustable within that range, while, in other embodiments, such a neck strap may be adjustable within the range, but also beyond that range, for a particular indicated size. Similarly, in some embodiments, a side lateral suspending strap, such as either of side lateral suspending straps 119, discussed above, of a bra or garment sized in accordance with a sizing system set forth herein may correspond in length with any length within the range indicated for side lateral lengths set forth in FIG. 30, for a particular indicated size. As with the embodiments for neck straps discussed above, in some embodiments, such a side lateral suspending strap may be adjustable in length, such that its length may be adjusted by a user to match any measurement within that range. Also as with the embodiments for neck straps discussed above, in some specific embodiments, such a side lateral suspending strap may only be adjustable within that range, while, in other embodiments, such a neck strap may be adjustable within the range, but also beyond that range, for a particular indicated size. Possible devices by which the neck strap and side lateral strap may be so adjusted within a range indicated for a particular size are discussed above in this application. As so discussed, in some embodiments, the lengths of a strap may be adjusted by sliders and rings in conjunction with looped bands of fabric, or by any other mechanism for adjusting the lengths of straps or bands of material known in the art.

By selecting any one value shown in both the column headings 3005 and one value for row headings, such as the examples shown as 3007, a wide variety of combinations can be created, corresponding with a good fit for a woman's body. For example, a woman with an average cup size of C, and an "Average" neck strap length, may select the size "Ave. C." Because each the neck strap and the side lateral straps may be individually adjusted, an array of alternate, more form-fitting sizes may be further selected and created using a bra or other supporting garment selected from that size. In other words, a user may adjust such a bra or other supporting garment to select a more specific, adjusted size, within the length ranges set forth in a particular size set forth in FIG. 30. For example, a user who has selected size "Ave. C" may manually adjust a neck strap and side lateral supporting strap, using any of the hardware discussed above for adjusting strap and band lengths, to select and match a more specific size, such as a halter length of 11, and a side lateral length of 29.

In this way, women with widely varying proportions, within a range of sizes, can each select and create a specific size best suited to her particular physique.

As explained above, in reference to FIG. 12, and elsewhere in this application, bra cups may be assembled together with band or strap sizes created according to sizing systems of the present invention. In some embodiments, such cup sizes correspond to, and be created in reference to, a set of cup sizes, which may be true cup sizes, meaning that cups created and designated according to a particular cup size within the set of cup sizes of the measurement system do not vary in size when created, matched and assembled in conjunction with different band lengths or other such measurements of other components aside from cup measurements. In some embodiments, and again, as explained previously in reference to FIG. 12, above, such cup sizes may be in increments that do not match conventional bra cup sizes. For example, in some sizing systems in accordance with the present invention, and as discussed above, as many as 10 different cup sizes and increments may be provided and used, which do not correspond with the increments of conventional cup sizes, in some embodiments. In some embodiments, the cup sizes provided are fixed cup sizes, meaning that the size of the dimensions of a woman's breast measured (e.g., volume or height of her breast(s)) and corresponding (e.g., matching or fitting) cups matched and provided for that woman (e.g., from subset(s) of a set of such cups or bras) do not vary with different sizes of band length dimensions, band lengths or other band sizes, such as those set forth in the present figure. This fixed size for dimensions and cups (e.g., volume held by a cup and corresponding with a particular cup size) may also be referred to as a "true cup size" or "true cup sizing." In some such embodiments, different coding for cup sizes, and bra sizes, may be used to label and select bras and sets of bras, and to provide bras corresponding to, matching and fitting a woman's body. For example, in some embodiments, different cup sizes and bra sizes, and increments (other than conventional cup sizes and sizing increments) of breast size dimensions and corresponding (e.g., matching or fitting) cups may be provided, and used to identify subsets (of cup sets) corresponding with each increment of such increments of breast size dimensions and corresponding cups. Such different cup size and bra size increments may be labeled with unconventional codes, each code corresponding with a different such bra size increment, preventing confusion with conventional cup size increments and coding. For example, in some embodiments, such different bra size increments may be coded, and ranked as follows: "Cup #1, Cup #2, Cup #3," etc., with cup sizes and dimensions that correspond to each code increasing as the codes progress from left to right. As another example, in some embodiments, such different bra size increments may be coded, and ranked as follows: "Cup Size #1, Cup Size #2, Cup Size #3," etc., with cup sizes and dimensions corresponding to each code increasing from left to right. In some such embodiments, multiple cup sizes may be covered by a single such code. In some such embodiments, two cup sizes may be covered by a single such code. In some such embodiments, such two cup sizes may be conventional cup sizes. For example, sizes A and B are combined to create Cup #1, in some embodiments.

Because, in some embodiments, each strap provided to match a halter length and a side lateral length measurement (as with any other dimension corresponding with strap or band lengths discussed in this application) is adjustable, with length adjustment hardware in some embodiments of the present invention, in some embodiments, a sizing system implementing covered ranges of such lengths may, instead, be used. If so, preferably, a middle, median or other average length of a corresponding band's total range of lengths, may be selected to fit a particular woman's body measurements as set forth in this application, in some embodiments of the sizing system inventions set forth in the present invention related to adjustable bra bands and straps. In some embodiments, the total range of lengths covered by a sizing system for adjustable and other strap lengths in accordance with the present invention may be different than that set forth in FIG. 30, and different from any known band and strap sizing ranges and increments. For example, in some embodiments, such a total range of lengths covered by a sizing system may cover a range in inches, at a plurality of length increments (e.g., 10 increments, which may be referred to as "Strap Length 1," "Strap Length 2," etc.) As discussed above, because any of the straps or bands of bras and other garments set forth in the present application may be individually adjusted, an infinite array of alternate, more form-fitting sizes may be selected and created with any bra or garment sized in accordance with aspects of the system set forth in the present figure. For example, the same woman may select a size down or up, or more, when measured as fitting a particular set of dimensions set forth in the sizing system.

Any of the aspects for a sizing system set forth in FIG. 29 related to cups, bands or straps may be applied to, and included in, any other sizing system set forth in reference to the present invention. For example, any use of conventional cup sizes in any sizing system set forth in this application may be replaced by the different cup size and bra size increments set forth in reference to FIG. 29.

Figure 31:
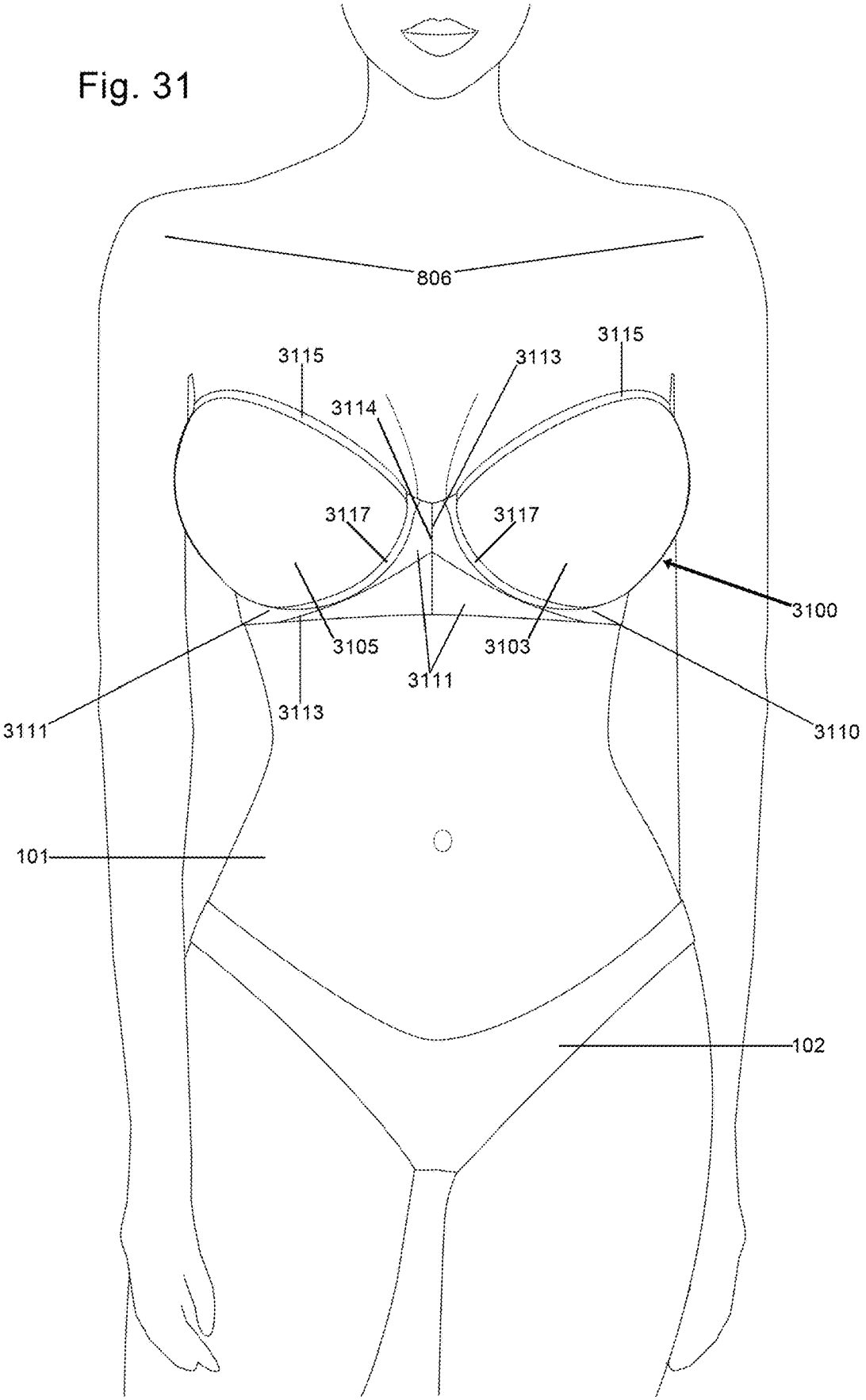
FIG. 31 is a front view of an example strapless bra, with a unique configuration of components, multiple back bands, and a wrap-around side piece, and other new aspects, fitted to the same woman's body of figures set forth above, in accordance with some embodiments of the present invention.

FIG. 31 is a front view of an example strapless bra 3100, with a unique configuration of components, multiple back bands, and a wrap-around side piece, and other new aspects, fitted to the same woman's body, 101, of figures set forth above, in accordance with some embodiments of the present invention. As with other bras and garments set forth in the present application, strapless bra 3100 may be worn alone, or with other garments, such as example separate bikini bottom 102, or over and/or under blouses, dresses and other tops or garments (not pictured), in some embodiments. In some embodiments, and also as with other bras and garments set forth in the present application, strapless bra 3100 may be integrated with such tops or garments, forming a part of them. According to some embodiments, strapless bra 3100, as with any other bras and garments set forth in the present application, may be attached to such tops or garments. As also mentioned above with respect to other bras or garments set forth in the present application, any aspect of strapless bra 3100 may be integrated with any such articles of clothing, in some embodiments. In some such embodiments, bra 3100, and such articles of clothing, cover, support, adorn or otherwise enhance a woman's top. Some examples of such articles of clothing include, but are not limited to, a bustier, blouse, corset, dress, camisole, tank top, crop-top, bandeau, tube-top, vest, sweater, jacket, shirt, tunic, robe, cat suit, body suit, leotard, crotch top or shirt body suit, bikini swimsuit top, one-piece swimsuit, among many possibilities. In some embodiments, strapless bra 3100 may be integrated with other strapless articles of clothing, such as strapless dresses and tops, such as strapless bustiers, strapless corsets, tube tops, and bandeau swimsuit tops, to name just a few possibilities. In some embodiments, a strapless dress or top may be worn directly over strapless bra 3100, covering just strapless bra 3100 from view, or nearly so (e.g., covering 1-5% more, or 1-5% less, of the woman's body laterally and vertically, than strapless bra 3100). In some embodiments, such a strapless dress or top may be selected with a size just concealing strapless bra 3100, and leaving the remainder of the woman's skin bare, giving the impression that the woman may not be wearing strapless bra 3100. In some embodiments, bra 3100 may include any other aspect for bras set forth in this application. For example, in some embodiments, bra 3100 may include attachment points (not pictured) for attaching other aspects to bra 3100, such as adhesive panels (not pictured), as discussed with reference to bra 2100 of FIG. 21, above.

Strapless bra 3100 may comprise two breast-supporting cup sections, including left breast-supporting cup section 3103 and right breast-supporting cup section 3105, joined together by: A) two rear bands (not pictured in the present figure, but visible as upper back band 3201 and lower back band 3202, in FIG. 32), which may be drawn around a woman's back, below her shoulders 806, and B) a main body 3110, attached to cup sections 3103 and 3105 and rear back bands 3201 and 3202. In some embodiments, main body 3110 (and any other part of bra 3100) may be constructed from constituent material panels, such as example constituent panels 3111, which may be attached together. In some embodiments, such constituent panels 3111 are stitched together, along seam lines, such as those shown as example seam lines 3113. Both left breast-supporting cup section 3103 and right breast-supporting cup section 3105 may be joined to at least one peripheral strip of material (a.k.a. a "periphery"), such as example upper peripheries 3115, and example lower peripheries 3117, each of which may partially surround, support and protect each cup, in some embodiments. In some embodiments, a reversible connector may join left breast-supporting cup section 3103 and right breast-supporting cup section 3105, rather than a sewn seam, at seam line 3114. For example, any of the variable, reversible connectors set forth above, for joining and separating cups and other parts of bras, in the present application, may be used to join and separate abutting constituent panels 3111.

Figure 32:
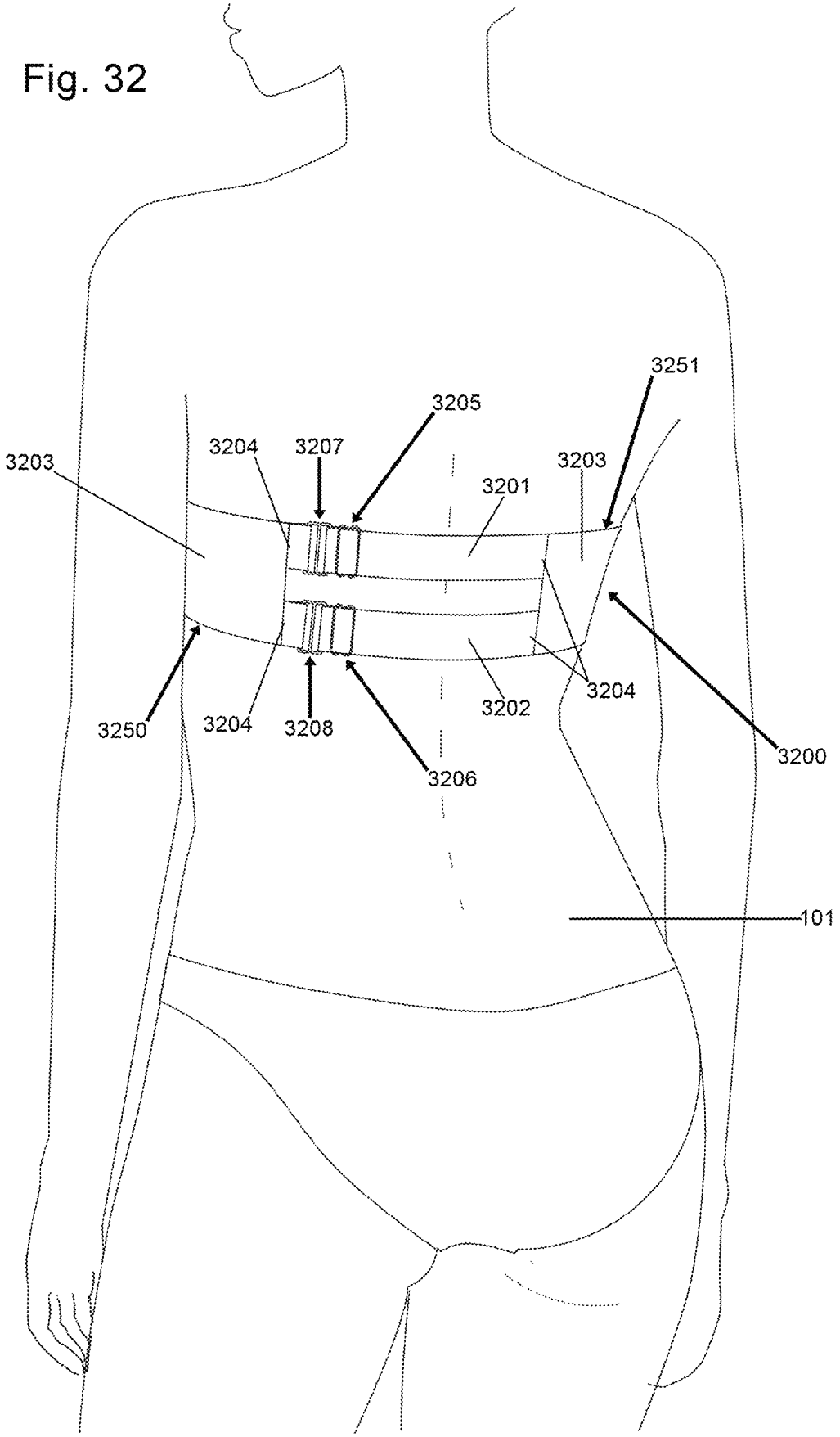
FIG. 32 is a rear perspective view of the same example strapless bra set forth in FIG. 31, above, fitted to the same woman's body, with a unique configuration of components, multiple back bands, a wrap-around side piece, and other new aspects, in accordance with some embodiments of the present invention.

Although strapless bra 3100, as with some other bras disclosed in the present application, is provided in a strapless form, as shown in FIG. 32, it should be understood (also as with other bras in this application) that strapless bra 3100 may be provided with neck, shoulder or other straps, which may be temporary fastened to bra 3100, at various possible positions, in some embodiments. Such strap(s) may be reversibly attached and separated in some embodiments, at one or more connection points with left breast-supporting cup section 3103 and/or right breast-supporting cup section 3105 (e.g., at peripheries 3115 and 3117), and/or at any other point on or about the front or rear of bra 3100. Each of left breast-supporting cup section 3103 and/or right breast-supporting cup section 3105 may have a curved lower support 3119, complementarily shaped and configured to securely hook and hold the woman's breasts and the infra-mammary fold of woman's body 101, from underneath. In some embodiments, curved lower support 3119 may be an underwire. In other embodiments curved lower support 3119 may be a strap. In still other embodiments, curved lower support 3119 may be any form of support suitable for supporting or enhancing the appearance of a woman's breasts.

FIG. 32 is a rear perspective view of the same example strapless bra, now 3200, set forth in FIG. 31, fitted to the same example woman's body, 101, with a unique configuration of components, including multiple adjustable back bands, such as the examples shown as upper back band 3201 and lower back band 3202, and two body-conforming wrap-around side pieces 3203, and other new aspects, in accordance with some embodiments of the present invention. Each of upper back band 3201 and lower back band 3202 has a preferably adjustable length and is attached on each end, ends 3204, to one of wrap-around side piece 3203 of bra 3200, holding bra 3200 in place on woman's body 101.

As with any other bands, straps or parts thereof set forth anywhere in this application, in some embodiments, upper back band 3201 and lower back band 3202 are each adjustable in length, in some embodiments. In some such embodiments, upper back band 3201 and lower back band 3202 each comprise length adjustment hardware, thus permitting a user to alter the length of either or both of upper back band 3201 and lower back band 3202 to better conform to her body, holding strapless bra 3200 in place. In some embodiments, a user may so alter the length either or both of upper back band 3201 and lower back band 3202 to better support her breasts. In some embodiments, a user may so alter the length either or both of upper back band 3201 and lower back band 3202 to better present her breasts. For example, and only as one example among virtually unlimited possibilities for length adjustment hardware, upper back band 3201 and lower back band 3202 may each comprise slidable, band length-adjusting hardware (a.k.a., a "slider"), such as the examples provided as upper slider 3205 and lower slider 3206, and a turnstile, such as the double-ring shaped turnstiles examples provided as upper double ring 3207 and lower double ring 3208. In some embodiments, other forms of turnstiles, sliders, or other forms of length or dimension adjustment hardware may be used. For example, in some embodiments, a single ring, rather than a double ring, may be used, in place of double-ring 3207. Similarly, in some embodiments, a single ring, rather than a double ring, may be used, in place of double-ring 3208. In some embodiments, a single ring, rather than a double ring, may be used, in place of double-ring 3207 and a single ring, rather than a double ring, may be used, in place of double-ring 3208. In any event, together, such a slider and turnstile combination as those pictured for each upper back band 3201 and lower back band 3202 permits a user to independently make alterations to the length of each back band of strapless bra 3200—namely, upper back band 3201 and lower back band 3202—to provide an infinitely adjustable fit at multiple positions of bra 3200. To facilitate such alterations, upper back band 3201 and lower back band 3202 may each loop around a turnstile, such as upper double ring 3207 and lower double ring 3208, as pictured, providing a user-variable length of doubled fabric. In some embodiments, as mentioned above, the fitment techniques described in this application, and other aspects of the invention, may be applied to other bras or other supporting garments incorporating aspects of the invention, fitting such other bras or such other garments to a particular body on which it is worn, such as woman's body 101.

Accordingly, in some embodiments, ranges of different lengths, and combination of lengths, of upper back band 3201 and lower back band 3202 may be created by a user of strapless bra 3200. Nonetheless, and in accordance with additional embodiments of the invention set forth below, those ranges may be limited, and differently limited, for each of the different back bands, such as upper back band 3201 and lower back band 3202, in accordance with bra sizing systems of the present invention. Such sizing systems, and examples thereof, are set forth in greater detail above. For example, some such sizing systems are set forth above, in reference to FIGS. 10-12. As explained in greater detail elsewhere in this application, a lower back band, such as 3202, may correspond with, and be created in reference to, a lower wrap length 1003 (or part thereof), while an upper back band, such as 3201, may correspond with, and be created in reference to, an upper torso hemi length 1007, in some embodiments. In some embodiments, lower back band 3202 and parts of wrap-around side pieces 3203 and other parts of strapless bra 3200 to which lower back band 3202 is attached may correspond with, and be created in reference to, lower wrap length 1003. In some embodiments, upper back band 3201 and parts of wrap-around side pieces 3203 to which upper back band 3201 is attached, and other parts of strapless bra 3200 to which lower back band 3202 is attached may correspond with, and be created in reference to, upper torso hemi length 1007. For example, the entire circumference of a lower edge 3250 of bra 3200 may correspond with, and be created in reference to, lower wrap length 1003, in some embodiments. In other embodiments, the entire circumference of an upper edge 3251 of bra 3200 may correspond with, and be created in reference to, upper torso hemi length 1007.

As explained above, in reference to FIG. 12, bra cups, such as left breast-supporting cup section 3103 and right breast-supporting cup section 3105, may be assembled together with band sizes created according to sizing systems of the present invention. In some embodiments, such cup sizes correspond to, and are created in reference to, a set of cup sizes, which may be true cup sizes, meaning that cups created and designated according to a particular cup size within the set of cup sizes of the measurement system do not vary in size when created, matched and assembled in conjunction with different band lengths or other such measurements of other components aside from cup measurements. In some embodiments, and again, as explained previously in reference to FIG. 12, above, such cup sizes may be in increments that do not match conventional bra cup sizes. For example, in some sizing systems in accordance with the present invention, and as discussed above, as many as 10 different cup sizes and increments may be provided and used, which do not correspond with the increments of conventional cup sizes, in some embodiments. In some embodiments, the cup sizes provided are fixed cup sizes, meaning that the size of the dimensions of a woman's breast measured (e.g., volume or height of her breast(s)) and corresponding (e.g., matching or fitting) cups matched and provided for that woman (e.g., from subset(s) of a set of such cups or bras) do not vary with different sizes of band length dimensions, band lengths or other band sizes, such as those set forth in the present figure. This fixed size for dimensions and cups (e.g., volume held by a cup and corresponding with a particular cup size) may also be referred to as a "true cup size" or "true cup sizing." In some such embodiments, different coding for cup sizes, and bra sizes, may be used to label and select bras and sets of bras, and to provide bras corresponding to, matching and fitting a woman's body. For example, in some embodiments, different cup sizes and bra sizes, and increments (other than conventional cup sizes and sizing increments) of breast size dimensions and corresponding (e.g., matching or fitting) cups may be provided, and used to identify subsets (of cup sets) corresponding to each increment of such increments of breast size dimensions and corresponding cups. Such different cup size and bra size increments may be labeled with unconventional codes, each code corresponding to a different such bra size increment, preventing confusion with conventional cup size increments and coding. For example, in some embodiments, such different bra size increments may be coded, and ranked as follows: "Cup #1, Cup #2, Cup #3," etc., with cup sizes and dimensions that correspond to each code increasing as the codes progress from left to right. As another example, in some embodiments, such different bra size increments may be coded, and ranked as follows: "Cup Size #1, Cup Size #2, Cup Size #3," etc., with cup sizes and dimensions corresponding to each code increasing from left to right. In some such embodiments, multiple cup sizes may be covered by a single such code. In some such embodiments, two cup sizes may be covered by a single such code. In some such embodiments, such two cup sizes may be conventional cup sizes. For example, sizes A and B are combined to create Cup #1, in some embodiments.

Because each band provided to match a wrap strap length 1003 and an upper torso hemi length 1007 (as with any other dimension corresponding with strap or band lengths discussed in this application) may be adjustable, with length adjustment hardware in some embodiments of the present invention, in some embodiments, a sizing system implementing covered ranges of such lengths may, instead, be used. If so, preferably, a middle, median or other average length of a corresponding band's total range of lengths, may be selected to fit a particular woman's body measurements as set forth in this application, in some embodiments of the sizing system inventions set forth in the present invention related to adjustable bra bands and straps. In some embodiments, the total range of lengths covered by a sizing system for adjustable and other band lengths or strap lengths in accordance with the present invention may be different than that set forth in FIG. 12, and different from any known band and strap sizing ranges and increments. For example, in some embodiments, such a total range of lengths covered by a sizing system may cover a range of between 26 inches and 60 inches, at a plurality of band length increments (e.g., 10 increments, which may be referred to as "Band Length 1," "Band Length 2," etc.) As discussed above, because any of the straps or bands of bras and other garments set forth in the present application may be individually adjusted, an infinite array of alternate, more form-fitting sizes may be selected and created with any bra or garment sized in accordance with aspects of the system set forth in the present figure. For example, the same woman may select a size down or up, or more, when measured as fitting a particular set of dimensions set forth in the sizing system.

Any of the aspects for a sizing system set forth in FIG. 32 related to cups, bands or straps may be applied to, and included in, any other sizing system set forth in reference to the present invention, in some embodiments. For example, any use of conventional cup sizes in any sizing system set forth in this application may be replaced by the different cup size and bra size increments set forth in reference to FIG. 32, in some embodiments.

In some embodiments, body-conforming wrap-around side pieces 3203 are 3-dimensionally shaped to match the contours of the back of woman's body 101. In some such embodiments, materials which hold such a 3-dimensional shape, such as plastics and/or meshes, are used to form wrap-around side pieces 3203. In some embodiments, elastic materials are used to form wrap-around side pieces 3203. In some embodiments, upper back band 3201 and lower back band 3202 include elastic materials. In some embodiments, any part of bra 3200, or any other part of any other bra set forth in the present application, includes a stretch-resistant fabric or other textile material. In some embodiments, any part of bra 3200, or any other part of any other bra set forth in the present application, may include nylon. In some embodiments, any part of bra 3200, or any other part of any other bra set forth in the present application, may include polyester. In some embodiments, any part of bra 3200, or any other part of any other bra set forth in the present application, may include rayon. In some embodiments, any part of bra 3200, or any other part of any other bra set forth in the present application, may include linen. In some embodiments, any part of bra 3200, or any other part of any other bra set forth in the present application, may include flax. In some embodiments, any part of bra 3200, or any other part of any other bra set forth in the present application, may include wool. In some embodiments, any part of bra 3200, or any other part of any other bra set forth in the present application, may include leather. In some embodiments, any part of bra 3200, or any other part of any other bra set forth in the present application, may include silk. In some embodiments, any part of bra 3200, or any other part of any other bra set forth in the present application, may include ramie. In some embodiments, any part of bra 3200, or any other part of any other bra set forth in the present application, may include neoprene. In some embodiments, any part of bra 3200, or any other part of any other bra set forth in the present application, may include or some type of cotton. In some embodiments, any part of bra 3200, or any other part of any other bra set forth in the present application, may include at least one recycled material. In some embodiments, any part of bra 3200, or any other part of any other bra set forth in the present application, may include any suitable material for constructing bras. In some embodiments, any part of bra 3200 may include any combination of such materials, in linked and/or blended textile materials.

Although the example of slider and ending double ring is provided as length-adjustment hardware for upper back band 3201 and lower back band 3202 in the pictured embodiment, it should be understood that any suitable mechanism or combination of mechanisms for altering the length of a band or strap of material may be used, in addition to, or as an alternative to, sliders 3205 and 3206, and double rings 3207 and 3208, in other embodiments. Similarly, although the example of two adjustable-length band strapless bra 3200 is provided, it should be understood that one band (as in the embodiment set forth in FIG. 13, above), or more than two bands, may also be used in some embodiments, in the context of any supporting or enhancing garment implementing some aspects of the invention. Such variations of the invention will be readily apparent to those of ordinary skill in the art, and are within the scope of the invention.

Either or both of upper back band 3201 and lower back band 3202, and any other bands and/or straps set forth in the present application, may comprise any suitable material, or combination of materials, known in the art for forming bra straps and bands. For example, in some embodiments, upper back band 3201 and lower back band 3202 may include any of: cloth, plastic, rubber, or flexible metal structures. In some embodiments, upper back band 3201 and lower back band 3202 may include any combination of such materials set forth above, for bands or other bra materials, in linked and/or blended textile materials.

It should be noted that bra 3100/3200 may include over-the-shoulder straps, such as any of the over-the-shoulder straps provided elsewhere in this application, in some embodiments. For example, such over-the-shoulder straps may be reversibly fastened to the remainder of bra 3100/3200, in some such embodiments. Accordingly, in some embodiments, such straps may include reversible attachment ends, for that purpose, such as the hooks 1803 of FIG. 18. Similarly, any and all parts of bra 3100/3200 pictured and set forth in FIGS. 31 and 32 may comprise attachment points for such reversible attachment ends, such as loops 1807 of FIG. 18, at any location about the surface of bra 3100/3200. For example, in some embodiments sidepiece 3203 may include one or more variable attachment points for attaching the ends of such straps. In some embodiments, upper back band 3201 may include variable attachment points for attaching the ends of such straps, at several positions about the upper edge of upper back band 3201. In some such embodiments, a user may alters the length of either or both of upper back band 3201 and lower back band 3202, and maintain a similar configuration of such straps by selecting different attachment points along the upper edge of upper back band 3201.

It should also be noted that, generally speaking, any part or other aspect of any bra or sizing system or other supporting garment set forth in this application may be combined with any other aspect of any bra or sizing system or other supporting garment set forth in this application. Any such combination is within the scope of the present invention. For example, in some embodiments, any neck strap, such as neck strap 107 of FIG. 1, and any side lateral straps, such as the examples provided above as side lateral suspending straps 119, in FIG. 1, may include location-variable, reversible attachment ends, such as those discussed above, allowing a user to vary their attachment position about the surface of the remainder of any other bra set forth in this application. As another example, in some embodiments, as with embodiments of the sliders of bra 800, upper slider 3205 and lower slider 3206 of bra 3200 may be provided on opposite sides of bra 3200, in some embodiments.

Figure 33:
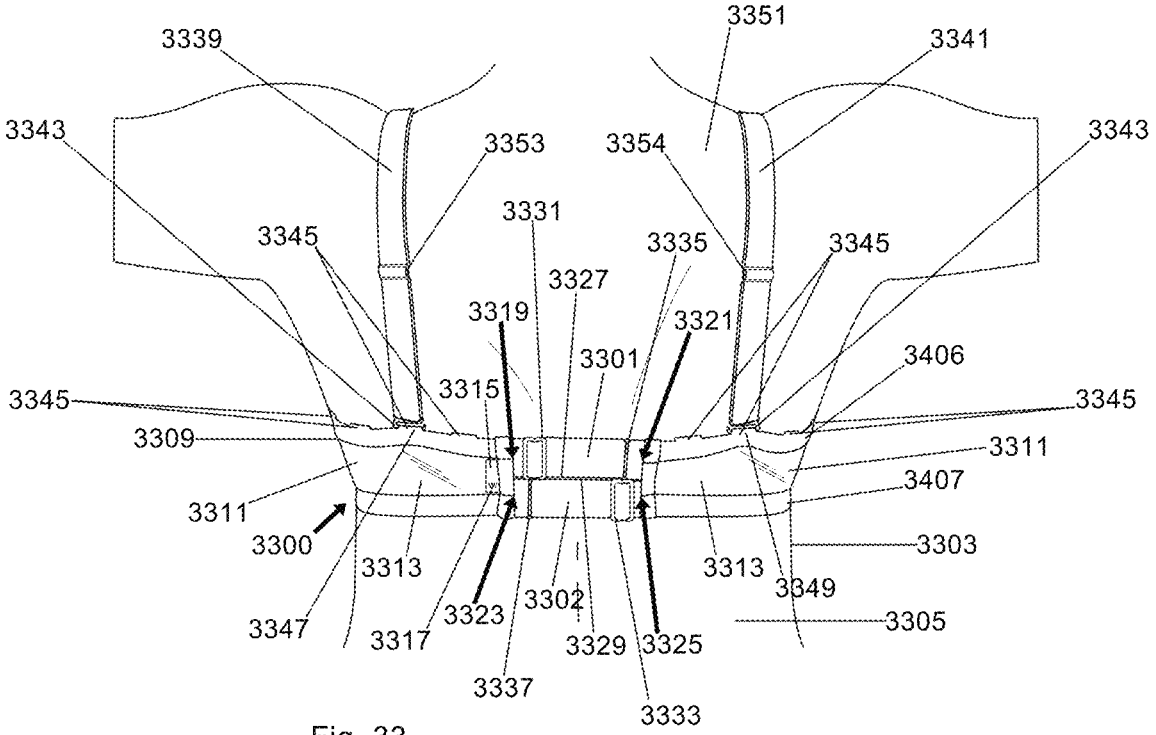
FIG. 33 is a front view of an example bra, with another unique configuration of components, multiple adjustable back bands, and multiple shoulder straps which may be variably attached, detached, and repositioned at attachment points in accordance with some embodiments of the present invention.

FIG. 33 is a back view of an example bra 3300, with another unique configuration of components, in accordance with some embodiments. As with some other bras and supporting garments set forth in the present application, in some embodiments, bra 3300 includes multiple adjustable back bands for securing and fitting bra 3300 to a woman's body, such as the examples shown as upper back band 3301 and lower back band 3302. Thus, in some such embodiments, bra 3300 includes two (2) back bands, at least one of which, in some embodiments, may be configured to wrap completely around (as shown) a user's torso, such as example torso 3303 of example user 3305, a woman, shown wearing bra 3300. However, in other embodiments, either or both of back band 3301 and/or back band 3302 may wrap part-way around such a torso and, in some such embodiments, may be attached to other components which, together with such a back band, wrap completely around such a torso forming a larger, unified back band with multiple components. In some such embodiments, such other components may include another band (such as example lower front band 3407, disposed predominantly on the front of bra 3300) and, when so attached to one such back band, forms a larger, wrap-around band with multiple parts which, together, are configured to wrap completely around such a torso. In some embodiments, at least one of upper back band 3301 and lower back band 3302 are attached to the remainder (a.k.a., a "main body" 3309) of bra 3300. In some such embodiments, such a main body of bra 3300 includes one or more body-conforming wrap-around side pieces, such as example body-conforming wrap-around side pieces 3311. In some embodiments, body-conforming wrap-around side pieces 3311 may be the same as, or similar in nature to, example wrap-around side pieces 3203, discussed above. In some embodiments, body-conforming wrap-around side pieces 3311 may include such another band attached to at least one such back band, or a plurality thereof. For example, as pictured, in some embodiments, there are two (2) such another bands, such as example upper front band 3406 and lower front band 3407, disposed at least partially on or about an upper and lower edge, respectively of the body-conforming wrap-around side pieces 3311 and bra 3300 generally.

In some embodiments, body-conforming wrap-around side pieces 3311 may include one or more central panels 3313. In some such embodiments, central panels 3313 may include a transparent material. In some embodiments, central panels 3313 may include a translucent material. In some embodiments, central panels 3313 may include an opaque material. In some embodiments, central panels 3313 may include an ornamental pattern and/or branding. In some embodiments, central panels 3313 may include a tag or other indicator, attached to and/or disposed on an interior side of central panels 3313, such as example tag 3315. In some such embodiments, such a tag may be visible when viewing the exterior of bra 3300, as shown in the perspective of the figure, because, for example, such a transparent and/or translucent material is included in central panels 3313, as pictured. In some such embodiments, a logo (such as example logo 3317) or other pattern, such as a unique ornamental pattern, may also be so visible, e.g., being located on a surface facing away from the torso, on such a tag or indicator.

As with other embodiments of bras having multiple back bands set forth in the present application, upper back band 3301 may be attached to main body 3309 and/or central panels 3313 at upper attachment positions 3319 and 3321 on main body and/or central panels 3313. In some embodiments, lower back band 3302 may be attached to a main body and/or central panels 3313 at a lower attachment positions 3323 and 3325 on main body and/or central panels 3313. In some such embodiments, either or both of upper attachment positions 3319 and 3321 are higher, vertically, than lower attachment positions 3323 and 3325, on main body and/or central panels 3313. As a result, even when bra 3300 is donned (by simply slipping bra 3300 over the user 3305's head and onto her torso 3303, as pictured), upper back band 3301 and lower back band 3302 are in an over/under configuration, relative to each other. Furthermore, in some embodiments, upper back band 3301 and lower back band 3302 abut each other, or at least substantially abut each other, in some embodiments, with no space between them, in some embodiments. In other words, a lower edge 3327 of upper back band 3301 and an upper edge 3329 of lower back band 3302 are touching, in some embodiments, at least at or about their attachment positions. In some embodiments, lower edge 3327 of upper back band 3301 and an upper edge 3329 of lower back band 3302 are configured to touch each other along the entirety of those edges, when donned as discussed above. However, in some embodiments, lower edge 3327 of upper back band 3301 and upper edge 3329 of lower back band 3302 are only substantially touching, meaning that they are variably in contact, or close to being in contact, along the entirety of those edges, and, in some such embodiments, upper attachment positions 3319 and 3321 are substantially and/or mostly higher, vertically, than lower attachment positions 3323 and 3325, on main body and/or central panels 3313, allowing some gap between those edges, at least at some times when ordinarily worn and positioned as shown. Even in such embodiments, however, such a gap is preferably narrower, measured vertically in the perspective of the figure, than the width (again, measured vertically in the perspective of the figure) of each of either of upper back band 3301 and lower back band 3302. Some similar positionings, and resulting spacings between upper and lower back bands are also set forth with reference to other bras and supporting garments in this application. Similarly, it should be noted that, in some embodiments of any of those other bras and supporting garments set forth in this application, the upper and lower straps may be abutting each other, with no space, or substantially no space, between them, as set forth in the present figure, in some embodiments. In some such embodiments, such a gap is preferably narrower than 2 inches. In some such embodiments, such a gap is preferably narrower than 1.5 inch. In some such embodiments, such a gap is preferably narrower than 1 inch. In some such embodiments, such a gap is preferably narrower than 0.5 inches. In some such embodiments, such a gap is preferably narrower than 0.25 inches. In some such embodiments, such a gap is preferably narrower than 0.125 inches. In some such embodiments, such a gap is preferably narrower than 1 centimeter. In some such embodiments, such a gap is preferably narrower than 5 millimeters. In some embodiments, such a gap is preferably narrower, measured vertically in the perspective of the figure, than the combined width (again, measured vertically in the perspective of the figure) of both of upper back band 3301 and lower back band 3302.

In some embodiments, a greater plurality of back bands (e.g., three (3), four (4) or five (5)) are provided, and each so attached to the main body 3309 of bra 3300 at different vertical positions (or substantially different vertical positions). In such embodiments, each of the plurality of bands may about and touch one another at their upper and lower edges, or, in some embodiments, have multiple gaps between the plurality of bands, with the same possible gap sizes discussed above, but defined with respect to the width of each such back band and/or the combined width of the plurality of back bands.

As with other embodiments for bras set for in the present application, in some embodiments, either or both of upper back band 3301 and lower back band 3302 may include band length adjustment hardware, such as either of example upper slider 3331 and example lower slider 3333, and turnstile(s), such as the ring-shaped turnstile examples provided as upper ring 3335 (e.g., in the form of a ring or "FIG. 8" connector) and lower ring 3337 (e.g., which also may be in the form of a ring or "FIG. 8" connector), as pictured. In some embodiments, as with embodiments of the sliders of bra 800, upper slider 3331 and lower slider 3333 of bra 3300 are provided on opposite sides of bra 3300, in some embodiments, as pictured. Similarly, in some such embodiments, upper double ring 3335 and lower double ring 3337 are provided on opposite sides of bra 3300, as pictured.

In some embodiments, bra 3300 includes multiple shoulder/neck straps, such as example left-hand side shoulder/neck strap 3339 and right-hand side shoulder/neck strap 3341. In some embodiments, such multiple shoulder/neck straps have a plurality of possible strap positions, in accordance with embodiments of the present invention, in that their point of attachment on or about the remainder of bra 3300 may be varied by a user. In some embodiments, left-hand side shoulder/neck strap 3339 and right-hand side shoulder/neck strap 3341 comprise hooks or other variable connectors, such as the example hook fasteners 3343, (e.g., at least one end of each strap, such as back ends, as pictured (a.k.a. "attachment ends") which may be variably attached to any of a plurality of connectors 3345 located at particular connection points (such as those pictured) which, in some embodiments, include connection hardware, such as example loop fasteners shown for connectors 3345, as pictured. In some embodiments, such connectors are integral to bra 3300, and are located at connection points lining or near a top edge of the remainder of bra 3300. In the example pictured, a total of eight (8) such connectors 3345 are provided (split evenly, four each, on each side of bra 3300), and either of the two attachment ends of the shoulder/neck straps may be attached to any of them, at a user's discretion. Thus, the example positions of left-hand side shoulder/neck strap 3339 and right-hand side shoulder/neck strap 3341, fastened to example loops 3347 and 3349, are one set of several possible attachment positions which may be selected and varied by the user, to complement any number of different outfits with various shapes and sizes of decolletage, and change support of and from bra 3300 and the resulting conformation and presentation of the user's body. In other embodiments, for example, the attachment ends of left-hand side shoulder/neck strap 3339 and right-hand side shoulder/neck strap 3341 may be attached on opposite sides from that pictured, by attaching the attachment end of left-hand side shoulder/neck strap 3339 to example loop 3349, while attaching the attachment end of right-hand side shoulder/neck strap 3341 to example loop 3347, for example. In some such embodiments, the straps may then crisscross (not pictured) on the surface of the user's back 3351, aiding in gripping and holding the user's neck from the back. However, in some embodiments with such attachment at opposing sides of the bra, the straps may instead crisscross the user's chest, as pictured in FIG. 35.

It should be noted that, in some embodiments, the number of connectors may be different in number, location and/or spacing between them than that pictured for connectors 3345. For example, in some embodiments, the spacing (i.e., the distance between one connector 3345 and another, adjacent connector 3345, pictured in the present figure is intended to be, or approximately be, a spacing of one-half (½) inch. However, in some embodiments some or all of such spacing is, or approximately is one-quarter (¼) inch. In some embodiments, some or all of such spacing is, or approximately is one-eighth (⅛) inch. In some embodiments, some or all of such spacing is, or approximately is three-quarters (¾) inch. In some embodiments, some or all of such spacing is, or approximately is one (1) inch. In some embodiments, some or all of such spacing is, or approximately is one and an eight (1⅛) inch. In some embodiments, some or all of such spacing is, or approximately is one and one quarter (1¼) inch. In some embodiments, some or all of such spacing is, or approximately is one and one half (1½) inch. In some embodiments, some or all of such spacing is, or approximately is one and three quarter (1¾) inch. In some embodiments, some or all of such spacing is, or approximately is one and seven eighths (1⅞) inch. In some embodiments, some or all of such spacing is, or approximately is two inches, and/or any of the intervals between integers set forth above. In some embodiments, some or all of such spacing is, or approximately is three inches, and/or any of the intervals between integers set forth above. In some embodiments, some or all of such spacing is, or approximately is four inches, and/or any of the intervals between integers set forth above. In some embodiments, some or all of such spacing is, or approximately is five inches, and/or any of the intervals between integers set forth above. In some embodiments, some or all of such spacing is, or approximately is six inches, and/or any of the intervals between integers set forth above. In some embodiments, some or all of such spacing is, or approximately is seven inches, and/or any of the intervals between integers set forth above, etc. In some embodiments, some or all of such spacing is any spacing within the range of ⅛ inch and 8 inches. As another example, of such alternative numbers of such connectors, in some embodiments, a different number of connectors 3345 may be provided. For example, in some embodiments, an alternative total number of six (6) such connectors are provided, with three such connectors being provided on each side of bra 3300. As another example, in some embodiments, an alternative total number of four (4) such connectors are provided, with two such connectors being provided on each side of bra 3300. As another example, in some embodiments, an alternative total number of two (2) such connectors are provided, with one such connector being provided on each side of bra 3300. As another example, in some embodiments, an alternative total number of 10 (10) such connectors are provided, with five such connectors being provided on each side of bra 3300. As another example, in some embodiments, an alternative total number of 12 (12) such connectors are provided, with six such connectors being provided on each side of bra 3300, etc.

In some embodiments, the number of such connectors provided in bras made in accordance with a sizing system of the present application is based on the size of the bra provided. As discussed further below, in reference to FIG. 37, bra 3300 may be provided in a number of alternative sizes, each of which is, in some embodiments, is further adjustable within a range, with length adjustment hardware. For example, at least four different band sizes are provided (and, in some embodiments, as pictured in FIG. 37, an additional four "half-sizes," are provided). Also as discussed below, in some embodiments, a bra may be constructed to match, or substantially match, such different band sizes, while also being constructed to include various sizes for breast supports, i.e., according to cup sizes. Accordingly, based on such four different band sizes, and an example nine (9) different cup sizes (ascending in size with number), and ranging between a size "6" cup and a size "14" cup (which, in some embodiments, may correspond with size A through Size I, in conventional bra cup sizes), the following table is one example of the number of such connectors for bras constructed in accordance with the possible combinations of sizes discussed above:

| Band Size/Cup Size Code(s) | No. of Shoulder Strap Connectors |
|---|---|
| 1/6 | 4 |
| 2/6 | 6 |
| 3/6 | 8 |
| 1/7 & 1/8 | 3 |
| 2/7 & 2/8 | 6 |
| 3/7 & 3/8 | 8 |
| 1/9 | 3 |
| 2/9 | 5 |
| 3/9 | 6 |
| 1/10 | 2 |
| 2/10 | 4 |
| 3/10 | 6 |
| 4/10 | 8 |
| 1/11 | 2 |
| 2/11 | 4 |
| 3/11 | 6 |
| 4/11 | 7 |
| 1/12 | 3 |
| 2/12 | 4 |
| 3/12 | 5 |
| 4/12 | 6 |
| 1/13 | 2 |
| 2/13 | 4 |
| 3/13 | 5 |
| 4/14 | 6 |
| 2/14 | 3 |
| 3/14 | 5 |
| 4/14 | 6 |

Also as with other embodiments for bras set for in the present application, in some embodiments, either or both of left-hand side shoulder/neck strap 3339 and right-hand side shoulder/neck strap 3341 may include neck strap length adjustment hardware, such as example strap length adjustment device 3353 and example strap length adjustment device 3354, respectively, as pictured. In various embodiments, each of which are in the scope of the invention, strap length adjustment device 3353 and/or example strap length adjustment device 3354 may be or include any suitable device known in the art for variably fixing the length of bra straps or other straps. For example, as pictured, in some embodiments, strap length adjustment device 3353 and/or example strap length adjustment device 3354 may be or include a slider.

In some embodiments, left-hand side shoulder/neck strap 3339 and right-hand side shoulder/neck strap 3341 may be variably attached, detached, and repositioned at attachment points in accordance with some embodiments of the present invention. For example, in some embodiments, left-hand side shoulder/neck strap 3339 and right-hand side shoulder/neck strap 3341 may include location-variable, reversible attachment ends, such as those discussed above, allowing a user to vary their attachment position about the surface of the remainder of any other bra set forth in this application.

Figure 34:
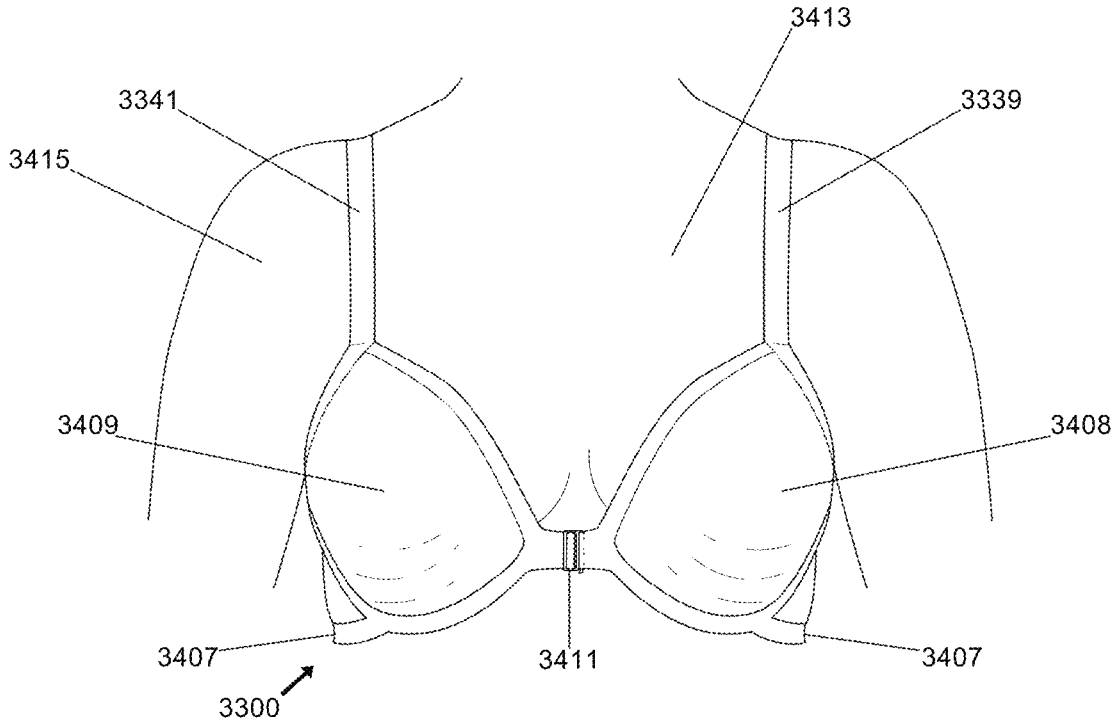
FIG. 34 is a front view of the same example bra set forth in FIG. 33, above, depicting additional aspects of the bra, including multiple shoulder straps with adjustable strap positions, in accordance with embodiments of the present invention.

FIG. 34 is a front view of the same example bra 3300 set forth in FIG. 33, above, depicting additional aspects of the bra, including multiple shoulder straps with adjustable strap positions, in accordance with embodiments of the present invention. As discussed above, in some embodiments, bra 3300 includes left-hand side shoulder/neck strap 3339 and right-hand side shoulder/neck strap 3341, which include repositioning hardware, allowing them to be attached, detached and repositioned in accordance with some embodiments of the present invention. Also pictured are a plurality of supports, configured to support breasts—namely, a left-hand side breast support 3408 and a right-hand side breast support 3409. As discussed with respect to other embodiments of bras and other breast-supporting garments set forth elsewhere in this application, such breast supports may be, or include, breast-accepting cups, in some embodiments. Such breast supports and/or cups may be sized in accordance with any of the sizing methods set forth in this application. Also as discussed with respect to other embodiments of bras and other breast-supporting garments set forth elsewhere in this application, such breast supports, and bra 3300 in general, may be variably fastened (in a closed configuration) and separated (in an opened configuration), with a reversible fastener, in some embodiments, such as example central J-hook fastener 3411, as pictured in such a closed configuration.

Although examples of that repositioning hardware are not pictured in the present figure, as a result of varying the attachment points of attachment on or about an upper edge of bra 3300, a wide variety of wearing and supporting configurations are possible. For example, as discussed above, in some embodiments, the attachment ends of left-hand side shoulder/neck strap 3339 and right-hand side shoulder/neck strap 3341 may be attached on their respective sides, as pictured in the present figure and FIG. 33, above. However, in some embodiments, the attachment ends of left-hand side shoulder/neck strap 3339 and right-hand side shoulder/neck strap 3341 may be attached on opposite sides, for example, by attaching the attachment end of left-hand side shoulder/neck strap 3339 to example loop 3349, while attaching the attachment end of right-hand side shoulder/neck strap 3341 to example loop 3347, for example. In some such embodiments, the straps may then crisscross on the surface of the user's chest 3413, as pictured in FIG. 35, below. As another example, in some embodiments each of left-hand side shoulder/neck strap 3339 and right-hand side shoulder/neck strap 3341 may be configured to lay over the same shoulder, such as example shoulder 3415, for example, at a position such as that shown in FIG. 36, below.

Figure 35:
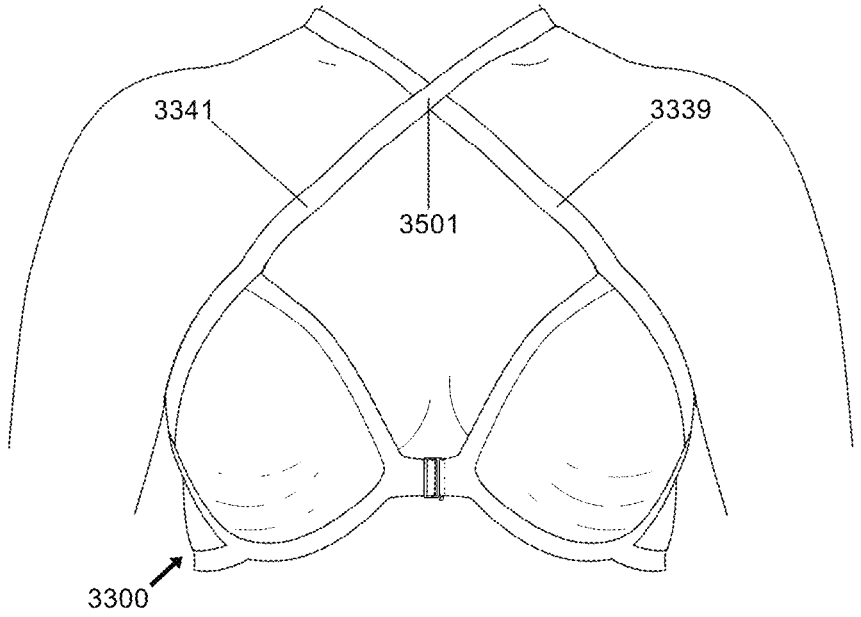
FIG. 35 is a front view of the same example bra set forth in FIGS. 33 and 34, above, depicting additional aspects of the bra, including an alternative wearing configuration of the multiple shoulder straps, in accordance with embodiments of the present invention.

FIG. 35 is a front view of the same example bra 3300 set forth in FIGS. 33 and 34, above, depicting additional aspects of the bra, including an alternative wearing configuration of the multiple shoulder straps, in accordance with embodiments of the present invention. As shown above, in FIG. 34, in some embodiments, example left-hand side shoulder/neck strap 3339 and example right-hand side shoulder/neck strap 3341 were provided in a substantially vertical orientation, in parallel with one another. However, in some embodiments as discussed but not yet shown above, with attachment of ends of the straps on opposing sides of the bra, the straps may instead crisscross the user's chest, as now shown. More specifically, as shown, example left-hand side shoulder/neck strap 3339 and example right-hand side shoulder/neck strap 3341 crisscross at an overlapping area 3501. To effectuate this alternative embodiment, as pictured, and, again, as a result of varying the attachment points of attachment on or about an upper edge of bra 3300 (e.g., selecting opposite sides, such a crisscrossing configuration such as that shown is possible. Among other advantages, such a crisscrossing orientation of the two straps increases lateral compression and holding force of bra 3300, in some embodiments.

Figure 36:
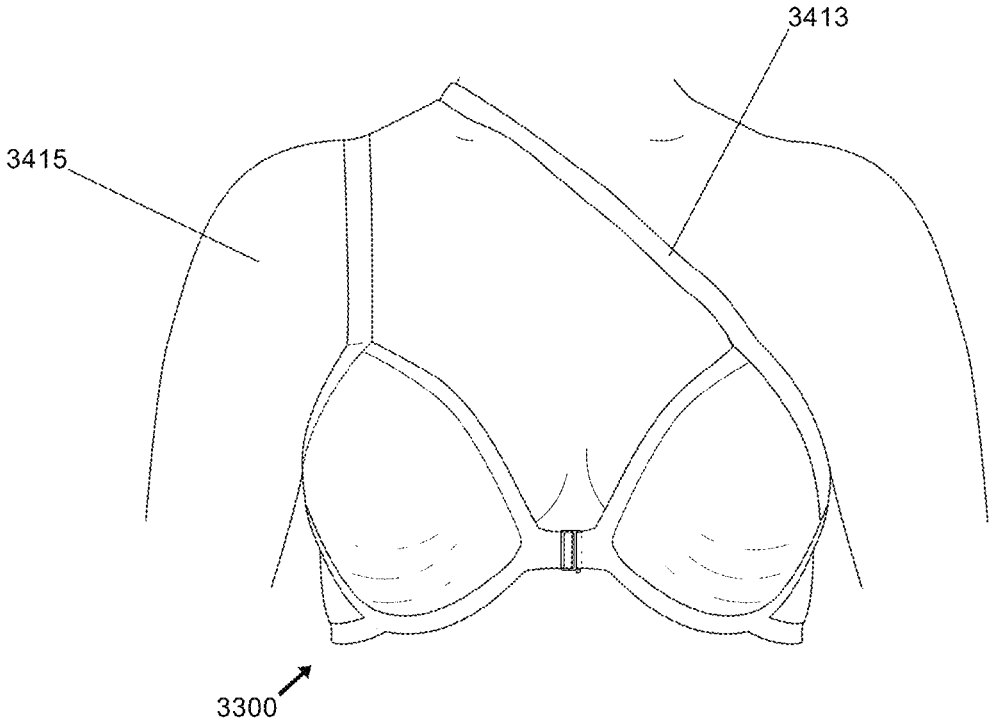
FIG. 36 is a front view of the same example bra set forth in FIGS. 33, and 35, above, depicting additional aspects of the bra, including an alternative wearing configuration of the multiple shoulder straps, in accordance with embodiments of the present invention.

FIG. 36 is a front view of the same example bra 3300 set forth in FIGS. 33, and 35, above, depicting additional aspects of the bra, including an alternative wearing configuration of the multiple shoulder straps, in accordance with embodiments of the present invention. As shown above, in FIG. 34, in some embodiments, example left-hand side shoulder/neck strap 3339 and example right-hand side shoulder/neck strap 3341 are provided in a substantially vertical orientation, in parallel with one another. However, in some embodiments as discussed above, and as now pictured, each of left-hand side shoulder/neck strap 3339 and right-hand side shoulder/neck strap 3341 may be configured to lay over the same shoulder, such as example shoulder 3415. In some embodiments, a user may so configure bra 3300 when wearing bra 3300 under a similarly styled dress or other clothing, having a larger neck strap on the same side as example left-hand side shoulder/neck strap 3339 and example right-hand side shoulder/neck strap 3341.

Figure 37:
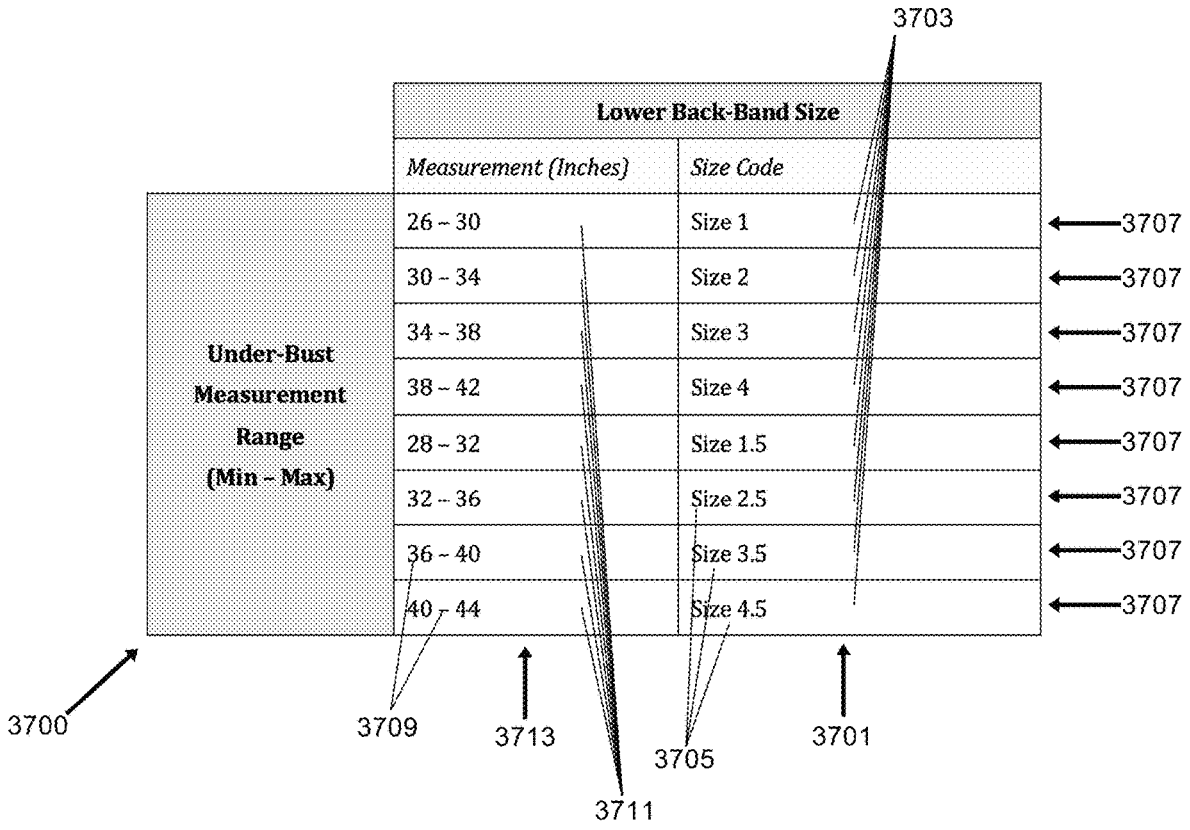
FIG. 37 depicts a table, coding and other example aspects of a sizing system corresponding with bras and other supporting garments, in accordance to some embodiments.

FIG. 37 depicts a table 3700, coding and other example aspects of a sizing system corresponding with bras and other supporting garments, in accordance to some embodiments. According to some embodiments, table 3700 includes a data column 3701 of data cells 3703, each of which contains a specialized size code, such as those shown as example codes 3705. Each of example codes 3705 signifies and corresponds with a unique size of at least part of a bra or other supporting garment created by a sizing system, in accordance with the present application. In some such embodiments, such a sizing system may relate to sizes for bra bands and other structural components of a bra, such as any of the types of bra bands set for in this application. For example, in some embodiments, such a bra or other garment is bra 3300, as discussed above. As also discussed above, either and/or both of such bra bands may wrap entirely around, or part-way around such a torso and, in some such embodiments, may be attached to other components which, together with such a back band, wrap completely around such a torso forming a larger, unified back band with multiple components. In some embodiments, and as also discussed above, such other components include side panels, a main body of a bra, bra supports (e.g., bra cups), fasteners, adjusters, and/or neck or over-the-shoulder straps. As with other embodiments of bras and other supporting garments set forth in the present application, in some embodiments such sizes for bra bands and other structural components of a bra may include a range of lengths which such bra bands and other structural components are adjustable to match, substantially match, and/or correspond with. In some embodiments, such a range of lengths include a minimum and a maximum length that such bra bands and/or other structural components are adjustable to match, substantially match, and/or correspond with, using length adjustment hardware of such bra bands and/or other structural components (e.g., such as example sliders 3331 and 3333).

As with other sizing systems set forth in the present application, example bras and supporting garments in accordance with any one of the example codes within data cells 3703 may match, substantially match, cover and/or correspond with a measurement, or range of measurements, of a particular woman user's body, in various embodiments. In some such embodiments, and also as discussed above, such a measurement is the length of a circumference of a woman's torso at a particular vertical level of the torso. For example, in some embodiments, each of the example codes within data cells 3703 signify that a bra or other garment constructed according to a size code (e.g., any of example size codes 3705) of the sizing system represented by table 3700 will be of a size matching the measurement (i.e., range of measurements), set forth in the cell immediately adjacent to it, within the same table row, as shown by example table rows 3707. Thus, as pictured, such a range of measurements is shown as a range of corresponding example under-bust measurement torso circumference lengths, such as the examples pictured as example under-bust measurement torso circumference lengths 3709 (the numbers shown being in inches), and such ranges being shown in each of example data cells 3711 of table column 3713.

In some embodiments, such a range of measurements matches, or, in some embodiments, substantially matches (e.g., within 1, 2, or 3-5% of the overall length), a set of other sizes set apart by predetermined increments. For example, in some embodiments, conventional bra sizes (e.g., three bra sizes having three different under-bust measurement torso circumference lengths) are covered by the range of measurements signified by each of the example size codes, such as example size codes 3705. For example, in the second row of example table rows 3707, the size code "Size 2" signifies a range of corresponding example under-bust measurement torso circumference lengths from 30 inches to 34 inches, which covers conventional bra band lengths 30, 32 and 34, being set apart from each other by predetermined increment of 2 inches.

In accordance with some embodiments of methods of use of a sizing system such as that represented by table 3700, a user may first measure or otherwise determine her under-bust torso circumference. For example, in some such embodiments, such an under-bust torso circumference may be determined by placing a measuring tape around her torso at a vertical position at or just below a lower point of connection of her breasts to her torso. As another example, in some embodiments, such an under-bust torso circumference may be determined through the user determining her band length from another existing, fitting bra (e.g., within her wardrobe). Following that determination, the user may then select any one of the ranges of under-bust measurement circumference lengths 3707 which best matches, or at least covers, that under-bust torso circumference. In some embodiments, such a best match may be determined by selecting any one of the ranges of under-bust measurement circumference lengths 3707 having an average length that is closest to that under-bust torso circumference. In some embodiments, a user may prefer to have a range of sizes covering her underbust circumference measurement with a wider range of adjustability above and below that measurement, and such an approach is advantageous in that regard. Based on such a range of under-bust measurement circumference lengths, a bra band, set of bra bands and/or other structural components of a bra, can be selected that match, substantially match that range.

The particular array of ranges of lengths shown in table column 3711 of FIG. 37 may be combined with other dimension(s) of bras, in some embodiments, to create a set of dimensions according to which bras may be constructed. For example, as discussed above, in some embodiments, a set of possible cup sizes may be determined, and each may be combined with any of the ranges of lengths set forth in table column 3711, in some embodiments. In some embodiments, such a set of possible cup sizes may be or include any of the cup sizes, or sets thereof, set forth in the present application.

For example, as many as 10 different cup sizes and increments may be provided and used, which do not correspond with the increments of conventional cup sizes, in some embodiments. In some embodiments, the cup sizes provided are fixed cup sizes, meaning that the size of the dimensions of a woman's breast measured (e.g., volume or height of her breast(s)) and corresponding (e.g., matching or fitting) cups matched and provided for that woman (e.g., from subset(s) of a set of such cups or bras) do not vary with different sizes of band length dimensions, band lengths or other band sizes, such as those set forth in the present figure. This fixed size for dimensions and cups (e.g., volume held by a cup and corresponding with a particular cup size) may also be referred to as a "true cup size" or "true cup sizing." In some such embodiments, different coding for cup sizes, and bra sizes, may be used to label and select bras and sets of bras, and to provide bras corresponding with, matching and fitting a woman's body. For example, in some embodiments, different cup sizes and bra sizes, and increments (other than conventional cup sizes and sizing increments) of breast size dimensions and corresponding (e.g., matching or fitting) cups may be provided, and used to identify subsets (of cup sets) corresponding with each increment of such increments of breast size dimensions and corresponding cups. Such different cup size and bra size increments may be labeled with unconventional codes, each code corresponding with a different such bra size increment, preventing confusion with conventional cup size increments and coding. For example, in some embodiments, such different bra size increments may be coded, and ranked as follows: "Cup #1, Cup #2, Cup #3," etc., with cup sizes and dimensions that correspond to each code increasing as the codes progress from left to right. As another example, in some embodiments, such different bra size increments may be coded, and ranked as follows: "Cup Size #1, Cup Size #2, Cup Size #3," etc. In some such embodiments, multiple cup sizes may be covered by a single such code. In some such embodiments, two cup sizes may be covered by a single such code. In some such embodiments, such two cup sizes may be conventional cup sizes. For example, sizes A and B are combined to create Cup #1, in some embodiments.

Any of the aspects for the sizing system set forth in FIG. 37 related to cups, bands or straps may be applied to, and included in, any other sizing system set forth in reference to the present invention. For example, any use of conventional cup sizes in any sizing system set forth in this application may be replaced by the different cup size and bra size increments set forth in reference to FIG. 37. As another example, any of the methods set forth above for creating bras and other supporting garments corresponding to the measurements set forth in FIG. 37 may be applied to any other measurements, and charts of measurements, set forth in this application.

The invention claimed is:

1. A breast-supporting garment, comprising:

a main body, comprising a plurality of supports configured to support breasts of a wearer; and at least two back bands, wherein said at least two back bands comprise:

a first back band having a first length, at a first vertical level just below, or at least partially just below, said breasts, configured to tighten or expand said breast-supporting garment, and wherein said first band comprises hardware configured to continuously adjust said first length of said first band;

a second back band having a second length, at a second vertical level, higher than said first vertical level, configured to tighten or expand said breast-supporting garment, and wherein said second back band comprises hardware configured to continuously adjust the second length of said second back band;

wherein said first back band is attached and vertically fixed to said main body by a first attachment at a first vertical position, said first attachment comprising stitching passing into said first back band and into, and/or an adhesive applied to said main body wherein said first vertical position is different from a second vertical position at which said second back band is attached to said main body by a second attachment, and wherein both the first back band and the second back band are fixed in a first horizontal orientation and a second horizontal orientation by said first attachment and said second attachment, respectively, in which both the first length and the second length are parallel, or substantially parallel, to a length of said main body; and wherein an upper edge of said first back band and a lower edge of said second back band abut each other.

2. The breast-supporting garment of claim 1, wherein said first back band is a band with multiple parts, including an adjustable-length portion and a fixed-length portion, which, together, are configured to wrap completely around a circumference of a torso.

3. The breast-supporting garment of claim 1, wherein said second back band is a band with multiple parts, including an adjustable-length portion and a fixed-length portion, which, together, are configured to wrap completely around a circumference of a torso.

4. The breast-supporting garment of claim 1, wherein said first length of said first back band is configured match a portion of a first circumference of a woman's torso at said first vertical level.

5. The breast-supporting garment of claim 1, wherein said second length of said second back band is configured match a portion of a second circumference of a woman's torso at said second vertical level.

6. The breast-supporting garment of claim 1, wherein said first back band is configured match a first circumference of a woman's torso at said first vertical level.

7. The breast-supporting garment of claim 1, wherein said second back band is configured match a second circumference of a woman's torso at said second vertical level.

8. The breast-supporting garment of claim 1, wherein said breast-supporting garment is a bra.

9. The breast-supporting garment of claim 1, wherein said breast-supporting garment comprises a corset, bustier, camisole, dress, shirt, t-shirt, tank top, crop-top, crotch top, tube-top, bandeau, blouse, vest, jacket, robe, tunic, sweater, sweatshirt, leotard, unitard, catsuit, bodysuit, tights, jumpsuit, wet suit, track suit, rash guard, romper, swimsuit and/or swimsuit top.

10. A breast-supporting garment, comprising:

a main body, comprising a plurality of supports configured to support breasts of a wearer; and at least two back bands, wherein said at least two back bands comprise:

a first back band having a first length, at a first vertical level just below, or at least partially just below, said breasts, configured to tighten or expand said breast-supporting garment, and wherein said first band comprises hardware configured to continuously adjust said first length of said first band;

a second back band having a second length, at a second vertical level, higher than said first vertical level, configured to tighten or expand said breast-supporting garment, and wherein said second back band comprises hardware configured to continuously adjust the second length of said second back band;

wherein said first back band is attached to and vertically fixed to said main body by a first attachment at a first vertical position, said first vertical position comprising stitching passing into said first back band and into said main body, wherein said first attachment at said first vertical position is different from a second vertical position at which said second back band is attached to said main body by a second attachment, and wherein both the first back band and the second back band are fixed by stitching or an adhesive in a first horizontal orientation and a second horizontal orientation by said first attachment and said second attachment, respectively, in which both the first length and the second length are parallel, or substantially parallel, to a length of said main body; and wherein an upper edge of said first back band and a lower edge of said second back band are separated by a structural gap, and wherein said structural gap has a vertical distance of less than the width of said first band and less than the width of said second band.

11. The breast-supporting garment of claim 1, wherein said first back band is configured to be adjusted in length to match a first predetermined range of first band lengths, said first predetermined range comprising a first maximum length and a first minimum length, wherein said first band lengths are spaced apart by a predetermined increment.

12. The breast-supporting garment of claim 1, wherein said second back band is configured to be adjusted in length to match a second predetermined range of second band lengths, said second predetermined range comprising a second maximum length and a second minimum length, wherein said second band lengths are spaced apart by said predetermined increment.

13. The breast-supporting garment of claim 1, wherein said plurality of supports are attached to straps configured to be positioned over-the-shoulder and/or around the neck of a user(s); and wherein said main body comprises a plurality of connection points comprising fasteners, configured to connect with fasteners provided on or about said straps.

14. The breast-supporting garment of claim 1, wherein said first attachment and/or said second attachment comprise(s) stitching.

15. The breast-supporting garment of claim 1, wherein said first attachment and/or said second attachment comprise(s) an adhesive.

16. The breast-supporting garment of claim 1, wherein said first back band and/or said second back band are integral with said main body.

17. The breast-supporting garment of claim 1, wherein said hardware configured to continuously adjust said first length and/or said hardware configured to continuously adjust said second length comprise(s) a slider.

18. The breast-supporting garment of claim 1, wherein said hardware configured to continuously adjust said first length comprises a first slider and a first ring, and said hardware configured to continuously adjust said second length comprises a second slider and a second ring.

19. The breast-supporting garment of claim 18, wherein said first slider and said second slider are provided on opposite sides from each other, of said breast-supporting garment, and wherein said first ring and said second ring are provided on opposite sides from each other, of said breast-supporting garment.

20. A method for providing a breast-supporting garment, comprising the following steps:

providing a breast-supporting garment, comprising:

a main body, comprising a plurality of supports configured to support breasts of a wearer; and at least two back bands, wherein said at least two back bands comprise:

a first back band having a first length, at a first vertical level just below, or at least partially just below, said breasts, configured to tighten or expand said breast-supporting garment, and wherein said first band comprises hardware configured to continuously adjust said first length of said first band;

a second back band having a second length, at a second vertical level, higher than said first vertical level, configured to tighten or expand said breast-supporting garment, and wherein said second back band comprises hardware configured to continuously adjust the second length of said second back band;

wherein said first back band is directly attached by stitching passing into said first back band and into said main body at a first attachment at a first vertical position, different from a second vertical position at which said second back band is attached to said main body by a second attachment, and wherein both the first back band and the second back band are fixed in a first horizontal orientation and a second horizontal orientation by said first attachment and said second attachment, respectively, in which both the first length and the second length are parallel, or substantially parallel, to a length of said main body; and wherein an upper edge of said first back band and a lower edge of said second back band abut each other.

* * * * *